US010426313B2

(12) United States Patent
Choi et al.

(10) Patent No.: US 10,426,313 B2
(45) Date of Patent: Oct. 1, 2019

(54) DISHWASHER

(71) Applicant: LG ELECTRONICS INC., Seoul (KR)

(72) Inventors: Kyuhyung Choi, Seoul (KR); Joonho Pyo, Seoul (KR); Wook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 276 days.

(21) Appl. No.: 15/403,302

(22) Filed: Jan. 11, 2017

(65) Prior Publication Data

US 2017/0354308 A1 Dec. 14, 2017

(30) Foreign Application Priority Data

Jun. 10, 2016 (KR) ..... 10-2016-0072197

(51) Int. Cl.

| | |
|---|---|
| ***A47L 15/23*** | (2006.01) |
| ***A47L 15/42*** | (2006.01) |
| *A47L 15/20* | (2006.01) |
| *A47L 15/22* | (2006.01) |

(52) U.S. Cl.

CPC ..... *A47L 15/23* (2013.01); *A47L 15/421* (2013.01); *A47L 15/4282* (2013.01); *A47L 15/20* (2013.01); *A47L 15/22* (2013.01)

(58) Field of Classification Search

CPC .... A47L 15/23; A47L 15/421; A47L 15/4282; A47L 15/20; A47L 15/22

USPC ..... 134/172

See application file for complete search history.

(56) References Cited

U.S. PATENT DOCUMENTS 5,415,350 A * 5/1995 Yoon ..... A47L 15/23 134/179

FOREIGN PATENT DOCUMENTS

| | | |
|---|---|---|
| CN | 203789884 | 8/2014 |
| CN | 104545744 | 4/2015 |
| CN | 104706293 | 6/2015 |
| CN | 104739346 | 7/2015 |
| JP | 2782943 | 6/1992 |
| KR | 100701168 | 3/2007 |
| KR | 10-2012-0134370 | 12/2012 |
| KR | 10-2015-0009402 | 1/2015 |

(Continued)

OTHER PUBLICATIONS

CN104706293A with machine translation (Year: 2015).*

(Continued)

*Primary Examiner* — Michael E Barr
*Assistant Examiner* — Tinsae B Ayalew
(74) *Attorney, Agent, or Firm* — Fish & Richardson P.C.

(57) ABSTRACT

A dishwasher that includes: a tub configured to accommodate an object; a main arm that is configured to (i) rotate about a first axis inside the tub, (ii) guide first water of the incoming water through a first flow path and second water of the incoming water through a second flow path, and (iii) spray the first water to the object; an auxiliary arm that is configured to (i) rotate about a second axis inside the tub and (ii) spray the second water to the object; and an auxiliary arm connector that couples the main arm to the auxiliary arm and that is rotatable with the auxiliary arm, the auxiliary arm connector including: an auxiliary flow path guide that is configured to (i) guide the second water from the main arm to the auxiliary arm and (ii) control water pressure of the second water is disclosed.

16 Claims, 40 Drawing Sheets

(56) References Cited

FOREIGN PATENT DOCUMENTS

| | | |
|---|---|---|
| KR | 10-2015-0142948 | 12/2015 |
| KR | 10-1598753 | 2/2016 |

OTHER PUBLICATIONS

KR101598753B1 with machine translation (Year: 2016).*
International Search Report and Written Opinion in International Application No. PCT/KR2017/000264, dated Apr. 24, 2017, 8 pages (with English translation).
Extended European Search Report in European Application No. 17161061.1, dated Jun. 6, 2017, 7 pages (with English translation).
Chinese Office Action in Chinese Application No. 201710043818.5, dated Jun. 19, 2019, 13 pages (with English translation).

* cited by examiner

340

(a)

(a)

(b)

B' - B"

C' - C"

D' - D"

F' - F"

G' - G"

(a)

(b)

DISHWASHER

CROSS-REFERENCE TO RELATED APPLICATION

This application claims priority to Korean Patent Application No. 10-2016-0072197, filed on Jun. 10, 2016, whose entire disclosure is hereby incorporated by reference.

TECHNICAL FILED

The present application generally relates to a dishwasher.

BACKGROUND

A dishwasher is an apparatus which washes off debris such as food waste remaining on dishes or cookware (hereinafter referred to as "objects to the washed") using wash water.

In general, the dishwasher includes a washing tub for providing a washing space, a dish rack provided in the washing tub while accommodating objects to be washed, a spray arm for spraying the wash water, a sump for storing wash water, and a supply flow path for supplying the wash water stored in the sump to the spray arm.

In general, wash water is sprayed onto the objects by rotation of the spray arm for spraying wash water to perform washing dishes. Recently, a dishwasher additionally includes an auxiliary arm spraying the wash water.

SUMMARY

This specification describes technologies for a dishwasher.

In general, one innovative aspect of the subject matter described in this specification can be embodied in a dishwasher comprising: a tub configured to accommodate an object; a main arm that is configured to (i) rotate about a first axis inside the tub, (ii) receive incoming water from a water source, (iii) guide first water of the incoming water through a first flow path and second water of the incoming water through a second flow path, and (iv) spray the first water to the object; an auxiliary arm that is coupled to the main arm and that is configured to (i) rotate about a second axis inside the tub and (ii) spray the second water to the object; and an auxiliary arm connector that couples the main arm to the auxiliary arm and that is rotatable with the auxiliary arm, the auxiliary arm connector including: an auxiliary flow path guide that is configured to (i) guide the second water from the main arm to the auxiliary arm and (ii) control water pressure of the second water.

The foregoing and other embodiments can each optionally include one or more of the following features, alone or in combination. In particular, one embodiment includes all the following features in combination. The auxiliary flow path guide is configured to change a water flow direction of the second water. The auxiliary arm connector includes: a flow path formation rib that is coupled to an inner surface of the auxiliary flow path guide and that is configured to divide the incoming water into the first water and the second water. The flow path formation rib is configured to control the water pressure of the second water based on volume of the second water. The auxiliary arm connector includes: a plurality of reinforcing ribs that are coupled to an outer surface of the auxiliary flow path guide and that are configured to support the auxiliary flow path guide. The auxiliary arm includes: a plurality of nozzles that is configured to spray the second water to the object, and wherein each of the plurality of reinforcing ribs includes: one or more depressed grooves for preventing interference with the nozzles of the auxiliary arm. The auxiliary arm includes: one or more first auxiliary nozzles that are configured to spray a first portion of the water that has passed through the second flow path in a first direction, and one or more second auxiliary nozzles that are configured to spray a second portion of the water that has passed through the second flow path in a second direction. The second direction is opposite to a direction that the auxiliary arm rotates. The plurality of reinforcing ribs include: one or more first reinforcing ribs that are coupled to a first portion of the auxiliary flow path guide, and one or more second reinforcing ribs that are coupled to a second portion of the auxiliary flow path guide. A number of the one or more second reinforcing ribs is more than a number of the one or more first reinforcing ribs. The dishwasher further includes a supporting part that is coupled to the auxiliary arm, the supporting part including a coupling hole. The auxiliary arm connector includes: a shaft that is coupled to the supporting part, the shaft being configured to be inserted into the coupling hole of the supporting part, and an insertion key that is protruded from the shaft and that is configured to couple the shaft to the auxiliary arm. The auxiliary arm is configured to rotate within a first angle, and wherein the shaft is configured to rotate about the second axis. The supporting part further includes: a key groove that is coupled to the coupling hole and that is configured to be inserted into the insertion key, and wherein the key groove is spaced apart from the insertion key. The auxiliary arm further includes: a reflective plate that is configured to block water from the coupling hole or the key groove. The auxiliary arm connector further includes: an extending pipe that couples the main arm to the auxiliary flow path guide and that is configured to guide the second water to the auxiliary flow path guide. The extending pipe further includes: one or more sealing ribs that are protruded from an outer surface of the extending pipe and that are configured to block water leaking between the extending pipe and the auxiliary arm, and a plurality of flow path formation protrusions that are protruded from the outer surface of the extending pipe and that are configured to flow a portion of the second water toward the sealing ribs. The auxiliary arm connector is integrated into the main arm. The dishwasher further includes a first gear that is coupled to the tub and that is configured to rotate with the main arm; a second gear that is coupled to the main arm and that is configured to rotate based on rotation of the main arm; and a linker that is coupled to the main arm and the auxiliary arm and that is configured to rotate the auxiliary arm based on rotation of the second gear. The linker is configured to rotate the auxiliary arm using an elastic force.

The subject matter described in this specification can be implemented in particular embodiments so as to realize one or more of the following advantages. Comparing to a conventional dishwasher, a dishwasher includes a specific spray arm that increase a sprayed area of water. Thus, the dishwasher can efficiently wash objects in the dishwasher. In particular, the spray arm can rotate using driving force of sprayed water without using a separate driving device. In addition, the spray arm can spray water at various angles using a main arm and an auxiliary arm.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Additionally, in describing the components of the present disclosure, there may be terms used like first, second, A, B, (a), and (b). These are solely for the purpose of differentiating one component from the other and not to imply or suggest the substances, order or sequence of the components. In this specification, a component is described as "connected", "coupled", or "linked" to another component. In some implementations, it means that one component is directly "connected", "coupled", or "linked" to another component. In some other implementations, it means that one component is indirectly "connected", "coupled", or "linked" to another component through a third component.

Figure 1:
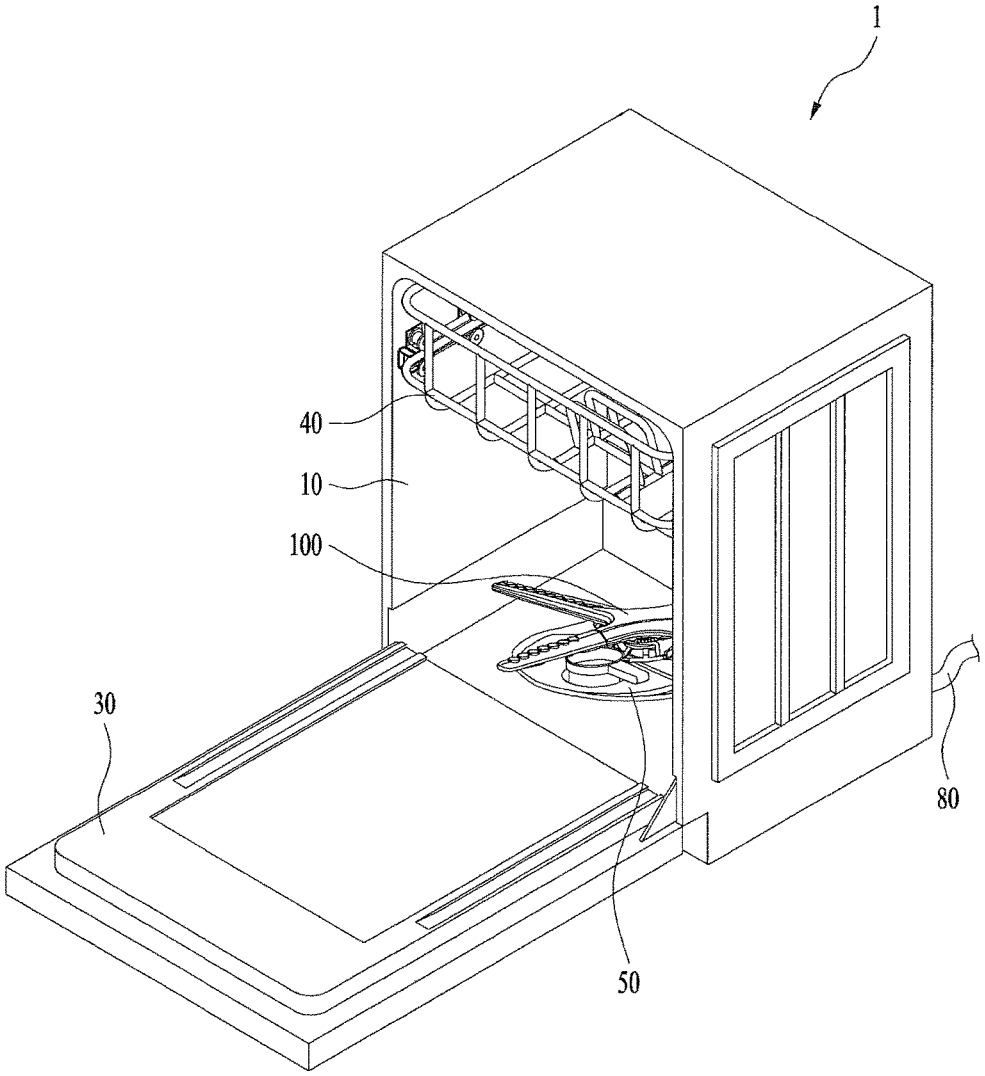
FIG. 1 is a diagram illustrating an example dishwasher.
Figure 2:
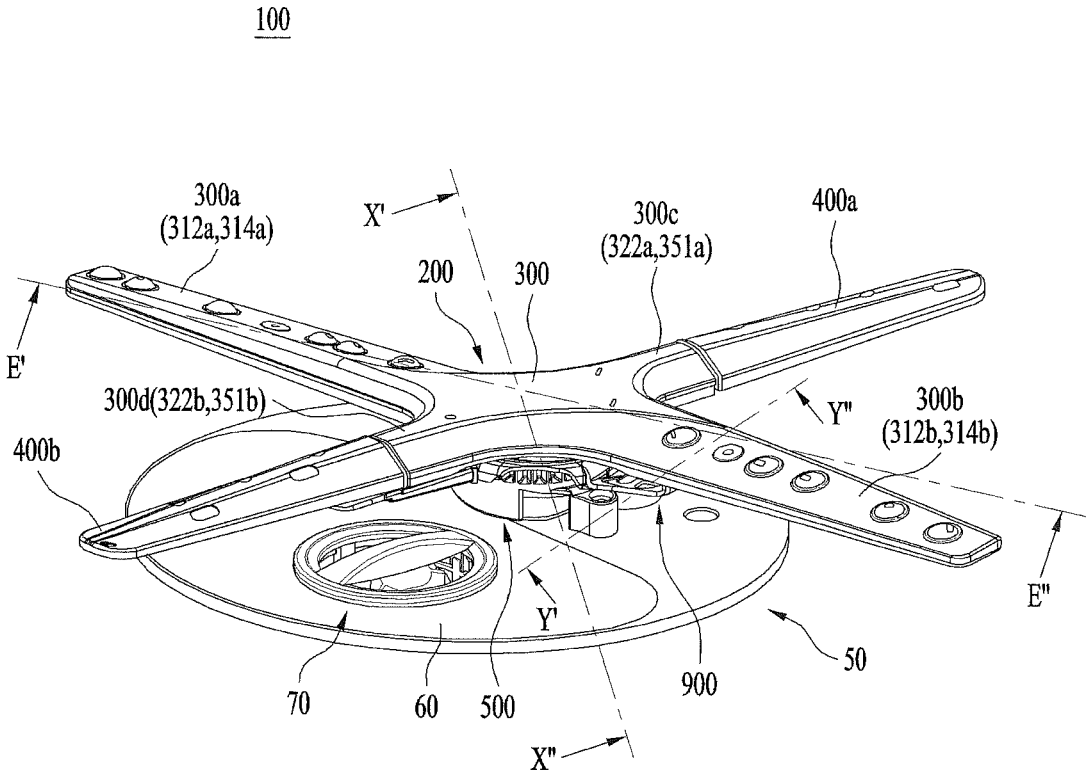
FIG. 2 is a diagram illustrating an example sump cover and an example spray arm assembly.
Figure 3:
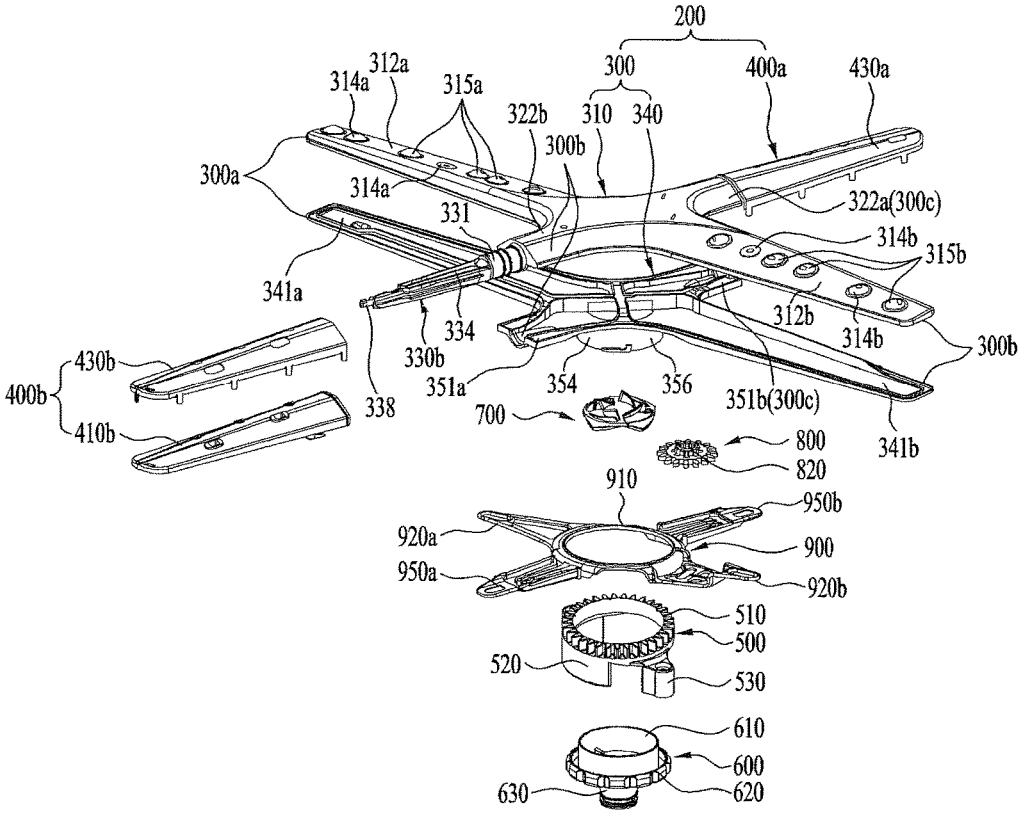
FIG. 3 is a diagram illustrating an example spray arm assembly.

FIG. 1 illustrates an example dishwasher. FIG. 2 illustrates an example sump cover and an example spray arm assembly. FIG. 3 illustrates an example spray arm assembly.

In FIGS. 1 and 2, the dishwasher 1 may include a washing tub 1 forming a washing space tin this example, a door 30 selectively opening/closing the washing space, a dish rack 40, in which objects to be washed are accommodated, provided in the washing tub 10, a sump provided in the washing tub 10 while storing wash water, and a spray arm assembly 100 provided in the washing tub 10 while spraying wash water onto the objects to be washed.

The dish rack 40 may be mounted to be withdrawable to a front of the washing tub 10. The dish rack 40 may include an upper dish rack or a lower dish rack, which is provided an upper part or a lower part of the washing tub 10, respectively. The dish rack 40 may be withdrawn from the washing tub 10 to the front of the washing tub 10, to place or remove the objects.

The sump may include a sump cover 50, a filter 40 provided at the sump cover 50 while filtering foreign substances included in the wash water after washing the objects, and a filter cover. The sump may receive the wash water from the outside through a water pipe 80. The wash water sprayed into the washing tub 10 may be drained through a separate drain. Although not illustrated, a water supply pump for transferring the wash water stored in the sump to the spray arm assembly 100 may be provided in the sump.

In some implementations, in the sump cover 50, the foreign substances, such as food waste, included in the wash water sprayed into the washing tub 10 may be filtered by the filter 70 and the filter cover 60, which are provided at the sump cover 50. The wash water may be collected in the sump through the filter 70 and the collected wash water may be returned to the spray arm assembly 100 by the water supply pump, which is provided in the sump. For example, the wash water supplied through the water pipe 80 may be recycled multiple times.

In this example, the filter cover 60 forms a part of the sump cover 50. The filter cover 60 may be formed at a lower front part of the washing tub 10 (for example, a lower part of the washing tub 10 adjacent to the door 30). The filter 40 is provided at a central part of the filter cover 60 to be inserted into the filter cover 60. Upon detachment of the filter 40, the filter cover 60 may be provided to be detached from the sump cover 50 according to detachment of the filter 70.

In some implementations, the spray arm assembly 100 is rotatably inserted into the central part of the filter cover 60 while a spray arm holder seating part 53 for receiving the wash water is formed. A water hole 59 for supplying the wash water is formed to pass through a central part of the spray arm holder seating part 53. A pair of coupling bosses 51 for fixing a fixed gear 500 of the spray arm assembly 100, which will be described, is formed at and protrudes from both sides of the spray arm holder seating part 53.

In addition, supporting bosses 55 for supporting a spray arm holder 600, which is seated in the spray arm holder seating part 53, are protruded at an upper part of the spray arm holder seating part 53. Each supporting boss 55 may be extended to have a certain height in order to prevent the wash water or the foreign substances introduced into the sump cover 50 from being introduced into the spray arm holder seating part 53.

In some implementations, the water hole 59 for transferring the wash water is formed at the central part of the spray arm holder seating part 53. Seating ribs 57 are formed at an inner circumferential surface of an end of the water hole 59. The seating ribs 57 correspond to an end part of the spray arm holder 600 inserted into the spray arm holder seating part 53 and each seating rib is upwardly extended to the spray arm holder 600.

In this example, the seating ribs 57 are formed to surround extensions 636 formed at the spray arm holder 600 so as to minimize water leakage between the spray arm holder 600 and the spray arm holder seating part 53. The spray arm holder seating part 53 will be explained in detail when the spray arm holder 600 is described below.

As illustrated in FIG. 3, the spray arm assembly 100 is mounted at the sump cover 50 such that the wash water stored in the sump is sprayed onto the objects accommodated in the dish rack 40. In some implementations, an upper spray arm provided between the upper dish rack and the lower dish rack and a top spray arm provided at an upper part of the upper dish rack as well as the spray arm assembly 100 may be further provided in the dishwasher 1.

In some implementations, the spray arm assembly 100 may include a spray arm 200 including a main arm 300 for spraying the wash water and auxiliary arms 400*a* and 400*b* rotatably coupled to the main arm 300, the spray arm holder 600 coupled to a lower part of the spray arm 200 to receive the wash water from the sump cover 50 while rotatably supporting the spray arm 500, the fixed gear 500 fixed to the sump cover 50 to prevent detachment of the spray arm holder 600, an eccentric gear 800 rotatably coupled to the spray arm 200 while being geared to the fixed gear 500 to rotate and revolve along an outer circumferential surface of the fixed gear 500 according to rotation of the spray arm 200, and a linker 900 coupled to the spray arm 200 and reciprocating according to rotation of the eccentric gear 800 to transfer rotational force to the auxiliary arms 400*a* and 400*b*.

In this example, the spray arm assembly 100 may be provided at the upper part of the dish rack 400 as well as the lower part thereof, unlike what is illustrated in FIG. 2. Furthermore, a plurality of spray arm assemblies 100 may be provided to spray the wash water toward the upper and lower parts of the dish rack 40, respectively.

The spray arm 200 may include the main arm 300 formed by coupling a main arm upper housing 310 and a main arm lower housing 340 and at least one of auxiliary arms 400*a* and 400*b* rotatably coupled to the main arm upper housing 310 of the main arm.

In some implementations, the main arm 300 may include a first main arm 300*a* and a second main arm 300*b*, which are extended in opposite directions with respect to a center of rotation of the spray arm assembly 100. The auxiliary arms 400*a* and 400*b* may include a first auxiliary arm 400*a* and a second auxiliary arm 400*b*, which are provided between the first and the second main arms 300*a* and 300*b* with respect to the center of rotation of the spray arm assembly 100, respectively, while the first and the second auxiliary arms 400*a* and 400*b* are coupled to be spaced apart from the first and the second main arms 300*a* and 300*b* at a certain angle, respectively.

In some implementations, a plurality of nozzles 314*a*, 315*a*, 314*b*, 315*b*, and 317*b* for spraying the wash water introduced into the main arm 300 may be formed at upper parts of the first and the second main arms 300*a* and 300*b*. The wash water introduced into the main arm 300 from the sump may be sprayed through the nozzles 314*a*, 315*a*, 314*b*, 315*b*, and 317*b* in an upper direction of the main arm 300 and in an opposite direction to a direction of rotation of the main arm 300.

Thus, the main arm 300 may wash the objects accommodated in the dish rack 40 by the wash water sprayed from the nozzles 314*a*, 315*a*, 314*b*, 315*b*, and 317*b* while driving force for rotating the main arm 300 may be achieved by the wash water sprayed from the nozzles 314*a*, 315*a*, 314*b*, 315*b*, and 317*b*.

The main arm lower housing 340 of the main arm 300 is formed at a lower surface of the main arm 300. A spray arm holder coupler 356 accommodating at least part of the spray arm holder 600 is protruded at the main arm lower housing 340. The wash water is supplied to the first and the second main arms 300*a* and 300*b* and the first and the second auxiliary arms 400*a* and 400*b* through the spray arm holder coupler 356.

In some implementations, the main arm 300 may include a first extension 300*c* and a second extension 300*d*, which are radially extended from the center of the spray arm holder coupler 356. A first auxiliary arm connector 330*a* and a second auxiliary connector 330*b*, at which the auxiliary arms 400*a* and 400*b* are rotatably mounted, may be formed at the first extension 300*c* and the second extension 300*d*, respectively.

In this example, the first and the second main flow paths 301*a* and 301*b* for guiding the wash water introduced through the spray arm holder 600 to the first and the second main arms 300*a* and 300*b* may be formed. The first and the second auxiliary flow paths 301*c* and 301*d* for guiding the wash water to the first and the second extensions 300*c* and 300*d* may be formed.

When the main arm 300 is rotated by driving force generated by spraying of the wash water sprayed from the first and the second main arms 300*a* and 300*b*, the first and the second auxiliary arms 400*a* and 400*b* may reciprocally rotate within a certain angle range due to the linker 900 according to rotation of the main arm 300 working along rotation of the main arm. A plurality of nozzles 414*a*, 415*a*, 414*b*, 415*b*, 422*a* and 422*b* may be formed at the first and the second auxiliary arms 400*a* and 400*b* for spraying the wash water introduced into the main arm 300.

In some implementations, the auxiliary arms 400*a* and 400*b* may include the first auxiliary arm 400*a* rotatably connected to the first extension 300*c* and the second auxiliary arm 400*b* rotatably connected to the second extension 300*d*. A part of the wash water introduced into the main arm 300 may be transferred to the first and the second auxiliary flow paths 301*c* and 301*d* (see FIG. 14) formed in the first and the second auxiliary arms 400*a* and 400*b*. In some implementations, a separate decorative panel 430*a* may be attached to an upper surface of the spray arm 200 to cover the spray arm 200.

The spray arm 200 may be rotated by a separate driving device. The spray arm 200 may be rotated by driving force of the wash water sprayed from the nozzles 314*a*, 315*a*, 314*b*, 315*b*, and 317*b* formed at the first and the second main arms 300*a* and 300*b* and the nozzles 414*a*, 415*a*, 414*b*, 415*b*, 422*a*, and 422*b* formed at the first and the second auxiliary arms 400*a* and 400*b*.

That is, the spray arm 200 may be rotated by driving force generated by spraying the wash water without a separate driving device, such as a motor.

The spray arm holder 600 may be coupled to the lower part of the spray arm 200 to be fixed to the spray arm 200. Accordingly, the spray arm holder 600 may be rotated with the spray arm 200 while functioning as a central shaft of rotation of the spray arm 200.

The spray arm holder 600 includes a main arm inserter 610 coupled to the spray arm holder coupler 356 formed at the main arm 300 in an inserted manner, a separation preventing part 620 protruding from a lower part of the main arm inserter 610 to prevent the fixed gear 500 from being separated, and a sump inserter 630 rotatably inserted into the spray arm holder seating part 53 of the sump cover 50.

In the state where the spray arm holder 600 is coupled to the spray arm 200, the spray arm holder 600 may be inserted into the spray arm holder seating part 53 of the sump cover 50 to be rotatably supported thereby. Furthermore, the wash water supplied from the sump may be supplied to an inside of the spray arm holder 600 through the water hole 59. The wash water introduced into the spray arm holder 600 may be supplied to the first and the second flow paths 301*a* and 301*b* or the first and the second auxiliary flow paths 301*c* and 301*d* through the flow path converter 700.

The flow path converter 700 may be accommodated in the spray arm holder 600 and may function to convert the flow path of the wash water supplied from the spray arm holder 600 to the spray arm 200 into the first and the second main flow paths 301*a* and 301*b* or the first and the second auxiliary flow paths 301*c* and 301*d*.

In some implementations, the flow path converter 700 may be inserted into the spray holder coupler 356 of the main arm 300 and may convert the flow path of the wash water as the flow path converter 700 moves up and down at the inside of the spray arm holder coupler 356 according to supply and stoppage of the wash water.

The flow path converter 700 includes a rotary plate 710 in which a plurality of opening holes 722*a*, 722*c* are formed, a plurality of upper inclined protrusions 720*a*, 720*b*, 720*c*, 720*d* for rotating the rotary plate 710 at a certain angle when the flow path converter 700 ascends according to supply of the wash water, and a plurality of lower inclined protrusions 730*a*, 730*b*, 730*c*, 730*d* for rotating the rotary plate 710 at a certain angle when the flow path converter 700 descends according to stoppage of the wash water.

The fixer gear 500 may be fixed to the sump cover 50 to prevent the spray arm holder 600 coupled to the spray arm 200 from being separated while limiting movement of the spray arm holder 600 such that it is possible to rotate the spray arm 200.

A rim 510, through which the spray arm holder coupler 356 formed at the main arm 300 rotatably passes, while gears are formed at an outer circumferential surface thereof, and fasteners 530 extending from both ends of the rim 510 to be coupled to the coupling bosses 51 of the sump cover 50.

In some implementations, in the state where the spray arm holder coupler 356 is inserted into the fixed gear 500, the spray arm holder 600 is coupled to the spray arm holder coupler 356. Then, the fixed gear 500 may be fixed to the coupling bosses 51 provided at the sump cover 500 through a separate fastener (e.g. a screw, not shown).

Accordingly, in the state where the fixed gear 500 is fixed to the sump cover 50, the fixed gear 500 may prevent the spray arm holder 600 from being separated from the spray arm holder seating part 53 of the sump cover 500, thereby preventing separation of the spray arm 200, while the spray arm holder 600 may rotatably support the spray arm 200.

In a lower surface of the spray arm 200, the eccentric gear 800 may be rotatably mounted at the fixed gear 500 in a geared manner. The eccentric gear 800 may revolve along a circumferential surface of the fixed gear 500 fixed to the sump cover 50 according to rotation of the spray arm 200 while the eccentric gear 800 may be rotated by engagement with the fixed gear 500.

The eccentric gear 800 includes a rim 810, in which gears are geared to the fixed gear 500, provided at a circumferential surface of the thereof; a rotation shaft support protrusion 820 provided at an inside of the rim 810 to be rotatably coupled to a rotation shaft of the main arm 300, and an eccentric protrusion 830 spaced apart from a rotation center of the rotation shaft support protrusion 820 while converting rotational force into linear reciprocating motion in order to transfer the linear reciprocating motion to the linker 900.

The linker 900 may be movably mounted at a lower part of the spray arm 200 to be rotated with rotation of the spray arm 200. The linker 900 may allow the auxiliary arms 400*a* and 400*b* to reciprocally rotate in a longitudinal direction according to rotation of the eccentric gear 800 by rotation of the spray arm 200.

The linker 900 includes a rim-shaped body 910 having an elongated through hole in which the spray arm holder coupler 256 is linearly movable within a certain interval, the first and the second main links 920*a* and 920*b* extending from the rim-shaped body 910 to be coupled to the first and the second main arms 300*a* and 300*b* in a linearly movable manner, and first and the second auxiliary links 950*a* and 950*b* extending from the rim-shaped body 910 while being spaced apart from the first and the second main links 920*a* and 920*b* at an certain angle to be coupled to the first and the second auxiliary arms 400*a* and 400*b* while reciprocally rotate the first and the second auxiliary arms 400*a* and 400*b* according to movement of the rim-shaped body 910. In this example, an eccentric gear container 940, into which the eccentric protrusion 830 of the eccentric gear 800 is inserted, while supporting the eccentric gear 800 is formed at the second main link 920*b*.

A coupling process of each configuration constituting the spray arm assembly 100 as described above will be briefly explained with reference to FIGS. 3 and 4.

Figure 4:
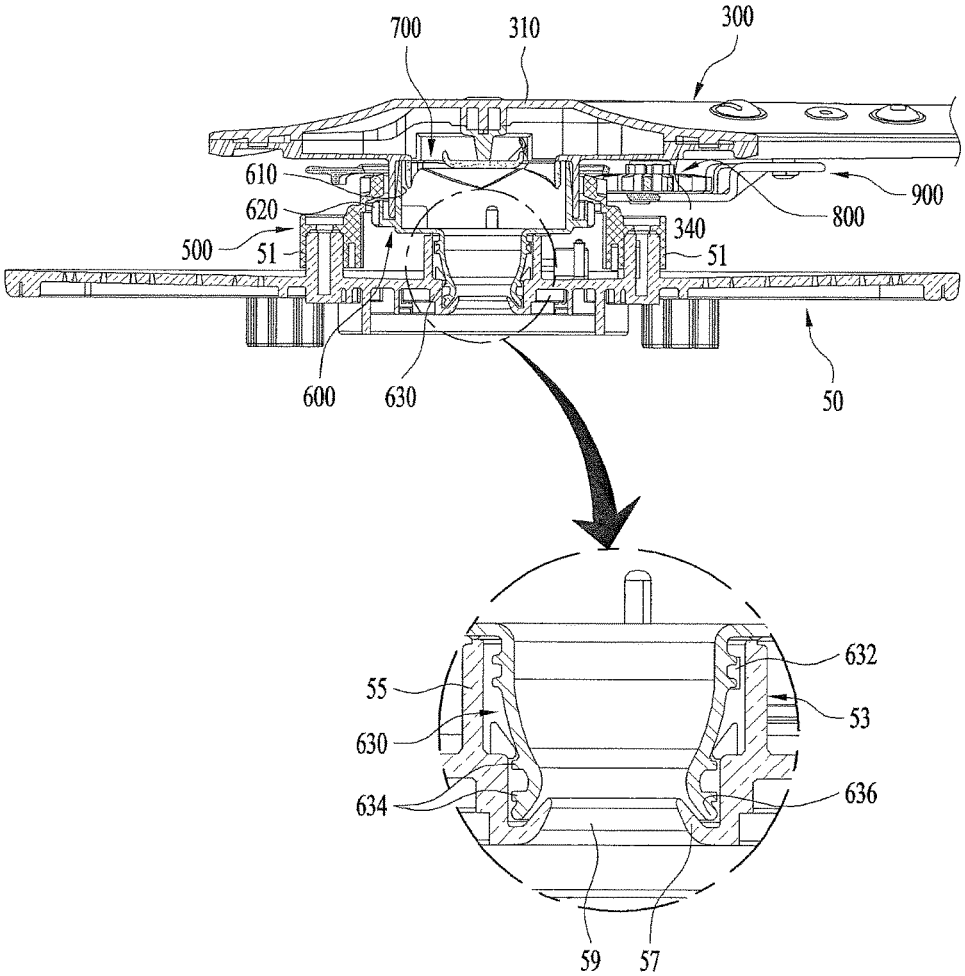
FIG. 4 is a diagram illustrating an example sump cover and an example spray arm assembly.

FIG. 4 illustrates an example sump cover and an example spray arm assembly. FIG. 4 illustrates a cross-sectional view taken along a line X'-X" in FIG. 2.

First, the first and the second auxiliary arms 400*a* and 400*b* are rotatably inserted into the first and the second auxiliary arm connectors 330*a* and 330*b* of the main arm 300. The spray arm holder coupler 356 formed at the lower part of the spray arm 200 is inserted into the rim-shaped body 910 of the linker 900.

In this example, the first and the second main links 920*a* and 920*b* of the linker 900 may be coupled to the first and the second main arms 300*a* and 300*b* in a linearly reciprocating manner. The first and the second auxiliary links 950*a* and 950*b* of the linker 900 may be coupled to the first and the second auxiliary arms 400*a* and 400*b* to rotate the first and the second auxiliary arms 400*a* and 400*b* according to reciprocating motion of the linker 900. The eccentric gear protrusion 830 is inserted into the eccentric gear container 940 formed at the second main link 920*b*, such that the eccentric gear 800 may be supported by and be rotatably provided at the lower part of the main arm 300.

Then, the fixed gear 500 may be rotatably coupled to the spray arm holder coupler 356 formed at the lower part of the spray arm 200 in an inserted manner. In this example, the eccentric gear 800 supported by the eccentric gear container 940 of the second main link 920*b* may be coupled to the gears formed at the fixed gear 500 in an engagement manner, such that the eccentric gear 800 may rotate and revolve along the outer circumferential surface of the fixed gear 500 according to rotation of the main arm 300.

In some implementations, the flow path converter 700 is inserted into the spray arm holder coupler 356. The flow path converter 700 may be accommodated in the main arm inserter 610 provided at the spray arm holder 600.

As the wash water is introduced into the main arm inserter 610, the flow path converter 700 ascends to the main arm inserter 610 by travel pressure of the wash water. Upon stoppage of the wash water, as internal water pressure of the main arm inserter 610 decreases, the flow path converter 700 descends.

In addition, the spray arm holder 600 is coupled to the lower part of the spray arm holder coupler 356. Accordingly, separation of the fixed gear 500 from the spray arm holder coupler 356 due to the spray arm holder 600 may be prevented.

Sequentially, while being inserted into the sump inserter 630 formed at the lower part of the spray arm 600, the fasteners 530 of the fixed gear 500 is coupled to the coupling bosses 51 of the sump cover 50 and the fixer gear 500 is fixed to the sump cover 50 by a separate fastener.

That is, the fixed gear 500 is rotatably coupled to the spray arm holder coupler 356 of the spray arm 200 before the spray arm holder 600 is coupled to and is fixed to the spray arm 200 at the lower part of the fixed gear 500. Then, the spray arm holder 600 is rotatably seated at the spray arm holder seating part 53 of the sump cover 50 and the fixed gear 500 is fixed to the sump cover 50.

Accordingly, the fixed gear 500 of the elements of the spray arm assembly 100 is fixed to the sump cover 50, alone. The spray arm 200, the spray arm holder 600, and the linker 900 of the spray arm assembly 100 are rotatably provided at the sump cover 50. In this example, upward movement of the spray arm holder 600 may be limited by the fixed gear 500, thereby being prevented from separating from the spray arm seating part 53.

In this example, operation of the spray arm assembly 100 will be briefly explained.

First, the wash water introduced through the water pipe 80 moves to the sump using the separate water supply pump and is introduced into the spray arm assembly 100 through the water hole 59 formed at the spray arm holder seating part 53 of the sump cover 50. The wash water introduced into the spray arm assembly 100 may be sprayed onto the objects to be washed through the first and the second main arms 300*a* and 300*b* or the first and the second auxiliary arms 400*a* and 400*b*.

In this example, the spray arm 200 may be rotated in a direction opposite to a spraying direction of the wash water by driving force according to the wash water sprayed by the first and the second main arms 300*a* and 300*b* or the first and the second auxiliary arms 400*a* and 400*b*.

In this example, supply of the wash water to the first and the second main arms 300*a* and 300*b* or the first and the second auxiliary arms 400*a* and 400*b* may be changed by operation of water flow path conversion of the flow path converter 70 according to supply or stoppage of the wash water using the water supply pump.

In some implementations, as the spray arm 200 rotates, the eccentric gear 800 provided at the lower part of the main arm 300 rotates and revolves along the outer circumferential surface of the fixed gear 500. That is, in the state where the fixed gear 500 is fixed to the sump cover 50, the fixed gear 50 maintains the fixed state regardless of rotation of the spray arm 200. In the state where the eccentric gear 800 is rotatably coupled to the main arm 300, the eccentric gear 800 is geared to the fixed gear 500 such that the eccentric gear 800 may revolve along the outer circumferential surface of the fixed gear 500 according to rotation of the main arm 300.

In some implementations, the eccentric protrusion 830 of the eccentric gear 800 is inserted into the second main link 830*b* of the linker 900. The eccentric protrusion 830 performs a circular motion with respect to the center of the rotation to have a certain interval according to rotation of the eccentric gear 800. Thus, the linker 900 into which the eccentric protrusion 830 is inserted linearly reciprocates due to rotation of the eccentric protrusion 830 at the lower part of the main arm 300.

In this example, the first and the second auxiliary arms 400*a* and 400*b* are connected to the first and the second auxiliary links 950*a* and 950*b* of the linker 900. The first and the second auxiliary arms 400*a* and 400*b* connected to first and the second auxiliary links 950*a* and 950*b* reciprocally rotates according to the reciprocating motion of the linker 900 such that a spraying angle of the wash water sprayed from the first and the second auxiliary arms 400*a* and 400*b* may be changed.

In this example, each configuration of the spray arm assembly 100 will be described in detail, with reference to the accompanying drawing.

First, the main arm 300, i.e. a main configuration of the spray arm assembly 100, will be described in detail, with reference to the accompanying drawing.

Figure 5:
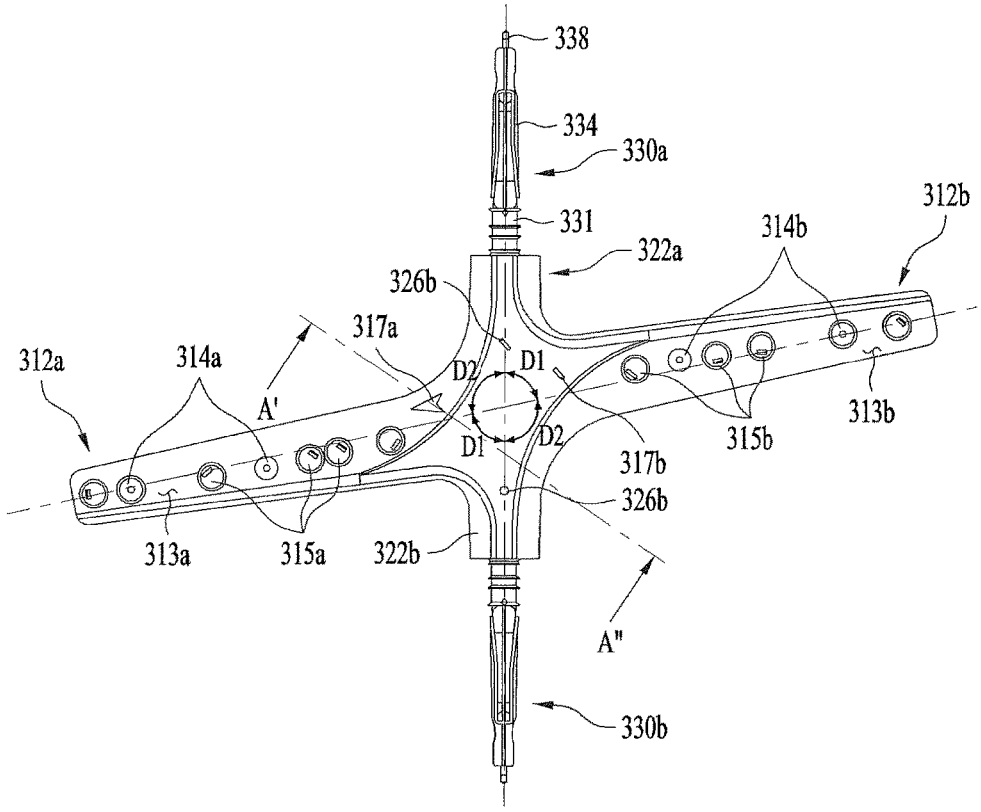
FIG. 5 is a diagram illustrating an example main arm.

FIG. 5 illustrates an example main arm.

As illustrated in FIG. 5, the main arm 300 may include the first and the second arms 300*a* and 300*b* having an asymmetric structure while extending in opposite directions, respectively, and the first and the second extensions 300*c* and 300*d* between the first and the second arms 300*a* and 300*b* while inclinedly extending at a certain angle with respect to the first and the second main arms 300*a* and 300*b*. In this example, the first and the second auxiliary arms connectors 330*a* and 330*b*, which are rotatably coupled to the first and the second auxiliary arms 400*a* and 400*b*, may be formed at the ends of the first and the second extensions 300*c* and 300*d*, respectively.

In some implementations, the flow path for transferring the wash water in the main arm 300 may be formed by the main arm upper housing 310 for forming the upper part of the main arm 300 and the main arm lower housing 340.

In this example, in the main arm upper housing 310, the first and the second upper main arms 312*a* and 312*b* forming the upper part of the first and the second main arm 300*a* and 300*b* and first and the second upper extensions 322*a* and 322*b* for forming the upper part of the first and the second extensions 300*c* and 300*d* are formed.

In addition, in the main arm lower housing 340, the first and the second lower main arms 341*a* and 341*b* forming the lower part of the first and the second main arm 300*a* and 300*b* and first and the second lower extensions 351*a* and 351*b* for forming the lower part of the first and the second extensions 300*c* and 300*d* are formed. In this example, the first and the second auxiliary arm connectors 330*a* and 330*b* and the first and the second upper main arms 312*a* and 312*b* may be formed at the ends of the first and the second main arms 312*a* and 312*b* in an integrated manner.

In this example, an angle between the first main arm 300*a* (or the second main arm 300*b*) and the first extension 300*c* (or the second extension 300*d*) may be an obtuse angle D2. An angle between the first main arm 300*a* (or the second main arm 300*b*) and the second extension 300*d* (or the first extension 300*c*) may be an acute angle D1.

That is, a certain angle between a central line passing through a center of the first and the second arms 300*a* and

300*b* and a central line passing through a center of the first and the second extensions 300*c* and 300*d* may be formed at the center of rotation.

In this example, since the obtuse angle D2 between the first and the second main arms 300*a*, 300*b* and the first and the second extensions 300*c* and 300*d* is formed, a detachment space of the filter 70 and the filter cover 60 which are provided at the lower part of the spray arm 200 may be secured.

However, if the detachment space is secured regardless of the angle between the first and the second main arms 300*a*, 300*b* and the first and the second extensions 300*c* and 300*d*, the angle between the first and the second main arms 300*a*, 300*b* and the first and the second extensions 300*c* and 300*d* may be varied.

In some implementations, the angle between the first and the second main arms 300*a*, 300*b* and the first and the second extensions 300*c* and 300*d* may be a right angle. Various modifications thereof are possible according to design change of the main arm 300. The angle between the first and the second main arms 300*a*, 300*b* and the first and the second extensions 300*c* and 300*d* is not limited thereto.

Furthermore, the first and the second main arms 300*a* and 300*b* may be asymmetrically formed with respect to the first and the second extensions 300*c* and 300*d*. However, the forming state of the first and the second main arms 300*a* and 300*b* is not limited thereto. The first and the second main arms 300*a* and 300*b* may be symmetrically formed respect to the first and the second extensions 300*c* and 300*d*.

As illustrated, the main arm 300 may form the flow path for transferring the wash water by coupling the main arm upper housing 310 to the main arm lower housing 340.

Figure 6:
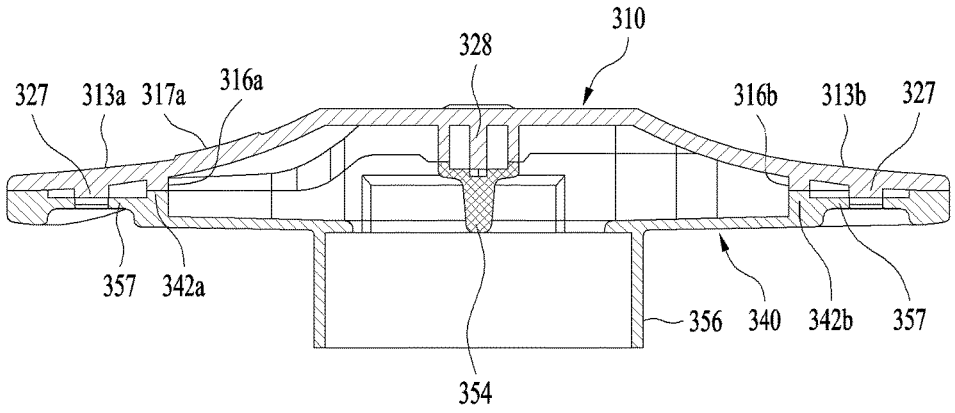
FIG. 6 is a diagram illustrating an example main arm in FIG. 5.

FIG. 6 illustrates an example main arm in FIG. 5. FIG. 6 illustrates a cross-sectional view along a line A'-A" in FIG. 5.

As illustrated in FIG. 6, the main arm 300 may be formed by coupling the main arm upper housing 310 to the main arm lower housing 340. In this example, the main arm upper housing 310 and the main arm lower housing 340 may be integrated using heat/ultrasonic welding.

Thus, the first and the second main flow paths 301*a* and 301*b* of the first and the second main arms 300*a* and 300*b* and the first and the second auxiliary flow paths 301*c* and 301*d* of the first and the second extensions 300*c* and 300*d* may be formed at the lower surface of the main arm upper housing 310. In addition, welding ribs 327 are formed at to the main arm lower housing 340 to be welded.

In addition, in the upper surface of the main arm lower housing 340, welding steps 357, at which the welding ribs 327 is welded, having a shape corresponding to the welding ribs 327 are formed along outer circumferential surfaces of the first and the second main flow paths 301*a* and 301*b* of the first and the second main arms 300*a* and 300*b* and the first and the second auxiliary flow paths 301*c* and 305 of the first and the second extensions 300*c* and 300*d*. The welding ribs 327 and the welding steps 357 will be described in detail when the main arm upper housing 310 and the main arm lower housing 340 are described.

Hereinafter, the main arm upper housing 310 of the main arm 300 will be described in detail, with reference to the accompanying drawing.

Again, referring to FIG. 5, an upper shape of the main arm upper housing 310 will be explained.

As illustrated in FIG. 5, a first inclined surface 313*a* having a downward slope in an opposite direction to a rotation direction of the spray arm 200 may be formed at the upper surface of the first upper main arm 312*a* of the main arm upper housing 310. A second inclined surface 313*b* having a downward slope in an opposite direction to a rotation direction of the spray arm 200 may be formed at the upper surface of the second upper main arm 312*b*.

In this example, the first and the second inclined surfaces 313*a* and 313*b* may be extended to the first and the second upper extensions 322*a* and 322*b* to have inclinedly curved shapes. The first and the second inclined surfaces 313*a* and 313*b* may be formed in order to widen a range of spraying angles of a plurality of the nozzles 314*a*, 315*a*, 314*b*, 315*b* formed at the first upper main arm 312*a* and the second upper main arm 312*b*.

In some implementations, the first nozzles 314*a* spraying the wash water in a vertical direction of the spray arm 200 and first inclined nozzles 315*a* inclinedly formed in an opposite direction to a rotation direction of the spray arm 200 to generate driving force which allows the spray arm 200 to be capable of rotating may be formed at the first inclined surface 313*a*.

Furthermore, second nozzles 314*b* spraying the wash water in a vertical direction of the spray arm 200 and second inclined nozzles 315*b* inclinedly formed in an opposite direction to a rotation direction of the spray arm 200 to generate driving force which allows the spray arm 200 to be capable of rotating may be formed at the second inclined surface 313*b*.

In this example, the first and the second nozzles 314*a* and 314*b* and the first and the second inclined nozzles 315*a* and 315*b* may be formed to have different radiuses or to have different sprayed areas, with respect to the center of rotation of the main arm upper housing 310.

In some implementations, in the case of the first and the second nozzles 314*a* and 314*b* and the first and the second inclined nozzles 315*a* and 315*b*, the quantity thereof may be increased or decreased in order to secure the sprayed areas of the wash water and to form of driving force for rotation of the spray arm 200. Forming positions and spray directions may be varied.

Furthermore, the first and the second inclined nozzles 315*a* and 315*b* may be formed to have various spray angles in order to secure washing areas. However, the first and the second inclined nozzles 315*a* and 315*b* may be formed to have the total of driving force due to the wash water sprayed from the first and the second inclined nozzles 315*a* and 315*b* may be equal to or greater than minimum driving force for rotation of the spray arm 200.

In addition, an upper marker 317*a* having a certain figure or character shape may be formed at a surface of the first upper main arm 312*a* to check a welding direction of the main arm upper housing 310 upon welding of the main upper housing 310 and the main arm lower housing 340.

Furthermore, a separate central nozzle 317*b* may be further formed at the center of rotation of the first upper main arm 312*a* or the second upper main arm 312*b* to spray the wash water to the center of rotation of the main arm 300. In this example, since the nozzles formed at the first and the second upper main arms 312*a* and 312*b* are uniformly distributed, the central nozzle 317*b* may be formed at one side of the first upper main arm 312*a* or the second upper main arm 312*b*.

The first and the second auxiliary arm connectors 330*a* and 330*b* supporting the first and the second auxiliary arm 400*a* and 400*b* are rotatably formed at the first and the second upper extensions 322*a* and 322*b*. First and the second ports 324*a* and 324*b* are formed at the ends of the first and the second upper extensions 322*a* and 322*b* to communicate with the first and the second auxiliary arm connectors 330*a* and 330*b*.

In some implementations, separate first and the second central nozzles 326*a* and 326*b* may be further formed at centers of rotation of the first and the second upper extensions 322*a* and 332*b* in order to spray the wash water to the center of rotation of the main arm 300. In this example, in the case of the first and the second extensions 322*a* and 322*b*, since the nozzles 414*a*, 415*a*, 414*b*, 415*b*, 422*a*, 422*b* are formed at the first and the second auxiliary arms 400*a* and 400*b* only (see FIG. 12), a small amount of wash water may be sprayed onto the centers of the first and the second extensions 322*a* and 322*b*. Thus, the separate first and the second central nozzles 326*a* and 326*b* may be further formed at the first and the second upper extensions 322*a* and 322*b*.

In addition, the first and the second central nozzles 326*a* and 326*b* may be formed to have different radiuses at the center of rotation of the main arm 300. The first and the second central nozzles 326*a* and 326*b* may be formed in different shapes in order to have different washing efficiency. For example, the first central nozzle 326*a* may be formed to have a slot shape. The second central nozzle 326*b* may be formed to have a circular shape.

Figure 7:
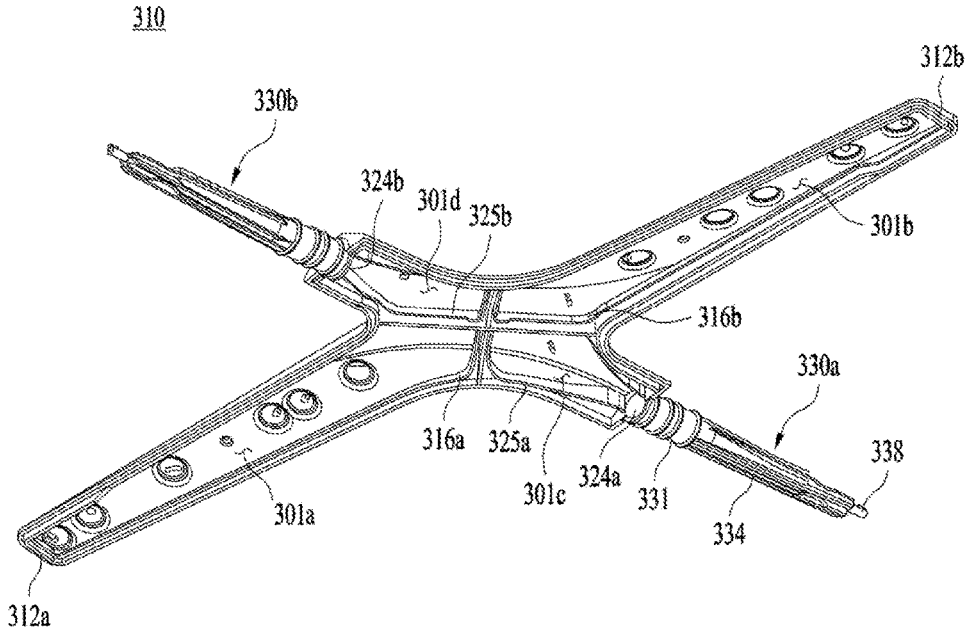
FIG. 7 is a diagram illustrating an example upper housing of the main arm in FIGS. 5-6.

FIG. 7 illustrates an example upper housing of the main arm in FIGS. 5-6.

In some implementations, as illustrated in FIG. 7, the welding ribs 327 for being welding to the main arm lower housing 340 are formed at the lower part of the upper main arm 310. Herein the welding ribs 327 are formed to extend to define the first and the second main arms 312*a* and 312*b* and the first and the second upper extensions 322*a* and 322*b*, thereby forming the first and the second main flow paths 301*a* and 301*b* and the first and the second auxiliary flow paths 301*c* and 301*d*.

In addition, a cross-shaped upper flow path formation rib 328 is formed at the center of rotation of the main arm upper housing 310 to define the flow path, such that wash water may be introduced into the first and the second main flow paths 301*a* and 301*b* and the first and the second auxiliary flow paths 301*c* and 301*d* through the main arm lower housing 340, which will be described below.

In some implementations, in the first and the second main flow paths 301*a* and 301*b* and the first and the second auxiliary flow paths 301*c* and 301*d*, a plurality of ribs may be formed inside the welding ribs 327 to guide the flow path of wash water moving to the first and the second main flow paths 301*a* and 301*b* and the first and the second auxiliary flow paths 301*c* and 301*d*.

In this example, the first and the second upper ribs 316*a* and 316*b* formed at the first and the second main flow paths 301*a* and 301*b* may be protruded from the upper flow path formation rib 328 to insides of the first and the second main flow paths 301*a* and 301*b*. The first and the second upper ribs 316*a* and 316*b* may be provided to be in contact with first and the second lower ribs 324*a* and 342*b* formed at the main arm lower housing 340, which will be described below, in order to form the flow paths.

Furthermore, the first and the second extension upper ribs 325*a* and 325*b* formed at the first and the second auxiliary flow paths 301*c* and 301*d* may be protruded from the upper flow path formation rib 328 to insides of the first and the second auxiliary flow paths 301*c* and 301*d*. The first and the second extension upper ribs 325*a* and 325*b* may be provided to be in contact with first and the second extension lower ribs 352*a* and 352*b* formed at the main arm lower housing 340, which will be described below, in order to form the flow paths.

In some implementations, in the case of the first and the second extension upper ribs 325*a* and 325*b* formed at the first and the second auxiliary flow paths 301*c* and 301*c*, the first and the second extension upper ribs 325*a* and 325*b* may be inclined to correspond to the shapes of the first and the second ports 324*a* and 324*b* such that the wash water flowing through the first and the second auxiliary flow paths 301*c* and 301*d* may be smoothly introduced into the first and the second ports 324*a* and 324*b* formed at the first and the second extensions 300*c* and 300*d*.

The first and the second auxiliary arm connectors 330*a* and 330*b* and the first and the second extensions 300*c* and 300*d* are formed at the ends of the first and the second upper extensions 322*a* and 322*b* in an integrated manner. The first and the second auxiliary arm connectors 330*a* and 300*b* are formed in opposite directions to each other while having the same shape. Hereinafter, only the first auxiliary arm connector 330*a* formed at the first upper extension 322*a* will be described below.

Figure 8:
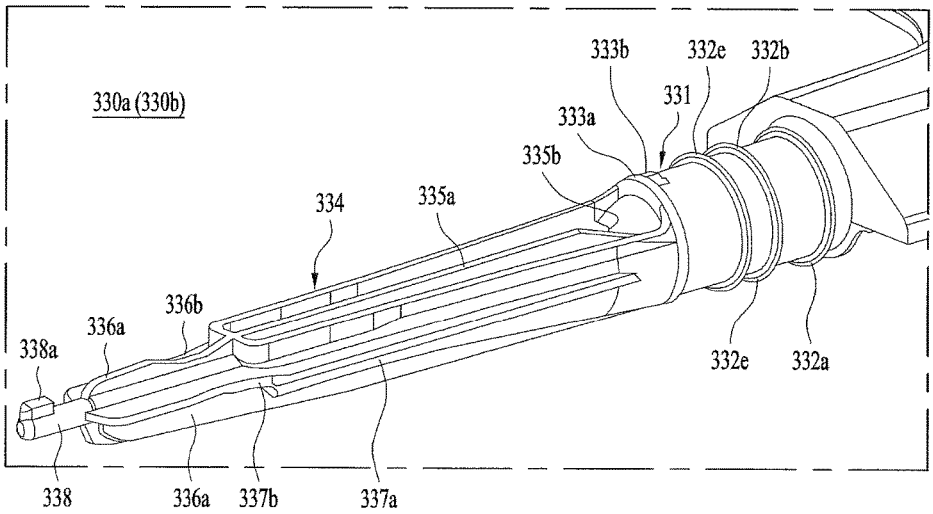
FIG. 8 is a diagram illustrating an example auxiliary arm connector of the main arm in FIGS. 5-6.

FIG. 8 illustrates an example auxiliary arm connector of the main arm in FIGS. 5-6.

As illustrated in FIG. 8, the first auxiliary arm connector 330*a* includes an extending pipe 331 communicating with the first port 324*a* of the first upper extension 322*a*, and an auxiliary flow 334 communicating with an end of the extending pipe 331 and converting the flow path of the wash water upwards, and a shaft 338 extending at an end of the auxiliary flow path guide 334 to rotatably supporting the first auxiliary arm 400*a*.

In this example, a plurality of sealing ribs 332*a*, 332*b*, 332*c* are provided between the extending pipe 331 and the first auxiliary arm 400*a* to seal water leaking. For example, the sealing ribs 332*a*, 332*b*, 332*c* can have ring shapes. Flow path forming protrusions 333*a* are provided between the extending pipe 331 and the auxiliary flow path guide 334. The auxiliary flow path guide 334 introduces a part of the wash water into the extending pipe 331. In some implementations, the flow path forming protrusions 333*a* can be provided on an outer circumferential surface of the extending pipe 331. The flow path forming protrusions 333*a* can be symmetrically provided on the surface of the extending pipe 331.

In this example, the sealing ribs 332*a*, 332*b*, 332*c* and the flow path forming protrusions 333*a* may be symmetrically formed at an inner circumferential surface of the first auxiliary arm 400*a*. That is, when the sealing ribs 332*a*, 332*b*, 332*c* and the flow path forming protrusions 333*a* completely adhere to the first auxiliary arm 400*a*, rotation of the first auxiliary arm 400*a* may be restricted by frictional force. Thus, a space between the first auxiliary arm 400*a*, and the sealing ribs 332*a*, 332*b*, 332*c* and the flow path forming protrusions 333*a* may be formed such that the first auxiliary arm 400*a* can rotate.

In some implementations, a space between a pair of sealing ribs of the sealing ribs 332*a*, 332*b*, and 332*c* may be equal to or greater than a width of each foreign substance discharge hole 419*a* (see FIG. 13) formed at the first auxiliary arm 400*a*, which will be described below.

In this example, in the case of the foreign substance discharge holes 419*a* of the first auxiliary arm 400*a*, when the wash water is introduced into the first auxiliary arm 400*a*, the wash water may be partially introduced by pressure of the wash water between the extending pipe 331 and the first auxiliary arm 400*a* through the flow path forming protrusion 333*a*, and the introduced wash water may discharge the foreign substances introduced between the extending pipe 331 and the first auxiliary arm 440*a* through the foreign substance discharge hole 419*a*.

In addition, an upper supporting protrusion 333*b* and a lower supporting protrusion 333*c* are protruded at a front upper surface and a rear lower surface of the extending pipe 331. The upper supporting protrusion 333*b* and the lower supporting protrusion 333*c* prevent the sealing ribs 332*a*, 332*b*, and 332*c* and the flow path forming protrusions 333*a* from being damaged by insertion error when the extending pipe 331 is inserted into the first auxiliary arm 440*a*, or from being damaged when the spray arm assembly 100 moves in the state where the auxiliary arm 400*a* is coupled to the spray arm assembly 100.

The upper supporting protrusion 333*b* and the lower supporting protrusion 333*c* are formed to have the same heights as the sealing ribs 332*a*, 332*b*, and 332*c* or the flow path forming protrusions 333*a* or to have comparatively large areas, such that the upper supporting protrusion 333*b* and the lower supporting protrusion 333*c* may be formed to have higher strength than sealing ribs 332*a*, 332*b*, and 332*c* or the flow path forming protrusions 333*a*.

The auxiliary flow path guide 334 may extend from the end of the extending pipe 331 and may be formed to have a drum-shaped body with an open upper part and having a certain length. The auxiliary flow path guide 334 is formed to allow a direction of the wash water passing through the extending pipe 331 to be changed upwards, such that the wash water flows to the nozzles 414*a*, 415*a*, and 422*a* of the first auxiliary arm 400*a*.

A flow path formation rib 335*a* extending in a longitudinal direction of the auxiliary flow path guide 334 may be further provided in the auxiliary flow path guide 334. To reinforce the auxiliary flow path guide 334, the flow path formation rib 335*a* may extend in a vertical direction in the auxiliary flow path guide 334 to maintain a shape of the auxiliary flow path guide 334. In addition, the flow path formation rib 335*a* may allow inner volume of the auxiliary flow path guide 334 to be decreased such that pressure of the wash water passing through the auxiliary flow path guide 334 may be temporarily increased.

In some implementations, an inclined part 335*b* may be formed at a front end of the flow path formation rib 335*a* (i.e. the extending pipe 331 side) to prevent the foreign substances from becoming stuck in the flow path formation rib 335*a* when the wash water introduced into the extending pipe 331 with the foreign substances is introduced into the flow path formation rib 335*a*.

Furthermore, a plurality of horizontal reinforcing ribs 337*a* may be formed at both sides of the auxiliary flow path guide 334 to reinforce the auxiliary flow path guide 334 from horizontal impact applied to the auxiliary flow path guide 334. A plurality of vertical reinforcing ribs 336*a* may be formed at the upper part and the lower part of the auxiliary flow path guide 334 to reinforce the auxiliary flow path guide 334 from vertical impact and load applied to the auxiliary flow path guide 334.

In this example, in impact applied to the auxiliary flow path guide 334, vertical impact and load may be more greatly applied to the auxiliary flow path guide 334 than horizontal impact and load. Thus, there may be more vertical reinforcing ribs 336*a* than horizontal reinforcing ribs 337*a*.

Furthermore, the vertical reinforcing ribs 336*a* and the horizontal reinforcing ribs 337*a* may be formed nearby an inner circumferential surface of the first auxiliary arm 440*a*. Thus, the vertical reinforcing ribs 336*a* and the horizontal reinforcing ribs 337*a* allow inner volume of the first auxiliary arm 440*a* to be decreased such that pressure of the wash water supplied to the first auxiliary arm 440*a* is temporarily increased, in the manner of the flow path formation rib 335*a*.

In some implementations, a plurality of depressed grooves 336*b* and 337*b* may be formed at outsides of the vertical reinforcing ribs 336*a* and the horizontal reinforcing ribs 337*a* to prevent interference with the nozzles formed at the first auxiliary arm 400*a*.

For example, since the vertical reinforcing ribs 336*a* and the horizontal reinforcing ribs 337*a* are inserted into the first auxiliary arm 400*a* and are formed adjacent to the inner circumferential surface of the first auxiliary arm 400*a*, the nozzles 414*a*, 415*a*, and 422*a* formed at the first auxiliary arm 400*a* may be closed by the vertical reinforcing ribs 336*a* and the horizontal reinforcing ribs 337*a* upon rotation of the first auxiliary arm 400*a*.

Thus, a plurality of depressed grooves 336*b* and 337*b* may be further formed at the outsides of the vertical reinforcing ribs 336*a* and the horizontal reinforcing ribs 337*a* such that the wash water may be introduced into the nozzles 414*a*, 415*a*, and 422*a* upon rotation of the first auxiliary arm.

The shaft 338 is protruded from an end of the auxiliary flow path guide 334 to be inserted into an inner end of the first auxiliary arm 400*a* to rotatably support the first auxiliary arm 400*a*. The shaft 338 may be formed at a position spaced apart from the extending pipe 331 to disperse load applied to the first auxiliary arm 400*a*.

In some implementations, an insertion key 338*a* is protruded at one side of an end of the shaft 338. The insertion key 338*a* is inserted into a key groove 417*a* (see FIG. 14) formed at the first auxiliary arm 400*a* to prevent the first auxiliary arm 400*a* from being separated from the shaft 338. To this end, in the state where the first auxiliary arm 400*a* is normally installed, the insertion key 338*a* and the key groove 417*a* may be provided at opposite directions to each other.

For example, when the first auxiliary arm 400*a* is coupled to the first auxiliary arm connector 330*a*, the first auxiliary arm 400*a* is inserted in reverse such that the insertion key 338*a* of the shaft 338 may be reversely inserted into the key groove 417*a* of the first auxiliary arm 400*a*. After being completely inserted into the first auxiliary arm 400*a*, the first auxiliary arm 400*a* turns in reverse, again such that the insertion key 338*a* of the shaft 338 cannot be separated from the key groove 417*a*.

Hereinafter, the main arm lower housing 340 of the main arm 300 will be described in detail with reference to the accompanying drawings.

Figure 9:
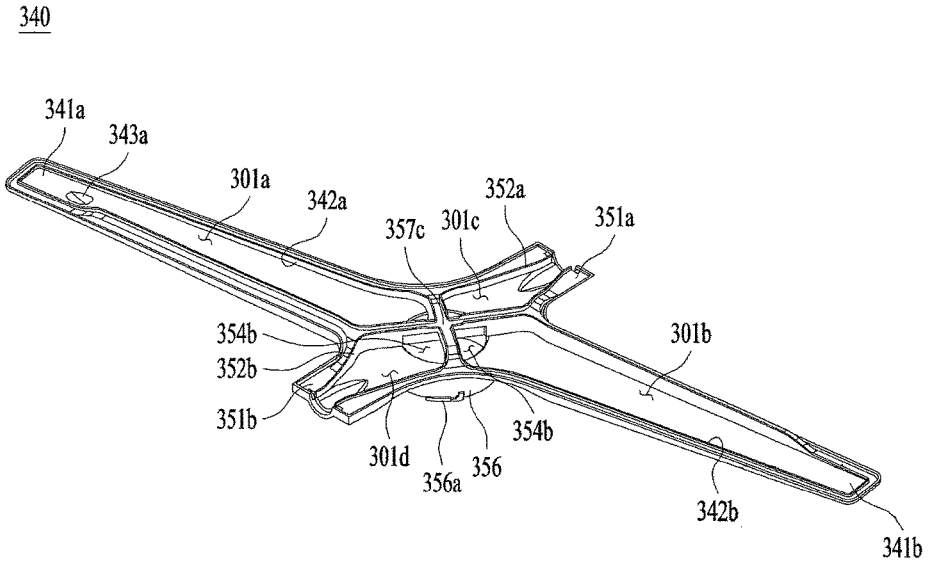
FIG. 9 is a diagram illustrating an example lower housing of the main arm in FIGS. 5-6.
Figure 10:
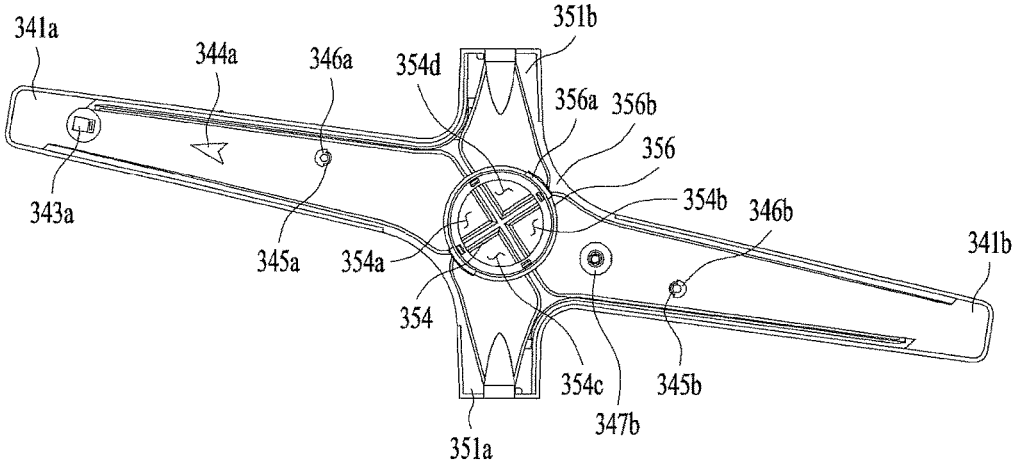
FIG. 10 is a diagram illustrating an example lower housing of the main arm in FIGS. 5-6.

FIG. 9 is a diagram illustrating an example lower housing of the main arm in FIGS. 5-6. FIG. 10 is a diagram illustrating an example lower housing of the main arm in FIGS. 5-6.

As illustrated in FIGS. 9 and 10, the main arm lower housing 340 as described above includes the first and the second lower main arms 341*a* and 341*b* for forming the lower parts of the first and the second main arms 300*a* and 300*b*, and the first and the second lower extensions 351*a* and 351*b* for forming the lower parts of the first and the second extensions 300*c* and 300*d*. A spray arm holder coupler 356 is protruded at the lower part of the center of rotation of the main arm lower housing 340.

In this example, shapes of the first and the second lower main arms 341*a* and 341*b* and the first and the second lower extensions 351*a* and 351*b* are formed to correspond to those of the first and the second upper main arms 312*a* and 312*b* and the first and the second upper extensions 322*a* and 322*b*, respectively. The detailed description of formation directions of the first and the second lower main arms 341*a* and 341*b* and the first and the second lower extensions 351*a* and 351*b* is omitted.

In some implementations, the welding steps 357, to which the welding ribs 327 of the main arm upper housing 310 is welded, is formed at the upper surface of the main arm lower housing 340, as illustrated in FIG. 9. In this example, the welding steps 357 is extended to define the first and the second lower main arms 341*a* and 341*b* and the first and the second extensions 531*a* and 531*b* in order to form the first and the second main flow paths 301*a* and 301*b* and the first and the second auxiliary flow paths 301*c* and 301*d*.

A cross-shaped lower flow path formation rib 354 is formed at the central part of the spray arm holder coupler 356 to define the flow paths, such that the wash water may be introduced into the first and the second main flow paths 301*a* and 301*b* and the first and the second auxiliary flow paths 301*c* and 301*d*.

In some implementations, in the first and the second main flow paths 301*a* and 301*b* and the first and the second auxiliary flow paths 301*c* and 301*d*, a plurality of lower ribs 342*a*, 342*b*, 352*a*, and 352*b* may be formed at an inside of the welding steps 357 (i.e. an inside for forming each flow path) to be in contact with the upper ribs 316*a*, 316*b*, 325*a*, and 325*b* of the main arm upper housing 310, respectively in order to guide the flow path of the wash water moving through the first and the second main flow paths 301*a* and 301*b* and the first and the second auxiliary flow paths 301*c* and 301*d*.

First and the second lower ribs 342*a* and 342*b* may be protruded from the lower flow path formation rib 335*a* to the inside of the first and the second main flow paths 301*a* and 301*b* while being in contact with the first and the second upper ribs 316*a* and 316*b* formed at the main arm upper housing 310 to form the first and the second flow paths 301*a* and 301*b*.

Furthermore, the first and the second extension lower ribs 352*a* and 352*b* may be protruded from the lower flow path formation rib 335*a* to the inside of the first and the second auxiliary flow paths 301*c* and 301*d* while in contact with the first and the second extension upper ribs 325*a* and 325*b* to form the first and the second auxiliary flow paths 301*c* and 301*d*.

In some implementations, in the case of the first and the second extension lower ribs 352*a* and 352*b* formed at the first and the second auxiliary flow paths 301*c* and 301*d*, the first and the second extension lower ribs 352*a* and 352*b* formed at the first and the second auxiliary flow paths 301*c* and 301*d* may be inclined to correspond to the shapes of the first and the second ports 324*a* and 324*b* such that the wash water flowing through the first and the second auxiliary flow paths 301*c* and 301*d* may be smoothly introduced into the first and the second ports 324*a* and 324*b* formed at the first and the second extensions 300*c* and 300*d*.

The spray arm holder coupler 356 is formed to have a cylindrical shape. Spray arm holder coupler protrusions 356*a* are protruded at both lower parts of an outer circumferential surface of the spray arm holder coupler 356. In the spray arm holder coupler 356, the main arm inserter 610 of the spray arm holder 600 is inserted into the spray arm holder coupler 356. When the spray arm holder 600 in an inserted state is rotated in one direction, the spray arm holder 600 may be held at the spray arm holder coupler protrusions 356*a* such that the spray arm holder 600 may be fixed. When the spray arm holder 600 in an inserted state is rotated in the other direction, the spray arm holder 600 may be separated from the spray arm holder coupler protrusions 356*a* such that the spray arm holder 600 may be separated.

In some implementations, the spray arm holder coupler 356 is formed at the main arm lower housing 340, as illustrated in FIG. 1. The lower flow path formation rib 354 is formed at an inside of the spray arm holder coupler 356. The inside of the spray arm holder coupler 356 is divided by the lower flow path formation rib 354 to define first and the second main flow path inlets 354*a* and 354*b* and first and the second extension flow path inlets 354*c* and 354*d* such that the wash water may be introduced into the first and the second main flow paths 301*a* and 301*b* and the first and the second auxiliary flow paths 301*c* and 301*d*.

In this example, the first and the second main flow path inlets 354*a* and 354*b* and the first and the second extension flow path inlets 354*c* and 354*d* may communicate with the first and the second main flow paths 301*a* and 301*b* and the first and the second auxiliary flow paths 301*c* and 301*d*, respectively. The first and the second main flow path inlets 354*a* and 354*b* and the first and the second extension flow path inlets 354*c* and 354*d* may be sequentially opened or closed by the flow path converter 700, while will be described below.

In some implementations, a washing nozzle 343*a* for spraying the wash water to the rotation shaft of the spray arm assembly 100 is formed at an end of the first lower main arm 341*a*. Upon rotation of the spray arm 200, the washing nozzle 343*a* sprays the wash water to the rotation shaft, such that residual foreign substances at the lower part of the washing tub 10 and the sump cover 50 may be introduced into the filter cover 60 and the filter 70.

Furthermore, a lower marker 344*a* having a certain figure or character shape may be formed at a central part of the first lower main arm 341*a* to check a welding direction of the main arm lower housing 340 upon welding of the main upper housing 310 and the main arm lower housing 340.

In some implementations, the first and the second guide protrusions 345*a* and 345*b* are protruded at the first and the second lower main arms 341*a* and 341*b*, to which where the first and the second main links 920*a* and 920*b* are coupled to reciprocate. Since the first and the second guide protrusions 345*a* and 345*b* are movably coupled to the first and the second main links 920*a* and 920*b* of the linker 900, the first and the second extension steps 346*a* and 346*b* are formed at the first and the second guide protrusions 345*a* and 345*b* to prevent the first and the second main links 920*a* and 920*b* from being separated. In addition, a gear rotation shaft 347*b* rotatably coupled to the eccentric gear 800 is protruded at the second lower main arm 341*b*.

In this example, the linker 900 movably coupled to the first and the second guide protrusion 345*a* and 345*b* performs reciprocating motion along the first and the second guide protrusions 345*a* and 345*b* according to rotation of the eccentric gear 800 coupled to the gear rotation shaft 347*b*. Furthermore, movement of the linker 900 in the state where the spray arm holder 600 is inserted into the rim-shaped body 910 may be restricted by the spray arm holder 600.

Thus, the gear rotation shaft 347*b* coupling the first and the second guide protrusions 345*a* and 345*b* for guiding movement of the linker 900 to the eccentric gear 800, and the center of the spray arm holder 600 inserted into the linker 900 may be collinear.

In some implementations, a plurality of drain lines 356*b* extending between the first and the second lower main arms 341*a* and 341*b*, and the first and the second lower extensions 351*a* and 351*b* may be formed at an outer circumferential surface of the spray arm holder coupler 356. The drain lines 356*b* may be formed at the lower surface of the main arm lower housing 340 along the welding steps 357 formed at the upper surface of the main arm lower housing 340.

In the drain lines 356*b*, upon rotation of the spray arm 200, the residual foreign substances and the wash water at the lower surface of the main arm lower housing 340 are discharged from the main arm lower housing 340 by centrifugal force due to rotation of the spray arm 200.

Hereinafter, the first and the second auxiliary arms 400 and 400*b* which are main components of the spray arm assembly 100 will be explained in detail with reference to accompanying drawings.

Figure 12:
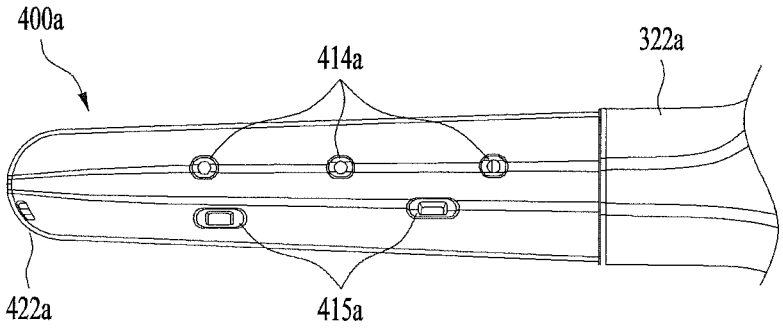
Figure 12:
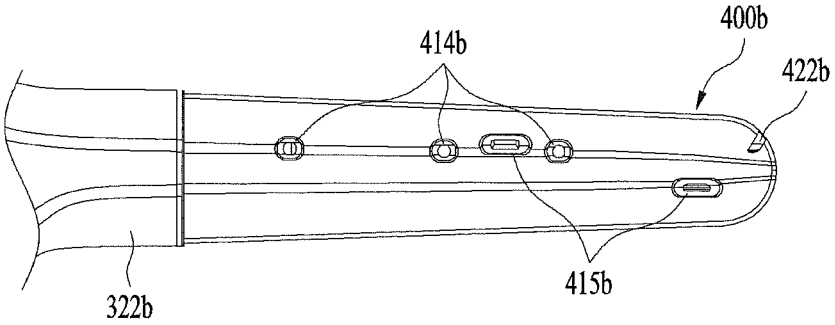
Figure 13:
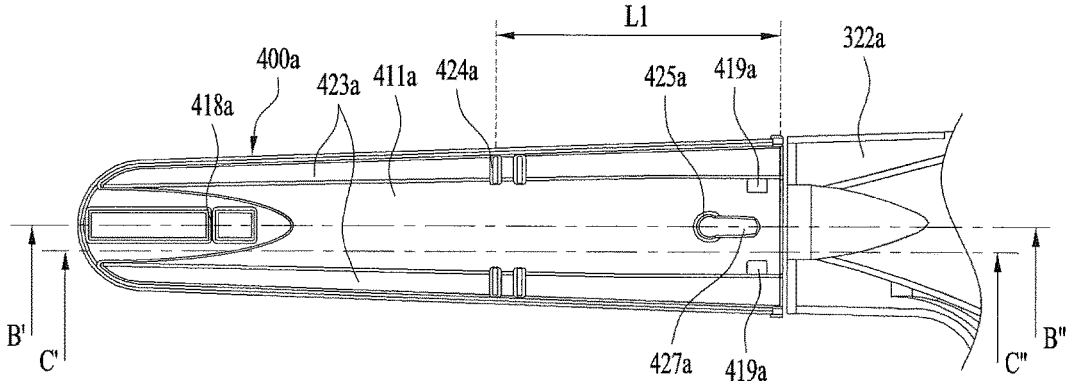
Figure 13:
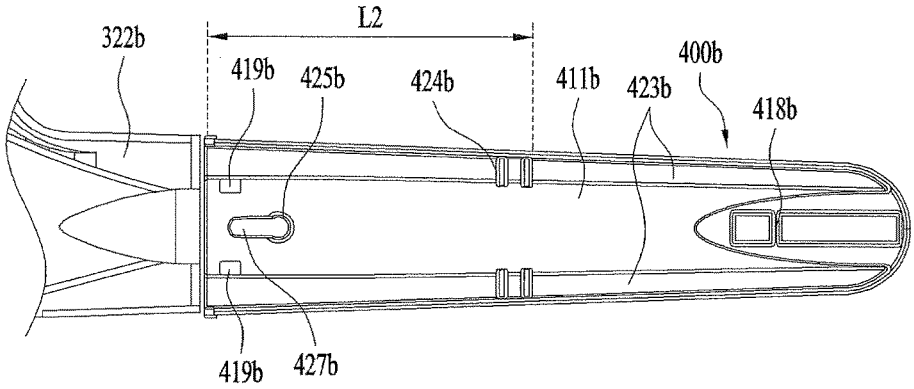
Figure 14:
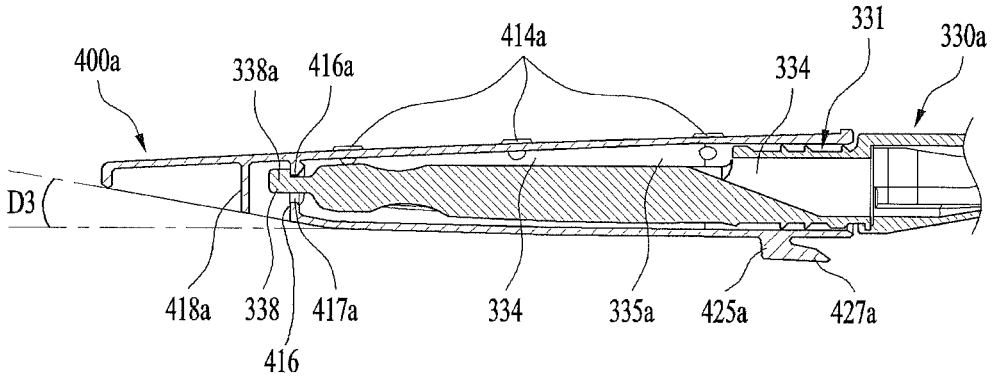
Figure 14:
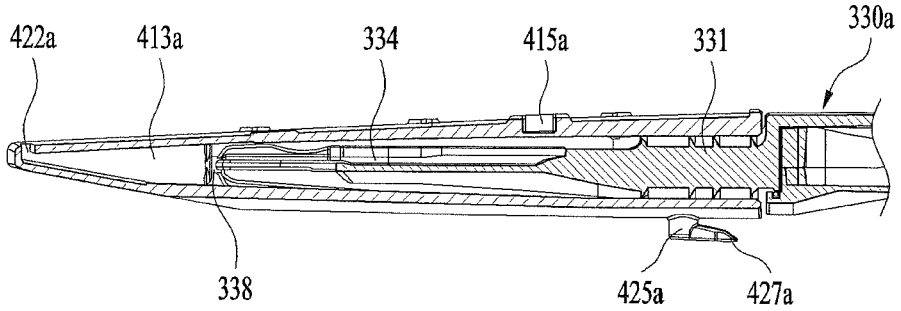

FIGS. 11-14 illustrate an example auxiliary arm. FIG. 14 illustrates cross-sectional views taken along lines B'-B" and C'-C" in FIG. 13, respectively.

In some implementations, the first and the second auxiliary arms 400*a* and 400*b* have almost identical structures. There are differences in formation positions and shapes of a plurality of nozzles 414*a*, 415*a*, 414*b*, 415*b*, 422*a*, and 422*b*. Accordingly, the first and the second auxiliary arms 400*a* and 400*b* are not separately described. The first auxiliary arm 400*a* will be representatively described below. A different structure of the second auxiliary arm 400*b* from that of the first auxiliary arm 400*a* may be added when describing the first auxiliary arm 400*a*.

Figure 11:
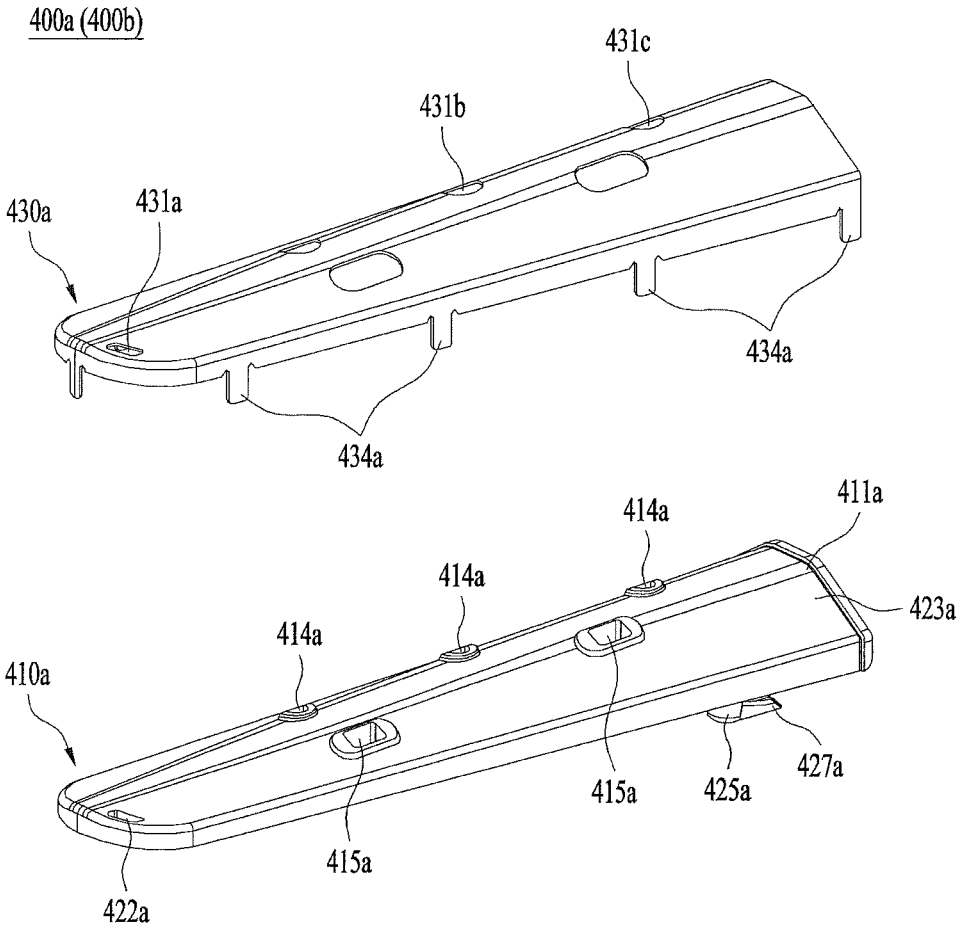
FIGS. 11-14 are diagrams illustrating an example auxiliary arm.

As illustrated in FIGS. 11 and 12, the first auxiliary arm 400*a* includes an auxiliary arm housing 410*a* rotatably coupled to the first auxiliary arm connector 330*a* while spraying the wash water supplied from the first auxiliary arm connector 330*a* according to operation of the linker 900 (see FIG. 43), and a decorative panel 430*a* coupled to an upper part of the auxiliary arm housing 410*a* to form the upper surface of the auxiliary arms 400*a* and 400*b*.

The auxiliary arm housing 410*a* includes an auxiliary arm flow path part 411*a* having a cylindrical shape while including an auxiliary arm flow path 412*a* into which the first auxiliary arm connector 330*a* is inserted, and extension ribs 423*a* (see FIG. 36) provided at the upper side of the auxiliary arm flow path part 411*a* while extending in a longitudinal direction at both sides of the auxiliary arm flow path part 411*a*, corresponding to an appearance of the first extension 300*c*, and having symmetric shapes.

In this example, the extension ribs 423*a* may be symmetric with respect to a longitudinal direction of the upper surface of the auxiliary arm flow path part 411*a* and may be formed to be bent downwards with respect to the auxiliary arm flow path part 411*a* while extending in a longitudinal direction at both sides of the auxiliary arm flow path part 411*a*. The decorative panel 430*a* may be fixed and supported at outer sides of the extension ribs 423*a*.

In some implementations, the first auxiliary nozzles 414*a* for spraying the wash water substantially perpendicular to the first auxiliary arm 400*a*, and first auxiliary inclined nozzles 415*a* inclinedly formed in a direction opposite to a rotation direction of the first auxiliary arm 400*a* to generate driving force capable of rotating the spray arm 200 when the wash water is sprayed by the first auxiliary arm 400*a* may be formed at the upper side of the auxiliary arm flow path part 411*a*.

The decorative panel 430*a* formed to cover the upper surface of the auxiliary arm housing 410*a* may have a certain thickness and include a polished metallic plate. The decorative panel 430*a* may be press-molded to correspond to the upper surface shape of the auxiliary arm housing 410*a*.

In some implementations, in an inside of the decorative panel 430*a*, a plurality of through holes 431*a*, 431*b*, and 431*c* are formed at positions corresponding to the first auxiliary nozzles 414*a* and the first auxiliary inclined nozzles 415*a* to expose the first auxiliary nozzles 414*a* and the first auxiliary inclined nozzles 415*a*.

In addition, upon mounting the decorative panel 430*a*, a plurality of fixing pins 434*a*, which is held at the extension ribs 423 of the auxiliary arm housing 410*a* to be fixed, is formed at an outer circumferential surface of the decorative panel 430*a*. The fixing pins 434*a* bend to an inside of the lower side of each extension rib 423 to fix the decorative panel 430*a* to the auxiliary arm housing 410*a*. In some implementations, a separate adhesive as well as the fixing pin 434*a* may be used between the decorative panel 430*a* and the auxiliary arm housing 410*a* to fix the decorative panel 430*a* to the auxiliary arm housing 410*a*.

In addition, a pivoting protrusion 425*a* coupled to the first auxiliary link 950*a* of the linker 900 is formed at the lower part of the auxiliary arm flow path part 411*a*. A stoppage protrusion 427*a* is formed by bending an end of the pivoting protrusion 425*a* to hold the first auxiliary link 950*a*. The stoppage protrusion 427*a* may extend to a center side of the spray arm 200 for coupling of the first auxiliary link 950*a*. Furthermore, the stoppage protrusion 427*a* may be formed to be shorter than at least first pivoting elongated holes 971*a* formed at the first auxiliary link 950*a*. The stoppage protrusion 427*a* may be formed to be held at the first pivoting elongated hole 971*a* when the linker 900 is mounted.

In some implementations, each of the first auxiliary nozzles 414*a* and the first auxiliary inclined nozzles 415*a* may be formed to have a circular hole shape or a slot shape in order to enlarge the area where the wash water is sprayed. Furthermore, the sprayed directions of the first auxiliary nozzles 414*a* and the first auxiliary inclined nozzles 415*a* may be formed to generate driving force in which the spray arm 200 is capable of rotating upon rotation of the first auxiliary arm 400*a*.

For example, driving force due to the wash water sprayed from the first auxiliary nozzles 414*a* and the first auxiliary inclined nozzles 415*a* may be increased or decreased by rotation of the first auxiliary arm 400*a*. However, the direction of driving force due to the wash water sprayed from the first auxiliary nozzles 414*a* and the first auxiliary inclined nozzles 415*a* may be constantly formed.

In some implementations, as illustrated in FIGS. 13 and 14, a coupling hole 416*a*, into which the shaft 338 of the first auxiliary arm connector 330*a* is inserted, is formed at an end of an inside of the auxiliary arm flow path 412*a*. In this example, the end of the inside of the auxiliary arm flow path 412*a* is defined as a supporting part 416. For example, the coupling hole 416*a* may be formed at the supporting part 416. The shaft 338 may be inserted into the coupling hole 416. Furthermore, in the supporting part 416, the key groove 419*a*, into which the insertion key 338*a* formed at the shaft 338 is inserted, connected to the coupling hole 416*a* may be further formed.

In this example, the key groove 417*a* formed at the coupling hole 416*a* may be formed to be opposite to the insertion key 338*a* in the state where the first auxiliary arm is normally mounted. For example, when the first auxiliary arm 400*a* in the reverse state is inserted into the first auxiliary arm connector 330*a* such that the shaft 338 of the first auxiliary arm connector 330*a* is inserted into the coupling hole 416*a* while the insertion key 338 of the shaft 338 is inserted into the key groove 417*a* of the coupling hole 416*a*.

Then, when the first auxiliary arm connector 330*a* is completely inserted into the first auxiliary arm 400*a*, the first auxiliary arm 400*a* rotates such that the position of the key groove 417*a* of the coupling hole 416*a* is spaced apart from the position of the insertion key 338 of the shaft 338, thereby preventing the first auxiliary arm 440*a* from being separated from the first auxiliary arm connector 330*a*.

In some implementations, a reflective plate 418*a* is formed at the outside of the coupling hole 416*a* of the first auxiliary arm 400*a* to prevent the wash water discharged from the coupling hole 416*a* and the key groove 417*a* from being scattered. In the case where the coupling hole 416*a* and the key groove 417*a* of the first auxiliary arm 400*a* is formed at an end of the auxiliary arm flow path 415 where the wash water moves, when the wash water is scattered from the first auxiliary nozzles 414*a* or the first auxiliary inclined nozzles 415*a* of the first auxiliary arm 400*a*, the little amount of the wash water may be discharged through the coupling hole 416*a* and the key groove 417*a*. The wash water discharged through the coupling hole 416*a* and the key groove 417*a* may be inadvertently scattered to the inner wall of the washing tub 10. Accordingly, the reflective plate 418*a* may be provided to prevent the wash water discharged through the coupling hole 416*a* and the key groove 417*a* from scattering and may drop to the sump cover 50.

In addition, the foreign substance discharge holes 419*a* are formed at the extending pipe 331 of a front end (i.e. a part provided at the extending pipe 331 of the first auxiliary arm connector 330*a*) of the auxiliary arm flow path part 411*a* to discharge the foreign substances introduced into the auxiliary arm flow path 412*a* of the auxiliary arm flow path part 411. The foreign substance discharge holes 419*a* are formed between a pair of sealing ribs of a plurality of sealing ribs 332*a*, 332*b*, and 332*c* formed at the extending pipe 331 of the first auxiliary arm connector 330*a*.

Accordingly, when the wash water is introduced into the auxiliary arm flow path 412*a* of the first auxiliary arm 400*a*, a part of the wash water may be introduced into the extending pipe 331 through the flow path forming protrusion 333*a* by pressure of the wash water. The introduced wash water may be discharged with the foreign substances introduced between the extending pipe 331 and the first auxiliary arm 400*a*.

In this example, the first auxiliary arm 400*a* performs reciprocating rotational motion about the first auxiliary arm connector 330*a* according to rotation of the spray arm 200. As the wash water is sprayed from the first auxiliary nozzles 414*a* and the first auxiliary inclined nozzles 415*b*, the driving force generated by the nozzles 414*a* and 415*a* may be increased or decreased.

In some implementations, a first driving nozzle 422*a* (see FIG. 12) for generating driving force of the first auxiliary arm 400*a* may be further formed at an end of the auxiliary arm flow path part 411*a*. The first driving nozzle 422*a* may be inclined in a direction opposite to a rotation direction of the first auxiliary arm 400*a*. The first driving nozzle 422*a* may generate greater driving force than driving force generated by the first auxiliary inclined nozzle 415*a*. The first driving nozzle 422*a* may allow driving force of the first auxiliary arm 400*a* to be directed upwards. In addition, the first driving nozzle 422*a* may be formed to wash an outer part of the washing tub 10.

In some implementations, an auxiliary arm divergent flow path 413*a* (see FIG. 14(*c*)) having a smaller area than that of the auxiliary arm flow path 412*a* may be further formed at the auxiliary arm flow path 412*a* to supply the wash water to the first driving nozzle 422*a*. In the auxiliary arm divergent flow path 413*a*, pressure of the wash water sprayed from the first driving nozzle 422*a* may be increased by decrease of a cross-sectional area of the flow path where the wash water flows.

In some implementations, the first and the second auxiliary arms 400*a* and 400*b* may have physically similar structures. However, positions of the first auxiliary nozzles 414*a* and the first auxiliary inclined nozzles 415*a* are different. For example, the first and the second auxiliary nozzles 414*a* and 414*b* and the first and the second auxiliary inclined nozzles 415*a* and 415*b* which are formed at the first and the second auxiliary arms 400*a* and 400*b*, respectively, may be formed to have different sprayed areas upon rotation thereof. Accordingly, if the same first auxiliary arms 400*a* (or the second auxiliary arms 400*b*) are mounted at the first and the second auxiliary arm connectors 330*a* and 330*b*, the same sprayed areas may be provided by the first auxiliary arms 400*a* (or the second auxiliary arms 400*b*), thereby decreasing washing efficiency.

Thus, an auxiliary arm marker may be further formed to distinguish the first and the second auxiliary arms 400*a* and 400*b*. In this example, the auxiliary arm marker may be formed at the lower surface of the auxiliary arm housing 410*a* and may be formed to have a certain figure or character shape.

In some implementations, separate reinforcing ribs 424*a* (see FIG. 13) may be formed to reinforce the extension rib 423 forming the auxiliary arm housing 410*a*. Positions of the reinforcing ribs 424*a* formed at the first and the second auxiliary arms 400*a* and 400*b* are different such that the first and the second auxiliary arms 400 and 400*b* may be distinguished from each other. For example, when the position of the reinforcing rib 424*a* formed at the first auxiliary arm 400*a* is L1, the position of the reinforcing rib 424*a* formed at the second auxiliary arm 400*b* is L2 such that the first and the second auxiliary arms 400 and 400*b* may be distinguished.

In some implementations, an upward inclination surface 428*a* (see FIG. 14(*a*)), inclined upwards at a certain angle D3 in an outer direction, may be formed at the lower surface of the end of the first auxiliary arm 400*a*. The upward inclination surface 428*a* may be formed to prevent the washing tub 10 from being in contact with the spray arm 200 upon rotation or stoppage of the spray arm 200.

Hereinafter, the fixed gear 500 of the spray arm assembly 100 will be described in detail, with reference to the accompanying drawing.

Figure 15:
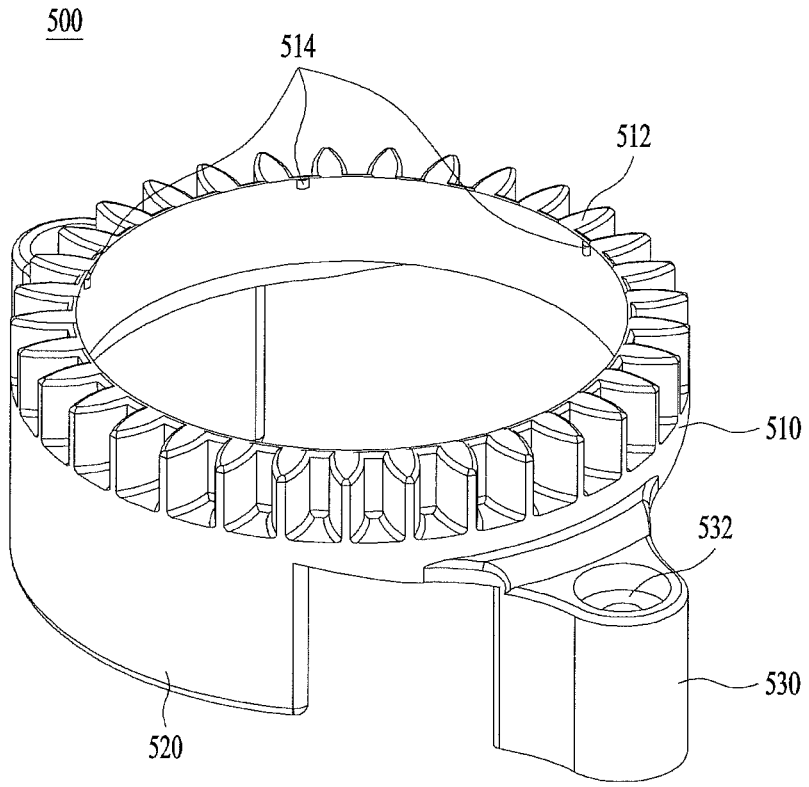
FIGS. 15-17 are diagrams illustrating an example fixed gear.
Figure 16:
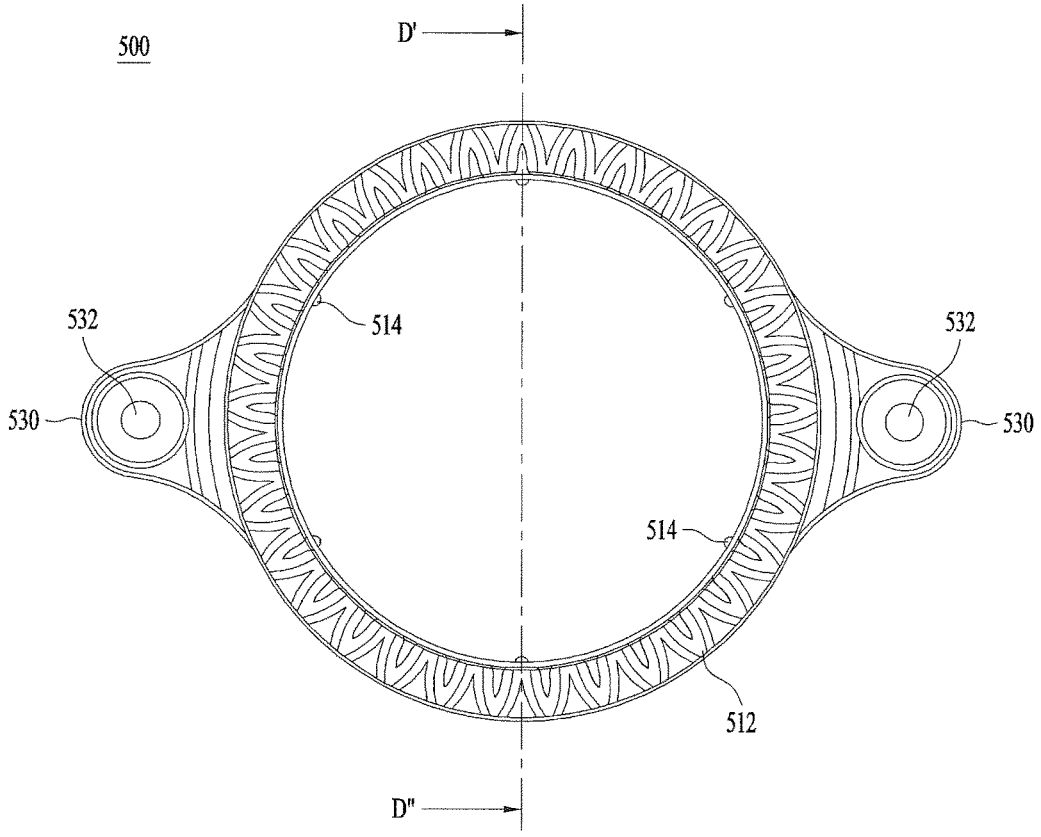
Figure 17:
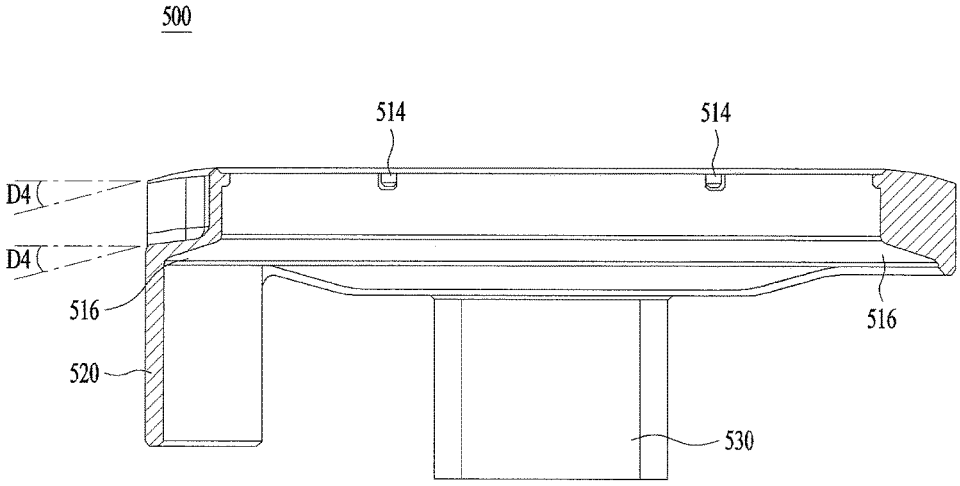
Figure 18:
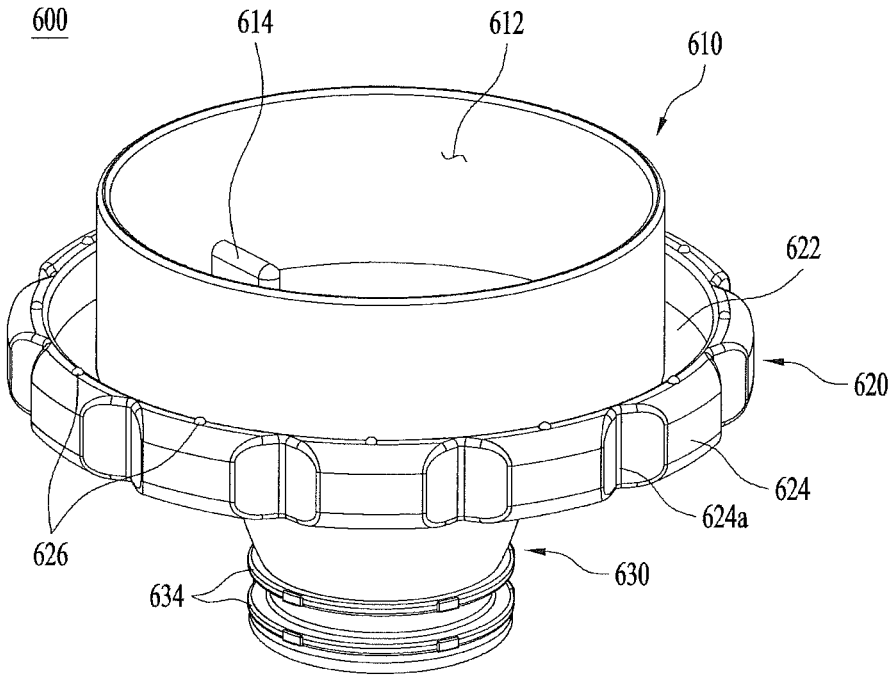
FIGS. 18-21 are diagrams illustrating an example spray arm holder.
Figure 19:
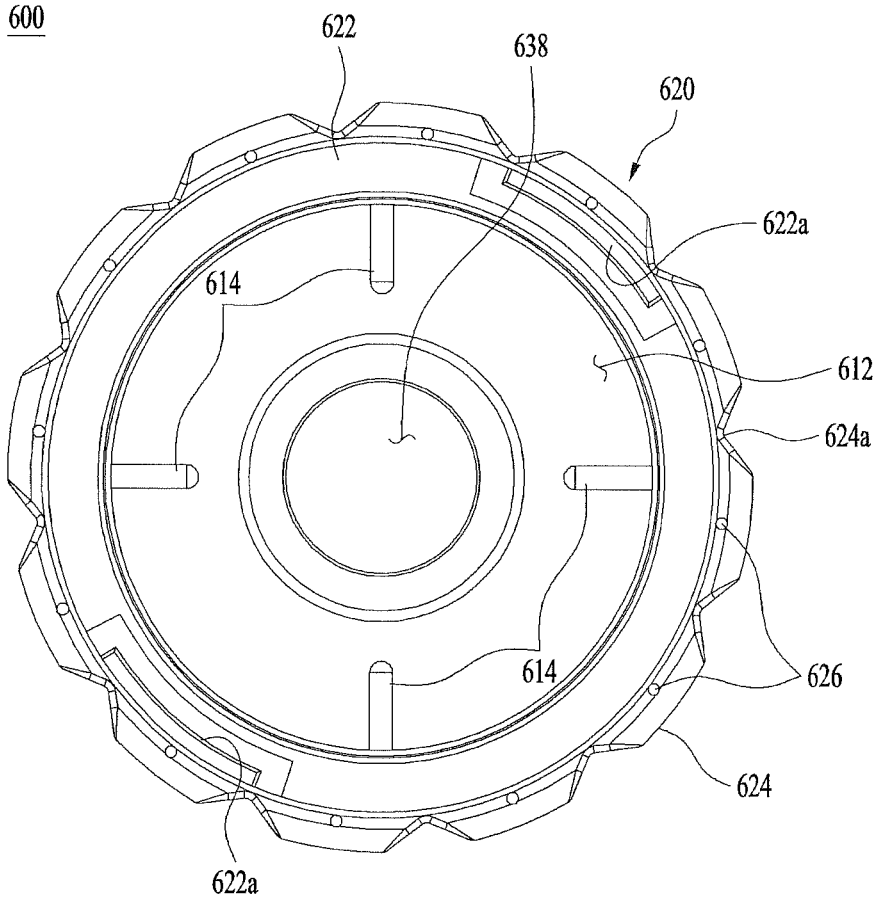
Figure 20:
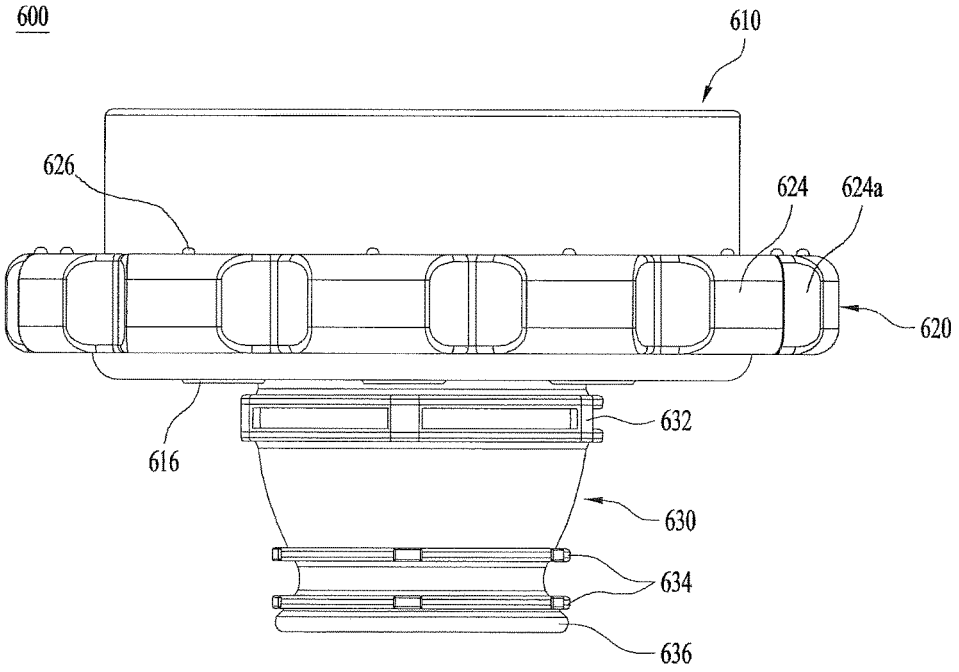
Figure 21:
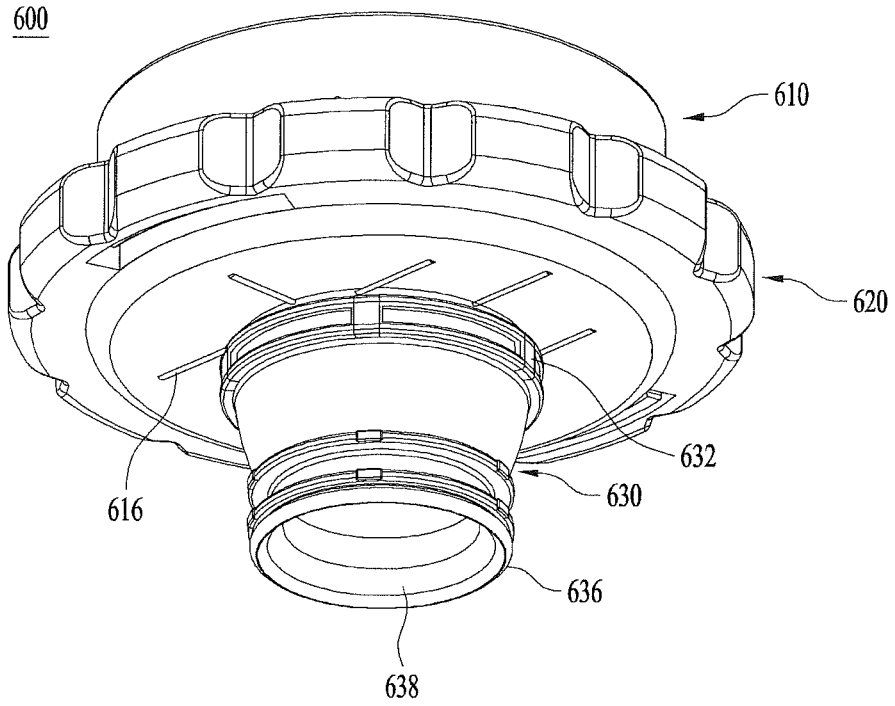

FIGS. 15-17 illustrate an example fixed gear. FIG. 17 illustrates a cross-sectional view taken along a line D'-D" in FIG. 16.

The fixed gear 500 includes a rim 510, through which the spray arm holder coupler 356 formed at the main arm lower housing 340 rotatably passes, and at which a plurality of first gear teeth 512 is formed, a fasteners 530 extending from both sides of the rim 510 to be coupled to the coupling bosses 51 of the sump cover 50, and a shielding rib 520 extending from one side of the rim 510 downwards to shield the inside of the fixed gear 500.

In this example, the rim 510 has a ring shape to be greater than the outer circumferential surface of the spray arm holder coupler 356. A plurality of first gear teeth 512 is formed along an upper outer circumferential surface. At least three space maintaining protrusions 514 is protruded at an inner circumferential surface of the rim 510 to maintain a space between the spray arm holder coupler 356 and the fixed gear 500 and to prevent friction.

In some implementations, upper surfaces of the first gear teeth 512 and an upper surface of the rim 510, on which the first gear teeth 512 are formed, may be formed to be inclined downwards at a certain angle D4 in an outside direction of the rim 510. For example, when washing using the wash water, the wash water and the foreign substances may be introduced into upper parts of the first gear teeth 512. For draining and discharge of the wash water and the foreign substances, the upper surfaces of the first gear teeth 512 and the upper surface of the rim 510 may be inclined downward in an outer direction of the rim 510.

Furthermore, a support surface 516 being in contact with the separation preventing part 620 of the spray arm holder 600 is formed at the lower surface of the rim 510. The support surface 516 may be inclined upward to the center of the rim 510.

In some implementations, upon rotation of the spray arm 200, the spray arm holder 600 coupled to the spray arm 200 rotates. In the state where the spray arm holder 600 is inserted into the spray arm holder seating part 53 of the sump cover 50, the spray arm holder 600 receives pressure of the wash water upwards and thus rotates in a floating manner. In this example, the spray arm holder 600 may float in a horizontal direction by the spray arm holder 600 and the space of the spray arm holder 600.

In this example, when the spray arm holder 600 ascends due to pressure of the wash water according to rotation of the spray arm 200, the support surface 516 of the rim 510 may prevent the separation preventing part 620 of the spray arm holder 600 from floating using the inclination of the support surface 516.

In addition, the fasteners 530 extend at both sides of the rim 510 in a lower direction of the rim 510. The coupling hole 532, into which the coupling bosses 51 of the sump cover 50 are inserted, is formed. The coupling hoe 532 may be fixed by a separate coupling member (e. g. a screw, not shown).

In some implementations, the shielding rib 520 is formed at a front side of the rim 510 (i.e. the door 30 side) to shield the spray arm holder 600 provided in the fixed gear 500. For example, upon detachment of the filter 70 and the filter cover 60 which are provided at the front side of the shielding rib 520, the shielding rib 520 may prevent the foreign substances from being introduced into the inside of the fixed gear 500 or may prevent a user's hand from being inserted therein.

Hereinafter, the spray arm holder 600 of the spray arm assembly 100 will be described in detail, with reference to the accompanying drawing.

FIGS. 18-21 illustrate an example spray arm holder.

As illustrated in FIGS. 18-21, the spray arm holder 600 includes the main arm inserter 610 inserted into the spray arm holder coupler 356 of the spray arm 200 while forming a space for mounting the flow path converter 700, the separation preventing part 620 formed at an outer circumferential surface of the main arm inserter 610 to be fixed to the spray arm holder coupler 356 while being held at the support surface 516 of the fixed gear 500, and the sump inserter 630 protruding from the lower part of the main arm inserter 610 while being rotatably inserted into the spray arm holder seating part 53.

In this example, an outer circumferential surface of the main arm inserter 610 is formed to correspond to an inner circumferential surface of the spray arm holder coupler 356. A valve chamber 612 into which the flow path converter 700 is inserted is formed. A plurality of support protrusions 614 being in contact with lower inclined protrusions 730*a*, 730*b*, 730*c*, and 730*d* of the flow path converter 700 are form at the lower surface of the valve chamber 612. A hollow hole where the wash water is introduced is formed at a central lower part of the valve chamber 612.

In this example, the number of the support protrusions 614 may be increased and decreased according to the number of the flow paths formed at the spray arm 200. Since the first and the second main flow paths 301*a* and 301*b* and the first and the second auxiliary flow paths 301*c* and 301*d* are formed, at least four support protrusions 614 may be provided.

Furthermore, each support protrusion 614 may be formed in a rotated state at about 30 to 45 degrees with respect to the formation angle of the lower flow path formation rib 354 forming the first and the second main arm inlets 354*a* and 354*b* and the first and the second extension flow path inlets 354*c* and 354*d*.

The separation preventing part 620 is enlarged to be greater than the main arm inserter 610 at the lower part of the main arm inserter 610. A main arm seating part 622 being in contact with a lower end of the spray arm holder coupler 356 is formed. A gripping part 624 for mounting the spray arm holder 600 to the spray arm holder coupler 356 is formed at the outer circumferential surface of the main arm seating part 622.

In this example, a holding protrusion 622*a* is formed at the inner circumferential surface of the main arm seating part 622 to hold the spray arm holder coupler protrusion 356*a* formed at the outer circumferential surface of the spray arm holder coupler 356. The spray arm holder coupler protrusion 356*a* and the holding protrusion 622*a* are formed to be fixed or released according to rotation of the spray arm holder 600.

In addition, when the separation preventing part 620 rotates at the upper surface of the gripping part 624 while being in contact with the support surface 516 of the fixed gear 500, a plurality of antifriction protrusions 626 may be formed to decrease friction of the support surface 516. In some implementations, a plurality of engagement grooves 624*a* may be further formed at the outer circumferential surface of the gripping part 624, thereby easily rotating when the spray arm holder 600 is mounted.

In some implementations, a plurality of wear prevention ribs 616 are formed at the lower surface of the main arm inserter 610 to minimize contact with the support boss 55 of the spray arm holder seating part 53 when the spray arm holder 600 is inserted into the spray arm holder seating part 53.

In some implementations, the sump inserter 630 is formed to communicate with the central part of the main arm inserter 610. The sump inserter 630 is hollow such that the wash water supplied from the sump may be introduced therein. The extension 636 is formed at the lower end of the sump inserter 630 to be held at the seating ribs 57 formed at the spray arm holder seating part 53 of the sump cover 50.

In addition, a plurality of sealing ribs 634 protruding toward the inner circumferential surface of the spray arm holder seating part 53 may be formed at the lower side of the outer circumferential surface of the sump inserter 630. A plurality of space maintaining protrusions 632 may be formed at the upper side of the outer circumferential surface of the sump inserter 630 to maintain a space between the inner circumferential surface of the spray arm holder seating part 53 and the outer circumferential surface of the sump inserter 630.

Hereinafter, the flow path converter 700 of the spray arm assembly 100 will be described in detail, with reference to the accompanying drawing.

Figure 22:
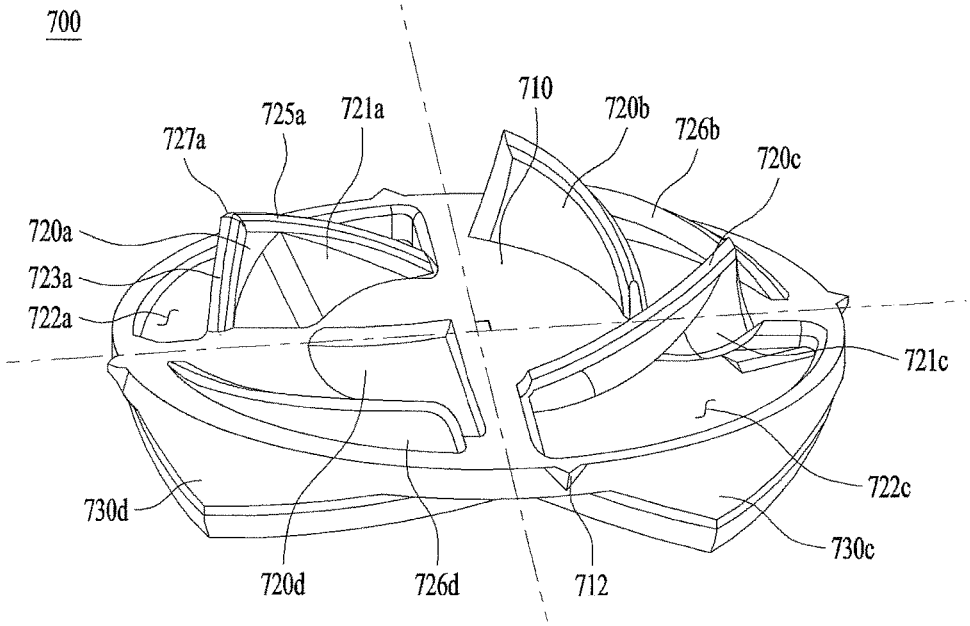
FIGS. 22-23 are diagrams illustrating an example flow path converter.
Figure 23:
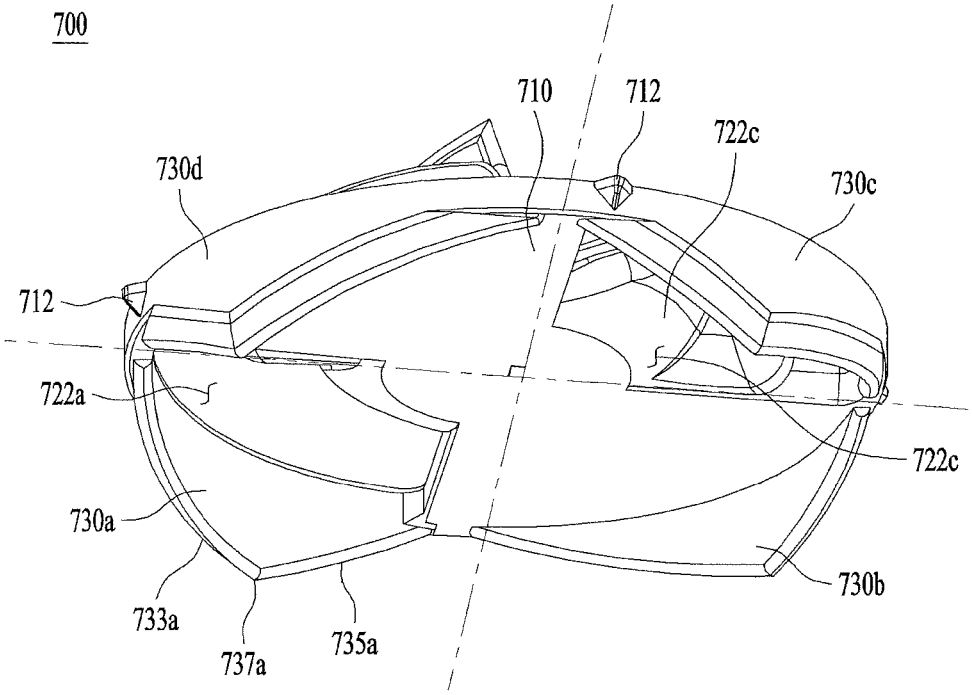
Figure 24:
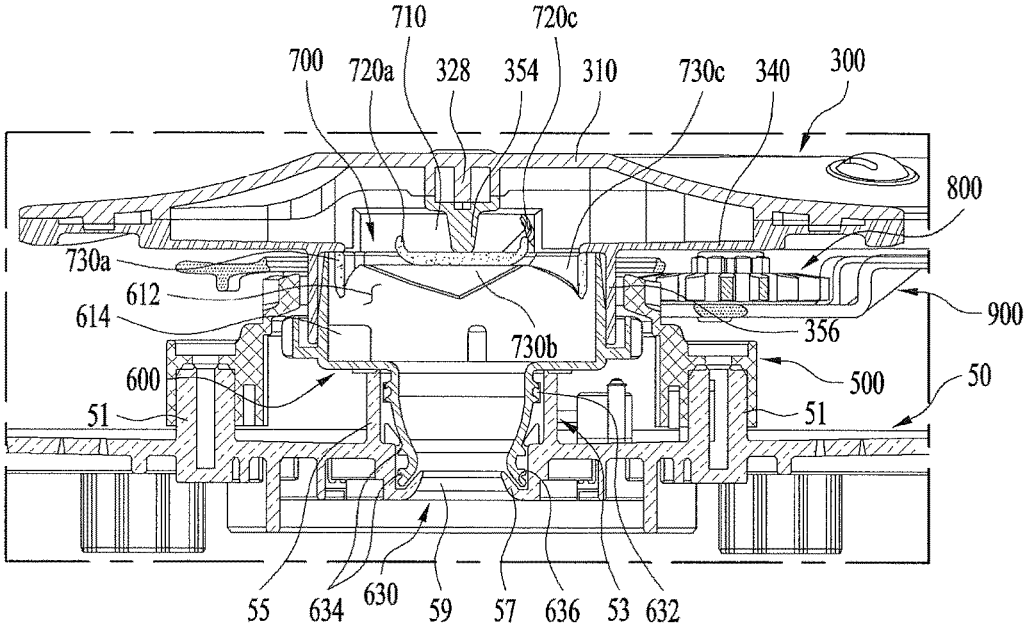
FIG. 24 is a diagram illustrating an example fixed gear, an example spray arm holder, and an example flow path converter.

FIGS. 22-23 illustrate an example flow path converter. FIG. 24 illustrates an example fixed gear, an example spray arm holder, and an example flow path converter. FIG. 24 illustrates a cross-sectional view taken along a line X'-X" in FIG. 2.

As illustrated in FIGS. 22-24, the flow path converter 700 may include the disk-shaped rotary plate 710 inserted into the valve chamber 612 of the spray arm holder 600, the first, second, third, and fourth upper inclined protrusions 720*a*, 720*b*, 720*c*, and 720*d* formed at the upper rotary plate 710 while being inserted into the lower flow path formation rib 354 of the main arm lower housing 340 to rotate the rotary plate 710, and first, second, third, and fourth lower inclined protrusions 730*a*, 730*b*, 730*c*, and 730*d* formed at the lower part of the rotary plate 710 while being held at the support protrusions 614 formed at the valve chamber 612 of the spray arm holder 600 to rotate the rotary plate 710.

The rotary plate 710 is accommodated in the valve chamber 612 of the spray arm holder 600. The rotary plate 710 may perform reciprocating motion upwards and downward in the valve chamber 612 according to water pressure of the wash water passing through the valve chamber 612.

Accordingly, the rotary plate 710 may be formed a disk shape to correspond to a cross-sectional shape of the valve chamber 612. In this example, a plurality of space maintaining protrusions 712 is formed at the outer circumferential surface of the rotary plate 710 to maintain a space between the inner circumferential surface of the valve chamber 612 and the outer circumferential surface of the rotary plate 710 and to minimize friction.

In some implementations, the first and the second opening holes 722*a* and 722*c* may be formed at the first and third upper inclined protrusions 720*a* and 720*c* for the wash water to pass through. When the upper inclined protrusions 720*a*, 720*b*, 720*c*, and 720*d* are inserted into the lower flow path housing 354 of the main arm lower housing 340, the first and the second opening holes 722*a* and 722*c* may communicate with the first and the second main arm inlets 354*a*, 354*b* or the first and the second extension inlets 354*c*, and 354*d* of the main arm lower housing 340.

In this example, the first, second, third, and fourth upper inclined protrusions, 720*a*, 720*b*, 720*c*, and 720*d* may be provided at positions corresponding to the first and the second main arm inlets 354*a*, 354*b* and the first and the second extension inlets 354*c*, and 354*d* of the main arm lower housing 340.

Furthermore, the first, second, third, and fourth upper inclined protrusions, 720*a*, 720*b*, 720*c*, and 720*d* may be spaced apart from the center of the rotary plate 710 and the outer circumferential surface of the rotary plate 710 at a certain interval. In this example, the first and the second opening holes 722*a* and 722*c* may be formed at outsides of the first and third upper inclined protrusions 720*a* and 720*c*, which face with the first and the second opening holes 722*a* and 722*c*, of the first, second, third, and fourth upper inclined protrusions, 720*a*, 720*b*, 720*c*, and 720*d*.

In some implementations, the first and the second rotation inclined surfaces 721*a* and 721*c* may be further formed between the first and third upper inclined protrusions 720*a* and 720*c* and the rotary plate 710. When the flow path converter 700 ascends or descends, the first and the second rotation inclined surfaces 721*a* and 721*c* may form rotation resistance such that the flow path converter 700 may be rotated by the wash water passing through the first and the second opening holes 722*a* and 722*c*.

Thus, upon supply of the wash water, the flow path converter 700 may be rotated by the wash water passing through the first and the second opening holes 722*a* and 722*c* in one direction. Upon stoppage of the supply of the wash water, when the flow path converter 700 descends due to load thereon, the flow path converter 700 may be rotated by the wash water passing through the first and the second opening holes 722*a* and 722*c* in one direction.

In some implementations, the first and the second anti-inflow protrusions 726*b* and 726*d* spaced apart from the second and fourth upper inclined protrusions 720*b* and 720*d* at a certain distance while closing the first and the second main arm inlets 354*a* and 354*b* (or the first and the second extension inlets 354*c* and 354*d*) may be formed at the insides of the second and fourth upper inclined protrusions 720*b* and 720*d*.

In this example, when the first and the second anti-inflow protrusions 726*b* and 726*d* are opened by the first and the second main arm inlets 354*a* and 354*b* (or the first and the second extension inlets 354*c* and 354*d*), the first and the second anti-inflow protrusions 726*b* and 726*d* may close the inlets inserted into the first and the second main arm inlets 354*a* and 354*b* (or the first and the second main arm inlets 354*a* and 354*b*) such that they are not opened.

Furthermore, each of the first, second, third, and fourth upper inclined protrusions, 720*a*, 720*b*, 720*c*, and 720*d* are formed at the first upper inclined surface 723*a* and the second upper inclined surface 725*a*. Each upper corner 727*a* is formed between the first and the second upper inclined surfaces 723*a* and 725*a*.

In this example, the first upper inclined surface 723*a* is formed in a rotation direction of the flow path converter 700 and the second upper inclined surface 275*a* is formed in a rotation direction opposite to the rotation direction. The first and the second upper inclined surfaces 723*a* and 725*a* are formed to have different angles. The first upper inclined surface 723*a* may be formed to have a greater angle of inclination than that of the second upper inclined surface 725*a*.

In some implementations, the first, second, third, and fourth lower inclined protrusions 730*a*, 730*b*, 730*c*, and 730*d* are held at the support protrusions 614 provided at the valve chamber 612 to rotate the rotary plate 710. The first, second, third, and fourth lower inclined protrusions 730*a*, 730*b*, 730*c*, and 730*d* may be provided to be spaced apart from one another at 90 degrees, with respect to the center of the rotary plate 710.

In this example, in the first, second, third, and fourth lower inclined protrusions 730*a*, 730*b*, 730*c*, and 730*d*, each lower corner 737*a* is formed between first and the second lower inclined surfaces 733*a* and 735*a*.

In this example, the first lower inclined surface 733*a* is formed in a rotation direction of the flow path converter 700, and the second lower inclined surface 735*a* is formed in a direction opposite to the rotation direction. The first and the second lower inclined surfaces 733*a* and 735*a* are formed to have different angles. The first lower inclined surface 733*a* may be formed to have a smaller angle of inclination than that of the second lower inclined surface 735*a*.

Hereinafter, a process of opening or closing the first and the second main arm inlets 354*a* and 354*b* or the first and the second extension inlets 354*c* and 354*d* by the flow path converter 700 will be described in detail, with reference to the accompanying drawing.

Figure 25:
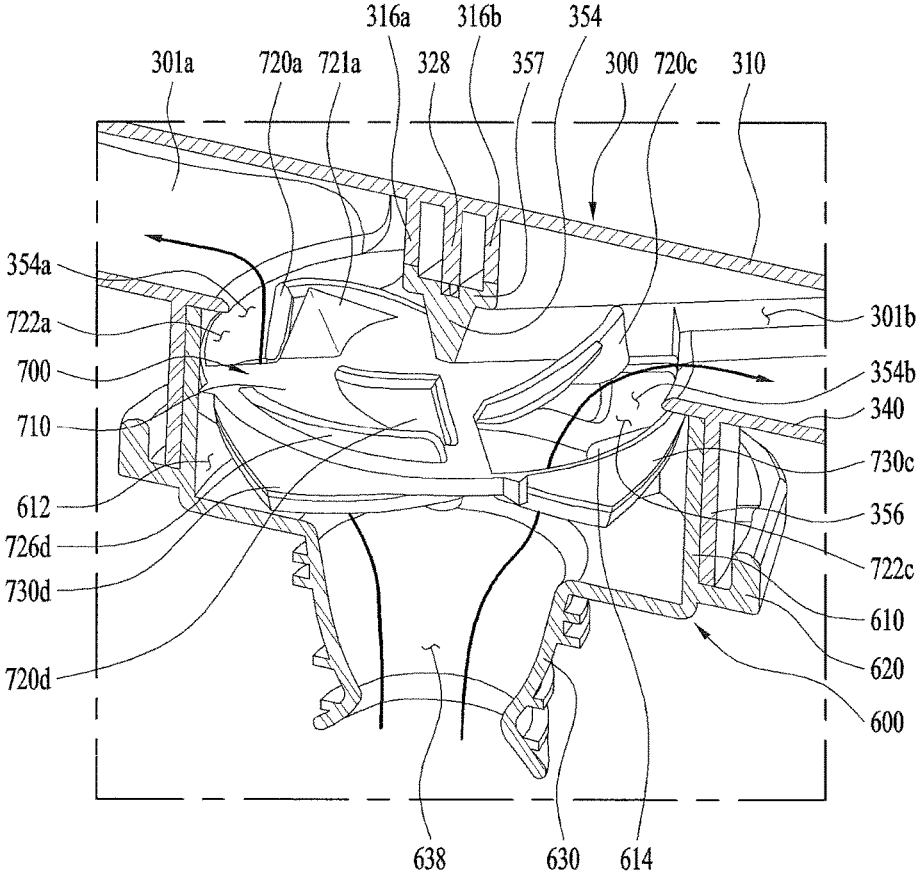
FIGS. 25 and 26 are diagrams illustrating an example operation of a flow path converter.
Figure 26:
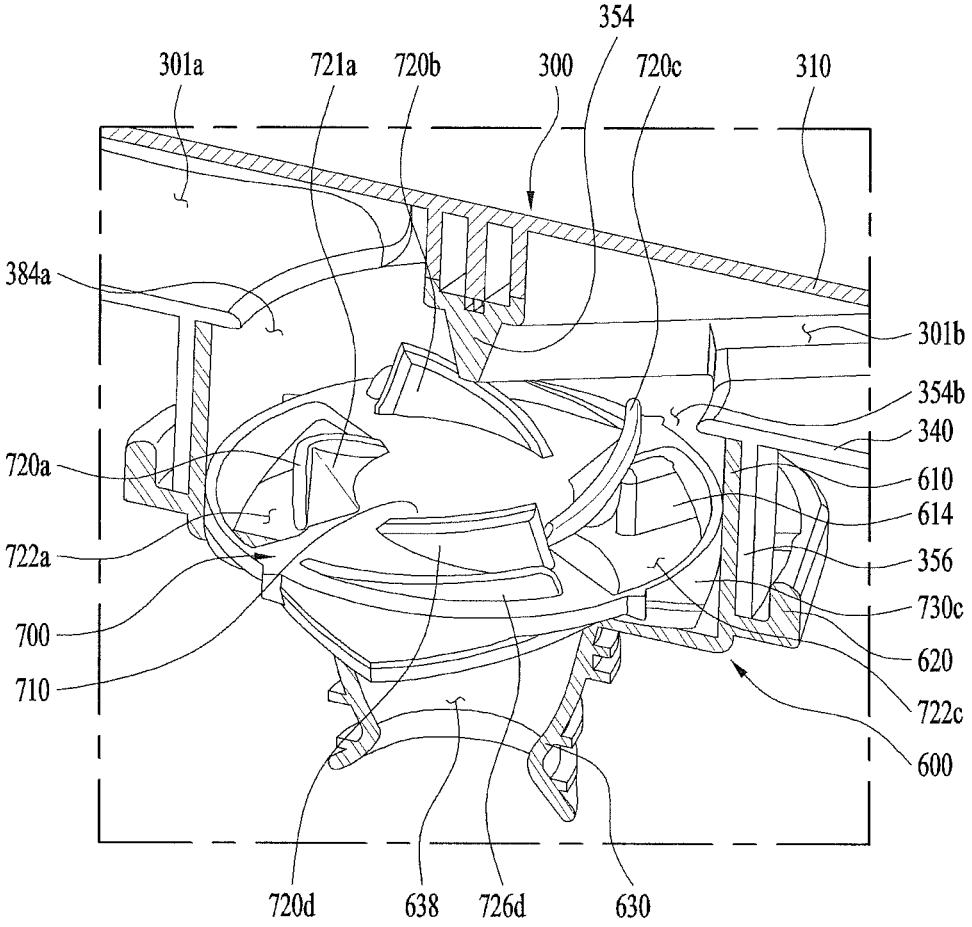

FIGS. 25 and 26 illustrate an example operation of a flow path converter.

As illustrated in FIGS. 25 and 26, when the wash water is supplied through the inlet 638 formed at the sump inserter 630 of the spray arm holder 600, the flow path converter 700 provided at the valve chamber 612 ascends by water pressure of the supplied wash water.

As the flow path converter 700 ascends, the first, second, third, and fourth upper inclined protrusions, 720*a*, 720*b*, 720*c*, and 720*d* are inserted into the first and the second main arm inlets 354*a* and 354*b* and the first and the second extension inlets 354*c* and 354*d* of the lower flow path formation rib 354 formed at the main arm lower housing 340, respectively.

In this example, the wash water introduced into the inlets 638 may be introduced into the first main arm inlet 354*a* through the first opening hole 722*a*. The wash water passing through the second opening hole 722*c* may be introduced into the second main arm inlet 345*b*.

In some implementations, the first extension inlet 354*c* and the second extension inlet 354*d* are closed by the rotary plate 710. Accordingly, introduction of the wash water through the first and the second extension inlets 354*c* and 354*d* is blocked.

In some implementations, when supply of the wash water stops, pressure of the wash water for transferring the flow path converter 700 upwards is removed, such that the flow path converter 700 descends due to weight thereof. In this example, when the wash water passes through the first and the second opening holes 722*a* and 722*c* in the descending flow path converter 700, the flow path converter 700 is rotated at a certain angle in one direction by the first and the second rotation inclined surfaces 721*a* and 721*c* formed at the first and the second opening holes 722*a* and 722*c*.

Accordingly, the first, second, third, and fourth lower inclined protrusions 730*a*, 730*b*, 730*c*, and 730*d* provided at the flow path converter 700 slip on the support protrusions 614 provided at the spray arm holder 600 to be rotated at a certain angle more in one direction, thereby being held at the support protrusions 614.

In this example, when the flow path converter 700 descends, the first, second, third, and fourth lower inclined protrusions 730*a*, 730*b*, 730*c*, and 730*d* are held at the support protrusion 614 while the flow path converter 700 rotates at a certain angle in one direction.

In this example, the flow path converter 700 may rotate at about 90 degrees. The reason for this is that, the first and the second lower inclined surfaces 733*a* and 735*a* provided at the first, second, third, and fourth lower inclined protrusions 730*a*, 730*b*, 730*c*, and 730*d* occupy an angle of 90 degrees on a circumferential surface of the rotary plate 710.

Although not illustrated, after the flow path converter 700 descends, the wash water is introduced through the inlets 638 formed at the sump inserter 630 again such that the flow path converter 700 ascends. As the flow path converter 700 ascends, the first, second, third, and fourth upper inclined protrusions, 720*a*, 720*b*, 720*c*, and 720*d* are respectively inserted into the first and the second main arm inlets 354*a* and 354*b* and the first and the second extension inlets 354*c* and 354*d* of the lower flow path formation rib 354 formed at the main arm lower housing 340.

In this example, when the wash water is supplied, the flow path converter 700 ascends due to pressure of the wash water and the wash water passes through the first and the second opening holes 722*a* and 722*c* in the ascending flow path converter 700. In this example, the wash water passing through the first and the second opening holes 722*a* and 722*c* pressurizes the first and the second rotation inclined surfaces 721*a* and 721*c* formed at the first and the second opening holes 722*a* and 722*c*. The flow path converter 700 is rotated at a certain angle in one direction by pressure applied to the first and the second rotation inclined surfaces 721*a* and 721*c* by pressure of the wash water.

In this example, the first, second, third, and fourth upper inclined protrusions, 720*a*, 720*b*, 720*c*, and 720*d* are inserted into the first and the second main arm inlets 354*a* and 354*b* and the first and the second extension inlets 354*c* and 354*d* of the lower flow path formation rib 354 while the flow path converter 700 is rotated at a certain angle more in one direction.

In this example, the flow path converter 700 may rotate at about 90 degrees. The reason for this is that, the first and the second upper inclined surfaces 723*a* and 725*a* provided at first, second, third, and fourth upper inclined protrusions, 720*a*, 720*b*, 720*c*, and 720*d* occupy an angle of 90 degrees on a circumferential surface of the rotary plate 710.

In this example, the first and the second opening holes 722*a* and 722*c* communicate with the first and the second extension inlets 354*c* and 354*d* instead of the first and the second main arm inlets 354*a* and 354*b*. Accordingly, the wash water introduced into the inlet 638 may be introduced into the first extension inlet 354*c* through the first opening hole 722*a*. The wash water passing through the second opening hole 722*c* may be introduced into the second extension inlet 354*d*.

In some implementations, the first and the second main arm inlets 354*a* and 354*b* are closed by the rotary plate 710. Accordingly, introduction of the wash water through the first and the second main arm inlets 354*a* and 354*b* is blocked.

The water supply pump provided at the sump may intermittently supply the wash water. In detail, after the wash water is supplied to the spray arm holder 600 for a certain time, the supply of the wash water may be suspended for a certain time.

For example, the sump performs the supply and stoppage of the wash water. Thus, as the flow path converter 700 ascends and descends repeatedly to rotate, the first and the second main arm inlets 354*a* and 354*b* and the first and the second extension inlets 354*c* and 354*d* may be alternately opened and closed.

Hereinafter, the eccentric gear 800 of the spray arm assembly 100 will be described in detail, with reference to the accompanying drawing.

Figure 27:
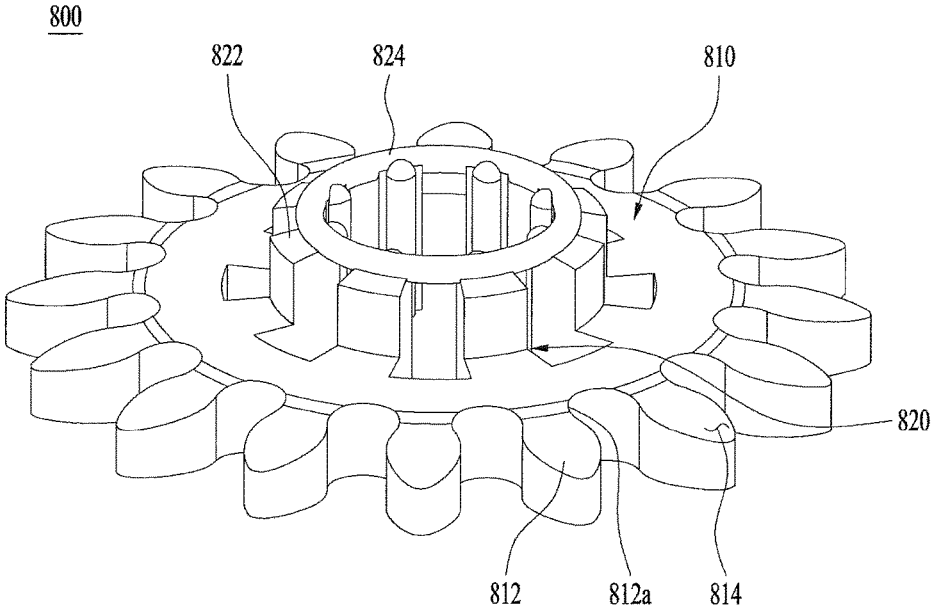
FIGS. 27-30 are diagrams illustrating an example eccentric gear.
Figure 28:
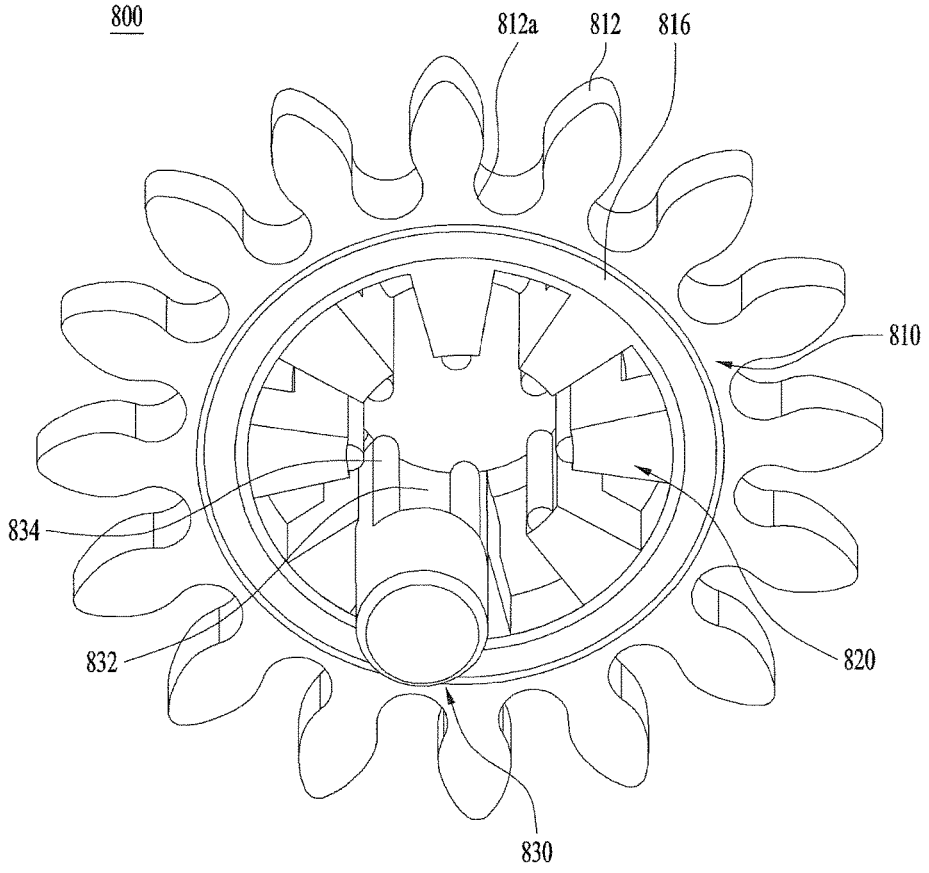
Figure 29:
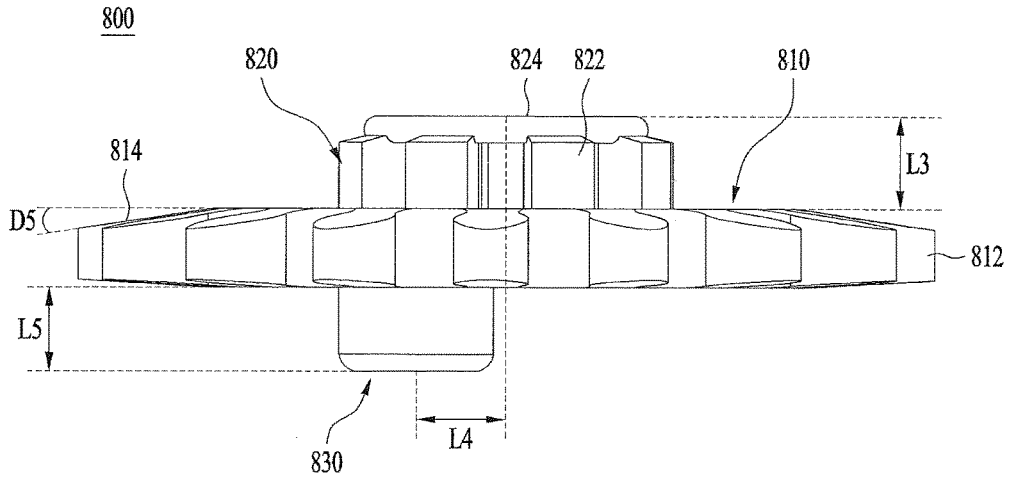

FIGS. 27-29 illustrate an example eccentric gear.

As illustrated in FIGS. 27 to 29, the eccentric gear 800 may include a rim 810, at which a plurality of second gear teeth 812 is formed, provided at the outer circumferential surface of the eccentric gear 800, rotation shaft support protrusions 820 in which a gear rotation shaft 347*b* is accommodated, and an eccentric protrusion 830 inserted into the linker 900 to move the linker 900 with reciprocating motion.

In this example, the rim 810 is formed to be ring-shaped. A plurality of second gear teeth 812 is formed along the outer circumferential surface. An anti-friction rib 816 is formed to be protruded at the lower surface of the rim 810 to minimize friction between the rim 810 and the eccentric gear container 940 of the linker 900 supporting the eccentric gear 800.

In some implementations, inclined surfaces 814 which are inclined downwards at a certain angle D5 in an outer direction of the rim 810 are formed at upper surfaces of the second gear teeth 812. For example, when washing using the wash water, the wash water and the foreign substances may be introduced into upper parts of the second gear teeth 812. For draining and discharge of the wash water and the foreign substances, the upper surfaces of the second gear teeth may be inclined downward at a certain angle D5 in an outer direction of the rim 810.

In addition, the rotation shaft support protrusions 820 are protruded at the inner circumferential surface of the rim 810 forming the eccentric gear 800 in order to support the outer circumferential surface of the gear rotation shaft 347*b* formed at the second lower main arm 341*b* of the main arm lower housing 340. The rotation shaft support protrusions 820 are in line contact with the gear rotation shaft 347*b* such that friction between the rotation shaft support protrusions 820 and the gear rotation shaft 347*b* may be relatively decreased.

Furthermore, the rotation shaft support protrusions 820 are protruded at the inner circumferential surface of the rim 810 forming the eccentric gear 800. For example, a plurality of spaces is formed between the rotation shaft support protrusions 820. The spaces between the rotation shaft support protrusions 820 are provided as spaces where the rotation shaft support protrusions 820 are capable of being deformed elastically. When external force is applied to the rim 810 of the eccentric gear 800, the rotation shaft support protrusions 820 are deformed at adjacent spaces to thus secure spaces for deformation of the rim 810.

In some implementations, protrusions 822 for securing the supported state of the gear rotation shaft 347*b* are formed at an end of the rotation shaft support protrusions 820. In the case where the gear rotation shaft 347*b* is supported by the rotation shaft support protrusions 820, when the eccentric gear 800 is rotated, the eccentric gear 800 is movable due to the spaces between the rotation shaft support protrusions 820. Thus, in order to secure the supported state of the gear rotation shaft 347*b*, each protrusion 822 may be extended to have a certain height.

In addition, the protrusions 822 functions to secure a mounting position of the eccentric gear 800. The eccentric gear 800 is mounted at the lower part of the second lower main arm 341*b*. Separation of the eccentric gear 800 is prevented by the linker 900.

In some implementations, the linker 900 is provided at the lower part of the second lower main arm 341*b*. The eccentric gear 800 may be provided downward at a distance corresponding to at least the thickness of the linker 900, or a thickness of the eccentric gear 800 may be increased. As a result, as each protrusion 822 is formed to have a greater height L3 than the thickness of the linker 900, the mounting position of the eccentric gear 800 may be secured without increase of the thickness of the eccentric gear 800.

In addition, a rotation shaft ring 824 being in line contact with the gear rotation shaft 347*b* along the circumferential surface thereof may be further formed at the ends of the protrusions 822. The protrusions 822 are formed at the rotation shaft support protrusions 820 such that the support state of the gear rotation shaft 347*b* may be secured. However, since the protrusions 822 are extended from the rotation shaft support protrusions 820, the eccentric gear 800 may be movable due to the spaces between the protrusions 822 and rotation shaft support protrusions 820. Accordingly, the rotation shaft ring 824 may be further formed to secure the support state of the gear rotation shaft 347*b*.

In some implementations, the eccentric protrusion 830 is be protruded from the lower part of the eccentric gear 800 to be spaced apart from the rotation shaft of the eccentric gear 800 by a certain interval L4. Furthermore, the eccentric protrusion 830 is inserted into the eccentric gear container 940 of the linker 900, in which the eccentric gear 800 is accommodated. Thus, the eccentric protrusion 830 may be formed to have a height L5 equal to or greater than the thickness of the eccentric gear container 940.

When the eccentric gear 800 is geared to the fixed gear 500 to rotate and revolve along the outer circumferential surface of the fixed gear 500, the eccentric protrusion 830 converts rotational force of the eccentric gear 800 into linear reciprocating motion to be transferred to the linker 900.

In this example, the space L4 between the eccentric protrusion 830 and the rotation shaft relates to a reciprocating distance and the rotation angles of the first and the second auxiliary arms 400*a* and 400*b*, which rotate according to the reciprocating motion of the linker 900. For example, as the space between the eccentric protrusion 830 and the rotation shaft is increased, the reciprocating distance of the linker 900 may be increased. As the reciprocating distance of the linker 900 is increased, the rotation angles of the first and the second auxiliary arms 400*a* and 400*b* may be increased.

In this example, the eccentric protrusion 830 may protrude at the support protrusions 820 of the eccentric gear 800 in an opposite direction to the protrusions 822. Furthermore, in the case where the eccentric position of the eccentric protrusion 830 overlaps an insertion area of the gear rotation shaft 347*b* supported by the support protrusions 820, rotation shaft grooves 832 may be further formed in the eccentric protrusion 830 (i.e. the area into which the gear rotation shaft 347*b* is inserted) for insertion of the gear rotation shaft 347.

In this example, in the case of the rotation shaft grooves 832, in order to prevent friction between the outer circumferential surface of the gear rotation shaft 347*b* and the rotation shaft grooves 832 in the manner of the rotation shaft support protrusions 820, rotation shaft groove support protrusions 834 being in line contact with the outer circumferential surface of the gear rotation shaft 347*b* to support the gear rotation shaft 347*b* may be further formed at the rotation shaft grooves 832.

In some implementations, the rim 810 forming the eccentric gear 800, the rotation shaft support protrusions 820, and the eccentric protrusion 830 may be formed of synthetic resins using injection molding in an integrated manner. However, at least one of the rims 810 forming the eccentric gear 800, the rotation shaft support protrusions 820, and the eccentric protrusion 830 may be separately formed to be assembled to the others, if needed.

Hereinafter, a coupling state of the fixed gear and the eccentric gear will be described in detail, with reference to the accompanying drawing.

Figure 30:
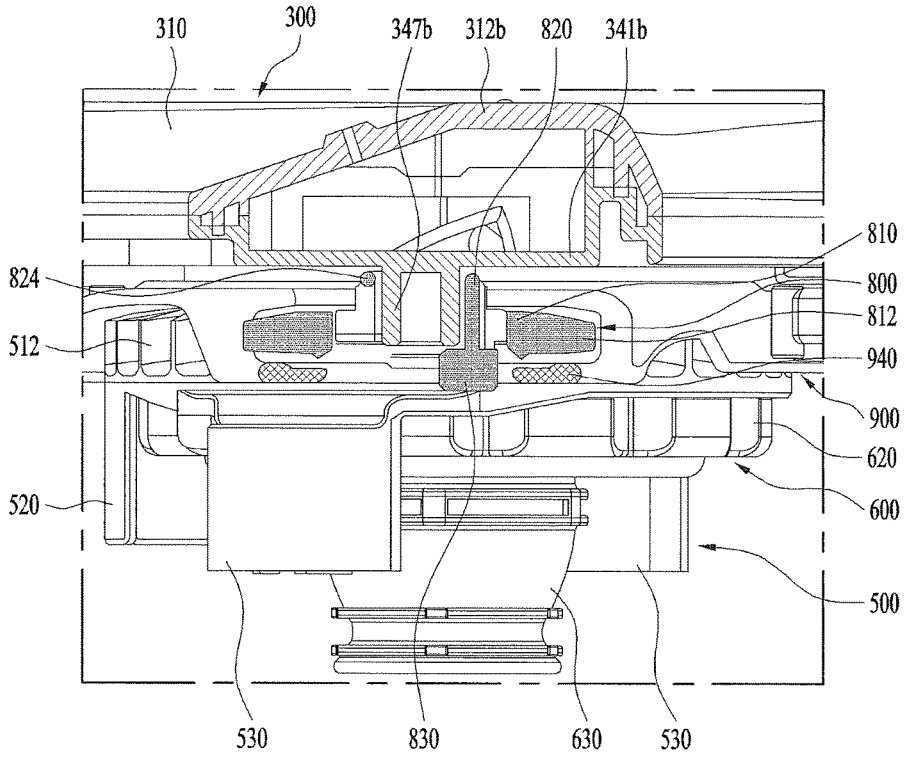
Figure 31:
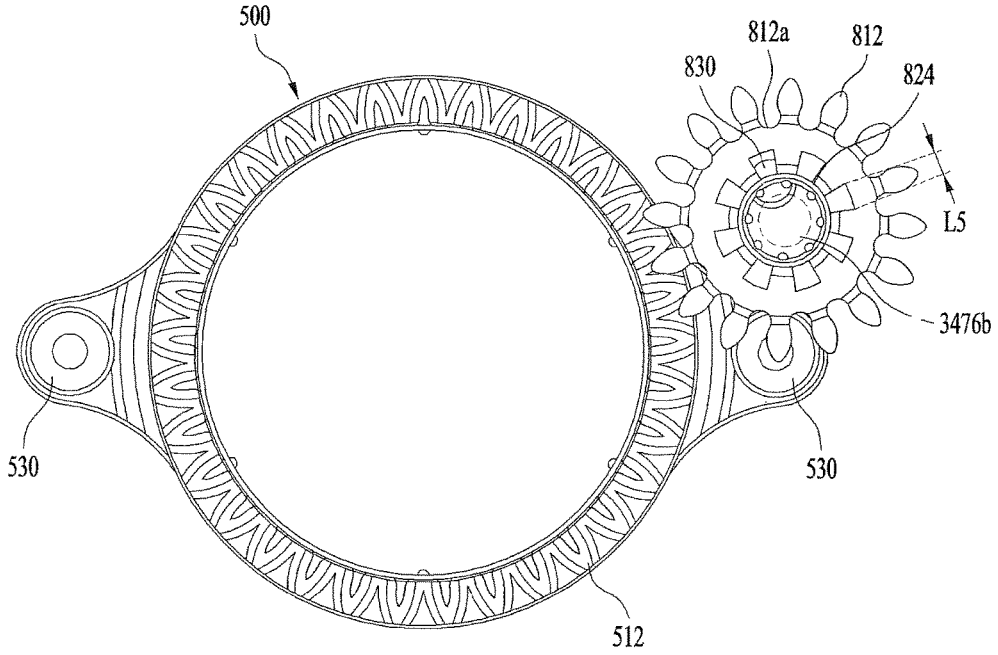
FIG. 31 is a diagram illustrating an example fixed gear and an example eccentric gear.

FIG. 30 illustrates an example eccentric gear. FIG. 30 illustrates a cross-sectional view taken along a line Y'-Y" in FIG. 2. FIG. 31 illustrates an example fixed gear and an example eccentric gear.

As illustrated in FIGS. 30 and 31, the eccentric gear 800 is rotatably inserted into the gear rotation shaft 347*b* formed at the second lower main arm 341*b* of the main arm lower housing 340. The eccentric gear 800 is supported by the eccentric gear container 940 of the linker 900. The second gear teeth 812 of the eccentric gear 800 are geared to the first gear teeth 512 of the fixed gear 500.

In some implementations, as described above, the number of second gear teeth 812 formed at the eccentric gear 800 and first gear teeth 512 formed at the fixed gear 500 may depend on rotation of the spray arm 200 and rotational motion of the first and the second auxiliary arms 400*a* and 400*b*.

In this example, when the number of first gear teeth 512 formed at the fixed gear 500 and the number of second gear teeth 812 formed at the eccentric gear 800 have a certain multiple relationship, rotation and cycles of the spray arm 200 and the patterns of rotational motion of the first and the second auxiliary arms 400*a* and 400*b* may have a certain period according to the multiple relationship between the first and the second gear teeth 512 and 812.

For example, when there is particular multiple relationship between the numbers of first and the second gear teeth 512 and 812, rotational motion of the first and the second auxiliary arms 400*a* and 400*b* may be constantly repeated according to rotational position of the spray arm 200. Thus, spray pattern of the wash water sprayed from the first and the second auxiliary arms 400*a* and 400*b* may be fixed.

In this case, since the spray pattern of the wash water sprayed from the spray arm 200, the spray pattern of the wash water sprayed from the first and the second auxiliary arms 400*a* and 400*b*, and the sprayed areas are repeated with a certain cycle, the sprayed positions of wash water sprayed from the first and the second auxiliary arms 400*a* and 400*b* are fixed.

That is, when the sprayed positions of wash water sprayed from the first and the second auxiliary arms 400*a* and 400*b* are fixed, the sprayed areas of wash water sprayed from the first and the second auxiliary arms 400*a* and 400*b* are limited, thereby decreasing washing capacity due to the first and the second auxiliary arms 400*a* and 400*b*. When the sprayed positions of wash water sprayed from the first and the second auxiliary arms 400*a* and 400*b* are fixed, the sprayed range of the wash water is fixed, thereby decreasing washing capacity of the dishwasher 1.

Thus, it is necessary to vary the spraying patterns of the wash water sprayed from the first and the second auxiliary arms 400*a* and 400*b*. To this end, the number of first gear teeth 512 formed at the fixed gear 500 and the number of second gear teeth 812 formed at the eccentric gear 800 may be formed to have a relative prime relationship therebetween. When the number of first gear teeth 512 formed at the fixed gear 500 and the number of second gear teeth 812 formed at the eccentric gear 800 are formed to have a relative prime relationship therebetween, the rotation pattern cycle of the fixed gear 500 and the eccentric gear is longer than in the case of a multiple relationship between the numbers of first and the second gear teeth 512 and 812. Thereby, the spray patterns of the wash water sprayed from the first and the second auxiliary arms 400*a* and 400*b* may be varied.

In some implementations, each of the second gear teeth 812 formed at the eccentric gear 800 has a smaller diameter than that of each of the first gear teeth 512 formed at the fixed gear 500. Under-cut of the second gear teeth 812 may be generated by the first and the second gear teeth 512 and 812. Thus, under-cut holes 812*a* may be further formed to prevent abrasion of the second gear teeth 812 due to friction.

Furthermore, when the fixed gear 500, at which the first gear teeth 512 are formed and the eccentric gear 800, at which the second gear teeth 812 are formed, are made of the same material, there is abrasion due to friction therebetween.

In this case, there is a disadvantage with respect to the maintenance of the fixed gear 500 and the eccentric gear 800. Accordingly, the fixed gear 500, at which the first gear teeth 512 are formed and the eccentric gear 800, at which the second gear teeth 812 are formed, may be formed of different materials. The fixed gear 500 may be formed of a harder material than the eccentric gear 800.

In some implementations, upon washing, if the foreign substances become stuck between the first gear teeth 512 of the fixed gear 500 and the second gear teeth 812 of the eccentric gear 800, it becomes impossible to rotate the eccentric gear 800. In this case, when the fixed gear 500 and the eccentric gear 800 are engaged, rotation of the spray arm 200 may be limited by the eccentric gear 800.

In this example, the eccentric gear 800 is supported by a plurality of rotation shaft support protrusions 820. The rotation shaft support protrusions 820 may be elastically deformed into the spaces L5 formed between the rotation shaft support protrusions 820. Accordingly, when the foreign substances are stuck between the first gear teeth 512 of the fixed gear 500 and the second gear teeth 812 of the eccentric gear 800, force due to the volume of the foreign substances is applied to the rim 810 of the eccentric gear 800 and the rotation shaft support protrusions 820 in the rim 810 are elastically deformed. Thereby, the eccentric gear 800 may be rotated along the fixed gear 500 regardless of whether the foreign substances are stuck between the first gear teeth 512 and the second gear teeth 812.

Hereinafter, the linker 900 of the spray arm assembly 100 will be described in detail, with reference to the accompanying drawing.

Figure 32:
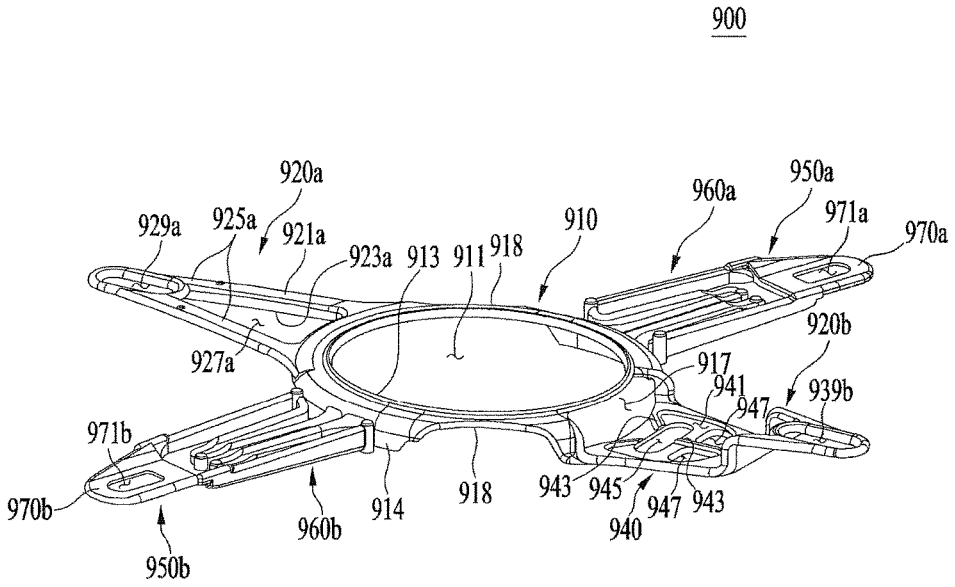
FIGS. 32-34 are diagrams illustrating an example linker.
Figure 33:
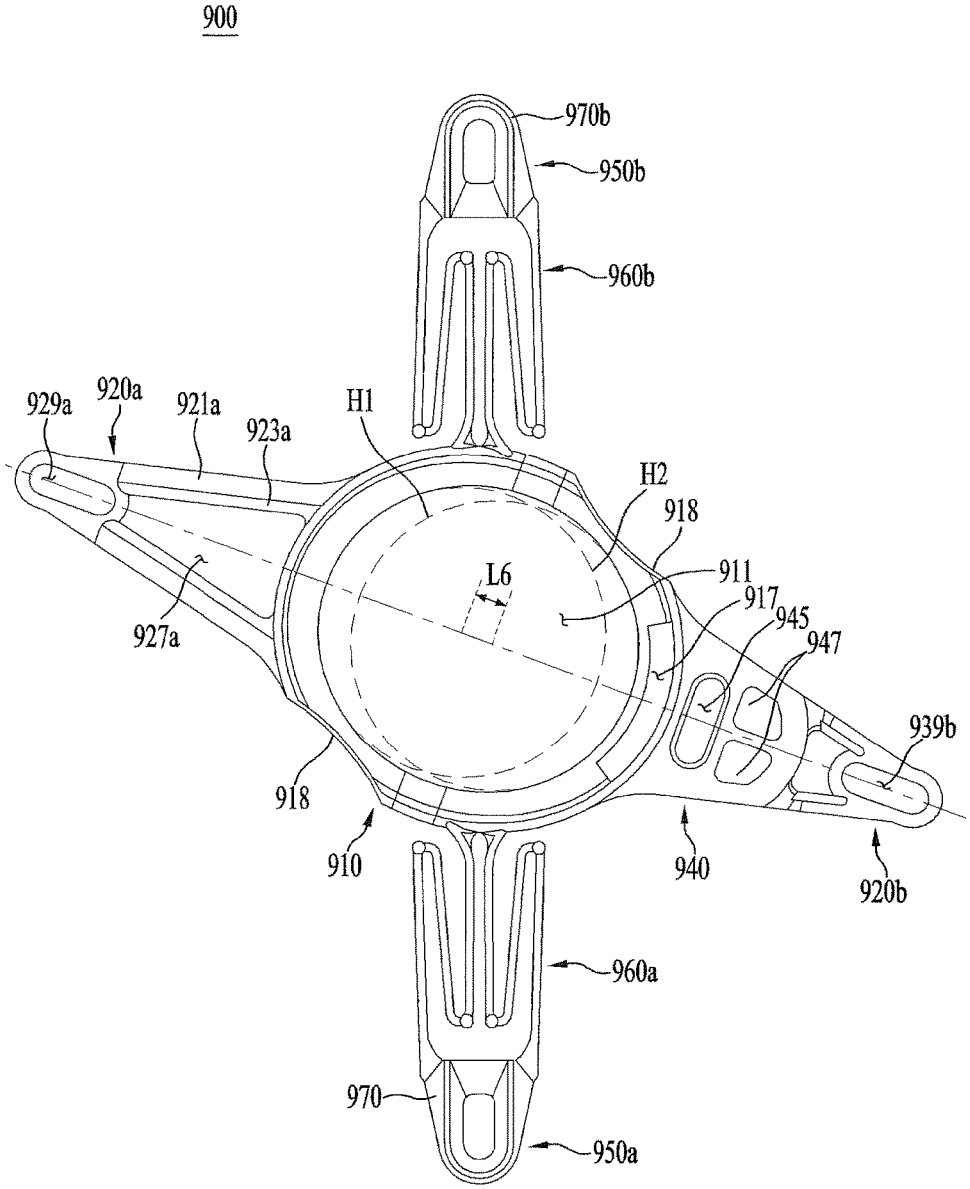
Figure 34:
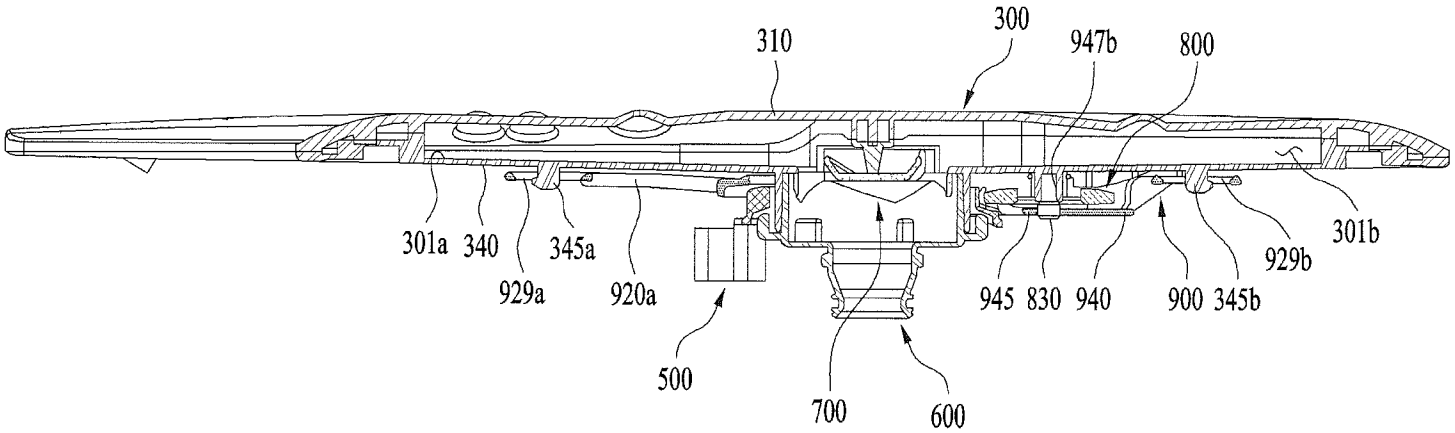

FIGS. 32-34 illustrate an example linker. FIG. 34 illustrates a cross-sectional view taken along a line E'-E" in FIG. 2.

As illustrated in FIGS. 32-34, the linker 900 includes the rim-shaped body 910 having an elongated hole in which the spray arm holder coupler 356 of the main arm lower housing 340 is movably inserted, the first main link 920 extending from the rim-shaped body 910 to the first main arm 300*a* to be movably coupled thereto, the second main link 920*b* extending from the rim-shaped body 910 to the second main arm 300*b* to be movably coupled thereto while being coupled to the eccentric gear 800, the first auxiliary link 950*a* extending to the first extension 300*c* to be coupled to the first auxiliary arm 400*a*, and the second auxiliary link 950*b* extending to the second extension 300*d* to be coupled to the second auxiliary arm 400*b*.

In this example, the elongated hole 911 into which the spray arm holder coupler 356 is inserted is formed in the rim-shaped body 910. The elongated hole 911 has a width corresponding to a diameter of the spray arm holder 600 to move the linker 900 with respect to the spray arm holder 600, and a length corresponding to moving distance of the linker 900. The elongated hole 911 may be formed as an enlarged hole H1 having a greater size than that of the spray arm holder coupler 356 and a different hole H2 having a center which is spaced apart from a center of the hole H1 at a moving distance, L6 i.e. the moving distance of the linker 900.

In some implementations, in the inner circumferential surface of the elongated hole 911, the upward reinforcing rib 913 is extended to the upper side of the rim-shaped body 910 to reinforce the rim-shaped body 910. In the outer circumferential surface of the elongated hole 911, the downward reinforcing rib 914 is extended to the lower side of the rim-shaped body 910 to reinforce the rim-shaped body 910.

In this example, the upward reinforcing rib 913 and the downward reinforcing rib 914 reinforce the rim-shaped body 910 while discharging the wash water and the foreign substances introduced into the upper part of the linker 900.

For example, introduction of the wash water and the foreign substances introduced into the upper part of the linker 900 to the spray arm holder coupler 356 is prevented by the upward reinforcing rib 913 formed at the upper side of the rim-shaped body 910 in the rim-shaped body 910 and is guided downward of the linker 900 according to the downward reinforcing rib 914 formed at the lower side of the rim-shaped body 910 at the outside of the rim-shaped body 910.

Furthermore, in the case of the downward reinforcing rib 914, the first and the second links 920*a* and 920*b* and the first and the second auxiliary links 950*a* and 950*b* extend to form the downward reinforcing rib 914. Accordingly, in order to form the first and the second links 920*a* and 920*b* and the first and the second auxiliary links 950*a* and 950*b*, the downward reinforcing rib 914 may be formed to have a greater height than that of each of the first and the second links 920*a* and 920*b* and the first and the second auxiliary links 950*a* and 950*b*.

In some implementations, cutting parts 918 corresponding to the shape of the spray arm 200 are formed in part of the outer circumferential surface of the rim-shaped body 910 to prevent the linker 900 from being exposed to the outside of the spray arm 200. For example, the cutting parts 918 may be formed between the first main arm 300*a* and the first extension 300*c*, and between the second main arm 300*b* and the second extension 300*d*.

That is, there are obtuse angles D2 (see, FIG. 5) between the first main arm 300*a* and the first extension 300*c*, and between the second main arm 300*b* and the second extension 300*d* such that the linker 900 provided below the spray arm 200 may be easily exposed above the spray arm 200. However, positions of the cutting parts 918 are not limited and the cutting parts 918 may be formed at different positions, if needed.

The first main link 920*a* may include a first extending plate 921*a* extending to the first main arm 300*a* in the downward reinforcing rib 914 of the rim-shaped body 910, a first drain hole 927*a* formed in the first extending plate 921*a*, and a first moving elongated hole 929*a* formed at an end of the first extending plate 921*a* to be movably coupled to the first guide protrusion 345*a* of the first lower main arm 341*a*.

In this example, the first extending plate 921*a* extends to have a smaller width than that of the first main arm 300*a*. A first reinforcing rib 923*a* extending to the lower side of the first extending plate 921*a* is formed at the inner circumferential surface of the first extending plate 921*a* (i.e. the outer circumferential surface of the first drain hole 927*a*). A plurality of wear prevention protrusions 925*a* is formed at the upper surface of the first extending plate 921*a* to prevent friction between the first extending plate 921*a* and the first lower main arm 341*a*.

In some implementations, when the wash water and the foreign substances are introduced into the upper part of the extending plate 921*a*, the first reinforcing rib 923*a* functions to guide the wash water and the foreign substances to the lower side of the first extending plate 921*a*.

In addition, the first moving elongated hole 929*a* extends parallel to the reciprocating direction of the linker 900. The first moving elongated hole 929*a* may be formed to have a greater length than a moving distance of reciprocating motion of the linker 900.

The second main link 920*b* may include a second extending plate 921*b* extending from the downward reinforcing rib 614 to the second main arm 300*b*, the eccentric gear container 940 depressed to the lower side of the center of the second extending plate 921*b* to accommodate the eccentric gear 800, and a second moving elongated hole 939*b* formed at the end of the second extending plate 921*b* to be movably coupled to the second guide protrusion 345*b* of the second lower main arm 341*b*.

In some implementations, the second extending plate 921*b* extends to have a smaller width than that of the second main arm 300*b*. The eccentric gear container is formed in the second extending plate 921*b*.

In this example, the second moving elongated hole 939*b* extends parallel to the reciprocating direction of the linker 900. The second moving elongated hole 939*b* may be formed to have a greater length than a moving distance of reciprocating motion of the linker 900.

In some implementations, a rotation gear insertion slot 917 is formed at the downward reinforcing rib 914 at a position where the second extending plate 921*b* is formed. The rotation gear insertion slot 917 allows the eccentric gear 800 accommodated in the eccentric gear container 940 to be exposed at the fixed gear 500. The eccentric gear container 940 may extend to the second main arm 300*b* at the lower side of the downward reinforcing rib 914.

In addition, in order to accommodate the eccentric gear 800 in the eccentric gear container 940, the eccentric gear container 940 may be formed to have a depth greater than the height of the eccentric gear 800 except for the height of the eccentric protrusion 830.

Furthermore, a recessed part 941 is formed at the upper surface of the eccentric gear container 940 to prevent direct contact between the eccentric gear 800 and the eccentric gear container 940. At least three wear prevention ribs 943 being in contact with the anti-friction ribs 816 of the eccentric gear 800 may be protruded at the recessed part 941.

In addition, an eccentric protrusion insertion slot 945, into which the eccentric protrusion 830 of the eccentric gear 800 is inserted, and second drain holes 947 for discharging the wash water and the foreign substances introduced into the eccentric gear container 940 are formed at the recessed part 941 of the eccentric gear container 940.

In this example, each second drain hole 947 extends in a perpendicular direction to a moving direction of the linker 900. Accordingly, as the eccentric gear 800 inserted into the gear rotation shaft 347*b* rotates, the eccentric protrusion 830 of the eccentric gear 800 generates external force parallel to the first and the second elongated holes 929*a* and 939*b* such that the linker 900 may perform reciprocating motion.

In this example, the eccentric protrusion insertion slot 945 is formed to have a size equal to or greater than a radius of rotation of the eccentric protrusion 830. A direction of the eccentric protrusion insertion slot 945 may be differently set depending on moving distances of the linker 900. That is, when the direction of the eccentric protrusion insertion slot 945 is formed to be perpendicular to the moving direction of the linker 900, the greatest reciprocating distance of the linker 900 may be provided.

In some implementations, the centers of the elongated hole 911 of the rim-shaped body 910, the first moving elongated hole 929*a* of the first main link 920*a*, the second moving elongated hole 939*b* of the second main link 940, and eccentric protrusion insertion slot 945 of the eccentric gear container 940 may be collinear. The reason for this is that, reciprocating motion of the linker 900 may be effectively performed according to the reciprocating motion of the linker 900 by the eccentric gear 800

In addition, the first auxiliary link 950*a* extends to the first extension 300*c* and is coupled to the pivoting protrusion 425*a* formed at the first auxiliary arm 400*a* which is rotatably coupled to the first extension 300*c*. In this example, the first auxiliary link 950*a* may include the first elastic buffer 960*a* extending from the downward reinforcing rib 914 of the rim-shaped body 910 to the first extension 300*c* and the first auxiliary arm coupler 970*a* formed at the end of the first elastic buffer 960*a* to be coupled so as to the pivoting protrusion 425*a*.

Furthermore, the second auxiliary link 950*b* extends to the second extension 300*d* and is coupled to the pivoting protrusion 425*a* formed at the second auxiliary arm 400*b* which is rotatably coupled to the second extension 300*d*. In this example, the second auxiliary link 950*b* may include the second elastic buffer 960*b* extending from the downward reinforcing rib 914 of the rim-shaped body 910 to the second extension 300*d* and the second auxiliary arm coupler 970*b* formed at the end of the second elastic buffer 960*b* to be coupled to the pivoting protrusion 425*a*.

In some implementations, the rim-shaped body 910, the first and the second main links 920*a* and 920*b*, and the first and the second auxiliary links 950*a* and 950*b* may be separately formed and then may be assembled. However, for convenience of manufacturing, the rim-shaped body 910, the first and the second main links 920*a* and 920*b*, and the first and the second auxiliary links 950*a* and 950*b* may be formed by injection molding in an integrated manner.

In this example, the first and the second elastic buffer 960*a* and 960*b* and the first and the second auxiliary arm couplers 970*a* and 970*b* may be formed to have identical shapes and may be formed to be symmetric with respect to the rim-shaped body 910. Thus, the first and the second elastic buffer 960*a* and 960*b* and the first and the second auxiliary arm couplers 970*a* and 970*b* are not separately described. The first elastic buffer 960*a* and the first auxiliary arm coupler 940*a* will be representatively described below.

Figure 35:
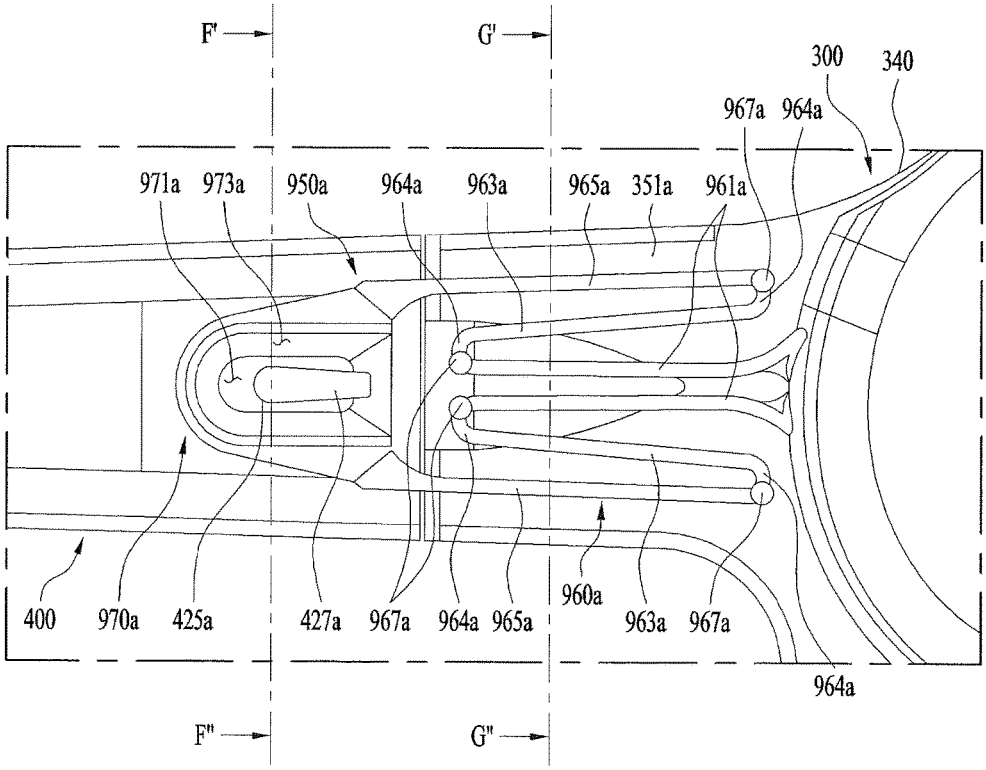
FIGS. 35-37 are diagrams illustrating an example first elastic butter and an example first auxiliary arm connector.
Figure 36:
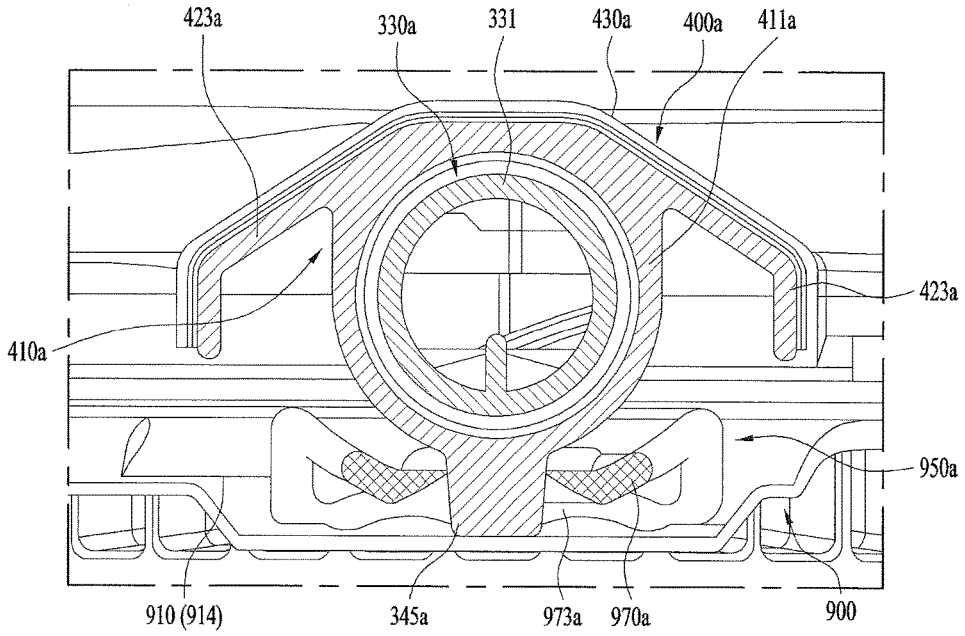
Figure 37:
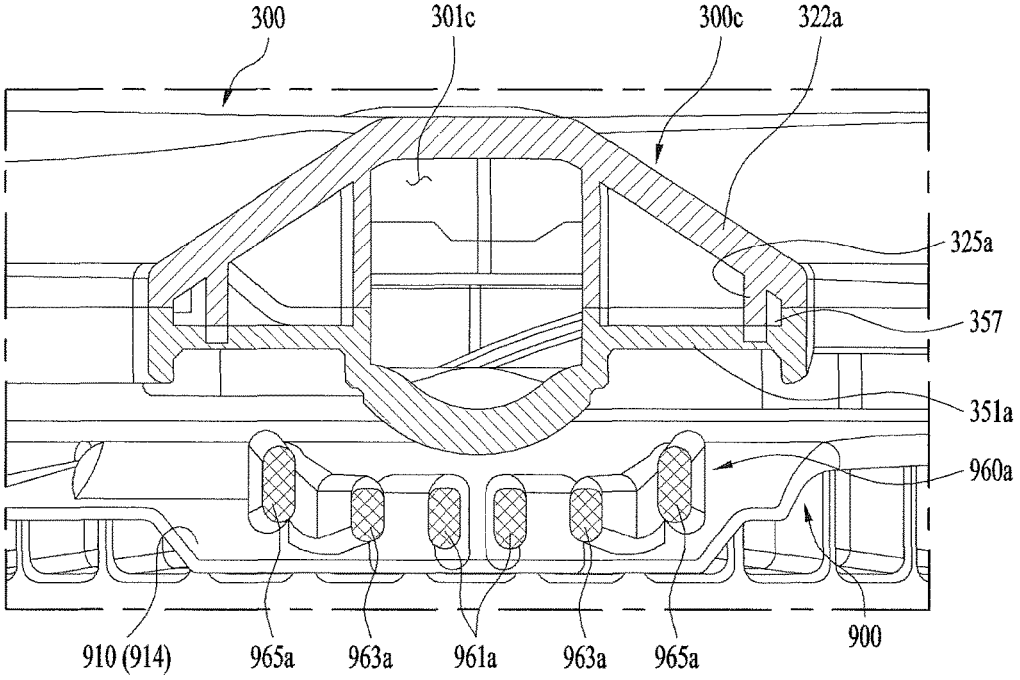

FIGS. 35-37 illustrate an example first elastic butter and an example first auxiliary arm connector. FIG. 36 illustrates a cross-sectional view taken along a line F'-F" in FIG. 35. FIG. 37 illustrates a cross-sectional view taken along a line G'-G" in FIG. 35.

As illustrated, the first auxiliary arm coupler 970*a* includes the first pivoting elongated hole 971*a*, to which the pivoting protrusion 425*a* formed at the lower part of the first auxiliary arm 400 is inserted is formed, formed at the end of the first auxiliary link 950*a* and a first inclined surface 973*a* formed at an adjacent part of the first pivoting elongated hole 971*a* of the lower surface of the first auxiliary arm coupler 970*a* to secure a pivoting space of the pivoting protrusion 425*a* when the first auxiliary arm 400*a* pivots.

In this example, in the upper surface of the first auxiliary arm, the first elongated hole 971*a* corresponding to the shape of the lower part of the first auxiliary arm 400*a* is recessed, and both side of the first auxiliary arm coupler 970*a* is protruded (see FIG. 36). In some implementations, the wash water and the foreign substances introduced into the upper surface of the first auxiliary arm coupler 970*a* move from both sides of the first auxiliary arm coupler 970*a* due to the shape of the first auxiliary arm coupler 970*a* to the first pivoting elongated hole 971*a*, thereby being discharged through the first pivoting elongated hole 971*a*.

In some implementations, the first pivoting elongated hole 971*a* may be formed to have a certain length into which the pivoting protrusion 425*a* formed at the first auxiliary arm 400*a* may be inserted. The length of the first pivoting elongated hole 971*a* may be equal to or greater than that of each stoppage protrusion 427*a* formed at the pivoting protrusion 425*a*. Furthermore, the first pivoting elongated hole 971*a* may have a width such that interference between the pivoting protrusion 425*a* and the first pivoting elongated hole 971*a* does not occur when the linker 900 performs reciprocating motion for rotating the first auxiliary arm 400*a*.

Furthermore, when the pivoting protrusion 425*a* of the first auxiliary arm 400*a* is inserted into the first pivoting elongated hole 971*a* formed at the first auxiliary arm coupler 970*a*, the position of the first auxiliary arm coupler 970*a* may be a position at which the first pivoting elongated hole 971*a* is not in direct contact with the pivoting protrusion 425*a* or a position forming minimum contact between the first pivoting elongated hole 971*a* and the pivoting protrusion 425*a*.

That is, when the linker 900 performs reciprocating motion for rotating the first auxiliary arm 400*a*, the first pivoting elongated hole 971*a* of the first auxiliary arm coupler 970*a* presses the pivoting protrusion 425*a* to rotate the first auxiliary arm 400*a*. Thereby, abrasion of the pivoting protrusion 425*a* or the first pivoting elongated hole 971*a* may occur. Thus, contact between the first pivoting elongated hole 971*a* and the pivoting protrusion 425*a* is minimized to prevent abrasion of the first pivoting elongated hole 971*a* and the pivoting protrusion 425*a*.

In some implementations, the first elastic buffer 960*a* may include a pair of first extension links 961*a* extending from the downward reinforcing rib 914 of the rim-shaped body 910 to the center of the first auxiliary arm connector 330*a*, a pair of second extension links 965*a* extending to outsides of a pair of first extension links 961*a* to be spaced apart from each other at a certain interval at the outside of the first auxiliary arm connector 330*a*, and an elastic link 963*a* at outsides of a pair of first extension links 961*a* and insides of a pair of second extension links 965*a* to connect the end of each of first extension links 961*a* to the end of a corresponding the second extension links 965*a*.

In this example, as a pair of first extension links 961*a* extend from the downward reinforcing rib 914, each first extension link 961*a* may be formed as a bar having a decreased cross-sectional area. A pair of first extension links 961*a* may be formed to be symmetric with respect to the center between the first extension links 961*a*.

The reason for this is that, as the first extension link 961*a* has elastic force and the rim-shaped body 910 performs reciprocating motion according to rotation of the eccentric gear 800, kinetic force of the reciprocating motion is transferred to the first auxiliary arm connector 330*a* and strength of the rim-shaped body 910 is maintained. For example, a pair of first extension links 961*a* is formed to be symmetric since the first extension links 961*a* maintain strength along a motion direction according to reciprocating motion of the rim-shaped body 910.

In some implementations, a pair of second extension links 965*a* extends from the first auxiliary arm connector 330*a* to the rim-shaped body 910 while being spaced apart from each other at a certain interval at the outsides of a pair of first extension links 961*a*. In this example, as the second extension links 965*a* extend from the first auxiliary arm connector 330*a* to the rim-shaped body 910, each second extension link 965*a* may be formed in the shape of a bar having an increasing cross-sectional area. A pair of second extension links 965*a* may be formed to be symmetric with respect to the center between the second extension links 965*a*.

In some implementations, the elastic link 963*a* connects the end of each first extension link 961*a* to the end of each second extension link 965*a* to provide elastic force parallel to and in a perpendicular to the reciprocating direction of the first auxiliary arm connector 330*a*.

That is, since the first and the second extension links 961*a* and 965*a* extend parallel to each other, when kinetic force is applied to the first and the second extension links 961*a* and 965*a* in a direction perpendicular to the extending direction of the first second extension links 961*a* and 965*a*, elastic force may be generated. However, when kinetic force is applied to the first and the second extension links 961*a* and 965*a* in a direction parallel to the extending direction, elastic force may not be generated.

Accordingly, the elastic link 963*a* may connect the ends of the first and the second extension links 961*a* and 965*a* to each other such that they are inclined at a certain angle, so that elastic force may be generated in other directions, which are not generated in the first and the second extension links 961*a* and 965*a*.

The elastic link 963*a* may include bending parts 964*a* curvedly formed at one side connected to the first extension link 961*a* and at the other side connected to the second extension link 965*a*. The bending parts 964*a* may increase directional range in which elastic force is generated at the bending parts 964*a*.

In some implementations, when points of contact between the first extension links 961*a*, the second extension links 965*a* and the elastic links 963*a* repeatedly receives elastic force, damage due to stress concentration may occur. Thus, link reinforcing parts 967*a* may be further formed at the points of contact between the first extension links 961*a*, the second extension links 965*a* and the elastic links 963*a* to prevent damage due to stress concentration. In this example, each link reinforcing part 967*a* being in contact with the end of each link in a longitudinal direction of the outer circumferential surface of the link may be formed to have a cylindrical shape.

Furthermore, as illustrated in FIG. 37, when the wash water and the foreign substances are introduced into the upper part of the first elastic buffer 960*a*, a horizontal width of each of the first extension links 961*a*, the second extension links 965*a* and the elastic links 963*a* may be smaller than a vertical width thereof, thereby discharging the wash water and the foreign substances. For example, when the horizontal width of each of first extension links 961*a*, the second extension links 965*a* and the elastic links 963*a* is greater than the vertical width thereof; the wash water and the foreign substances remain at the upper part of the first elastic buffer 960*a*.

Furthermore, in the cross-sectional view of each of the first extension links 961*a*, the second extension links 965*a* and the elastic links 963*a*, when the horizontal width is less than the vertical width, the buffering effect of the first elastic buffer 961*a* may be effective. For example, as illustrated, when the cross-sections of the first extension links 961*a*, the second extension links 965*a* and the elastic links 963*a* are formed, the linker 900 may be formed to be perpendicular to a reciprocating direction such that elastic force may be effectively generated in a moving direction of the linker 900.

Furthermore, elastic force of the first elastic buffer 960*a* may be varied depending on materials or shapes of the first extension links 961*a*, the second extension links 965*a* and the elastic links 963*a*. For example, the first extension links 961*a*, the second extension links 965*a* and the elastic links 963*a* may be formed of materials having different elasticities, thereby controlling elastic force of the first elastic buffer 960*a*. In some implementations, thicknesses, lengths, widths of the first extension links 961*a*, the second extension links 965*a* and the elastic links 963*a* may be changed to control elastic force of the first elastic buffer 960*a*. Furthermore, formation angles or shapes of the elastic links 963*a* connecting the first extension links 961 to the second extension links 965*a* may be changed to control elastic force of the first elastic buffer 960*a*.

In some implementations, elastic deformation range of the first elastic buffer 960*a* may be obtained by spaces between the first extension links 961*a*, the second extension links 965*a* and the elastic links 963*a*. For example, when the spaces between first extension links 961*a*, the second extension links 965*a* and the elastic links 963*a* are increased, elastic deformation range of the first elastic buffer 960*a* may be increased. When the spaces between first extension links 961*a*, the second extension links 965*a* and the elastic links 963*a* are decreased, elastic deformation range of the first elastic buffer 960*a* may be decreased.

In addition, since the first elastic buffer 960*a* corresponds to the shape of the lower surface of the first extension 300*c* at which the first elastic buffer 960*a* is provided, the first extension links 961*a*, the second extension links 965*a* and the elastic links 963*a* may be formed to have different heights and different vertical widths.

In some implementations, elastic force of the first elastic buffer 960*a* satisfies minimum elastic force, in which the linker 900 performs reciprocating motion according to rotation of the eccentric gear 800 and generated kinetic force of the linker 900 is transferred to the first auxiliary arm 400*a* to rotate the first auxiliary arm 400*a*, and elastic force, in which kinetic force of the linker 900 is absorbed not to be transferred to the first auxiliary arm 400*a* when the first auxiliary arm 400*a* is restricted.

In some implementations, there is a possibility of rotation restraint of the first auxiliary arm 400*a* due to some cause such as deposition of the foreign substances. In this case, the linker 900 transferring power to the first auxiliary arm 400*a*, the eccentric gear 800, the spray arm 200, and the fixed gear 500 may be sequentially restricted by the rotation restraint of the first auxiliary arm 400*a*.

That is, upon the rotation restraint of the first auxiliary arm 400*a*, reciprocating motion of the linker 900 is restricted by the first auxiliary arm 400*a*. Rotation of the eccentric gear 800 for performing reciprocating motion of the linker 900 is restricted by restraint of reciprocating motion of the linker 900. Relative rotation of the eccentric gear 800 and the fixed gear 500 is restricted by restraint of rotation of the eccentric gear 800 to thus restrict rotation of the spray arm 200 coupled to the eccentric gear 800.

In this example, upon rotation restraint of the first auxiliary arm 400*a*, the first elastic buffer 960*a* of the first auxiliary arm 950*a* absorbs force transferred from the linker 900 as elastic force, thereby performing the reciprocating motion of the linker 900. Thus, despite of restraint of the first auxiliary arm 400*a*, the linker 900 may perform the reciprocating motion for rotating the first auxiliary arm 400*a*. Thereby, the linker 900 transferring power to the first auxiliary arm 400*a*, the eccentric gear 800, the spray arm 200, and the fixed gear 500 may be operated.

Hereinafter, the mounted state of the linker 900 will be described in detail with reference to the accompanying drawings.

Figure 38:
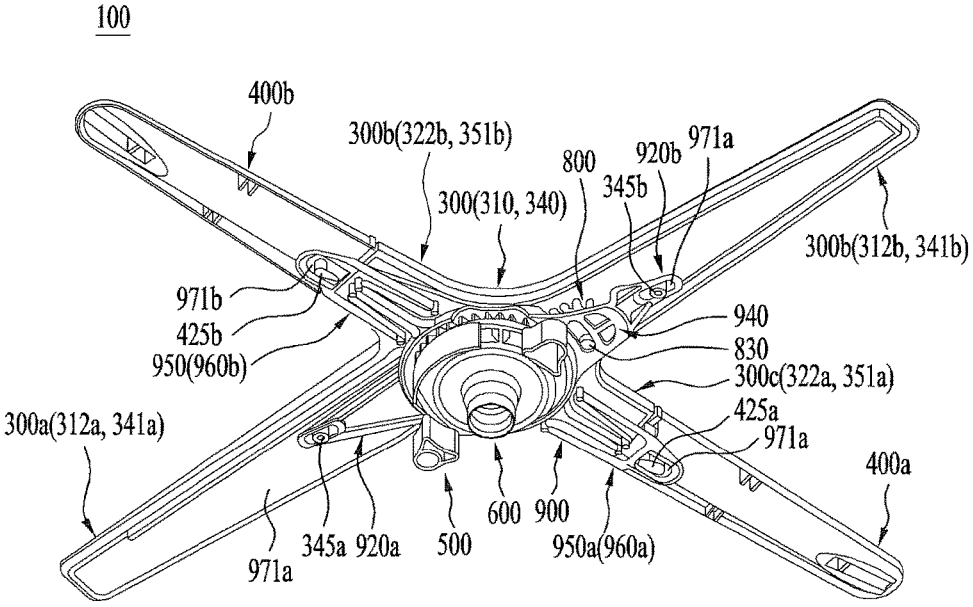
FIG. 38 is a diagram illustrating an example linker.

FIG. 38 illustrates an example linker.

As illustrated in FIGS. 38, 2 and 3, the first extension 300*c* and the second extension 300*d* of the main arm 300 are coupled to the first auxiliary arm 400*a* and the second auxiliary arm 400*b*, respectively. The eccentric gear 800 may be inserted into the gear rotation shaft 347*b* formed at the second main arm 300*b* of the spray arm 200.

In this example, the linker 900 is movably coupled to the spray arm holder coupler 356 of the main arm 300 through the elongated hole of the rim-shaped body 910 of the linker 900. In addition, the first and the second main links 920*a* and 920*b* of the linker 900 are movably coupled to the first and the second guide protrusions 345*a* and 345*b*. The first and the second auxiliary links 950*a* and 950*b* are coupled to the pivoting protrusions of the first and the second auxiliary arms 400*a* and 400*b*.

Firstly, the pivoting protrusion 425*a* of the first auxiliary arm 400*a* is movably inserted into the first pivoting elongated hole 971*a* of the first auxiliary link 950*a*. In this example, when the first pivoting elongated hole 971*a* of the first auxiliary link 950*a* is held to the pivoting protrusion 425*a*, in order to insert the stoppage protrusions 427*a* formed at the pivoting protrusion 425*a*, the first elastic buffer 960*a* formed at the first auxiliary link 950*a* is elongated at a certain distance while bending due to elastic force, such that the stoppage protrusions 427*a* are inserted into the first pivoting elongated hole 971*a*. Then, the first elastic buffer 960*a* is restored to be held at the pivoting protrusion 425*a* of the first pivoting elongated hole 971*a* after insertion of the stoppage protrusions 427*a*.

In addition, the pivoting protrusion 425*a* of the second auxiliary arm 400*b* is movably inserted into the second pivoting elongated hole 971*b* of the second auxiliary link 950*b*. In this example, when the second pivoting elongated hole 971*b* of the second auxiliary link 950*b* is held to the pivoting protrusion 425*a*, in order to insert the stoppage protrusions 427*b* formed at the pivoting protrusion 425*a*, the second elastic buffer 960*b* formed at the second auxiliary link 950*b* is elongated at a certain distance while bending due to elastic force, such that the stoppage protrusions 427*b* are inserted into the second pivoting elongated hole 971*b*. Then, the second elastic buffer 960*b* is restored to be held at the pivoting protrusion 425*b* of the second pivoting elongated hole 971*b* after insertion of the stoppage protrusions 427*b*.

In some implementations, the first guide protrusion 345*a* of the first main arm 300*a* is movably inserted into the first moving elongated hole 929*a* of the first main links 920*a*. The first extension step 346*a* formed at the first guide protrusion 345*a* is inserted into the first moving elongated hole 929*a* in an interference-fit manner, such that the first guide protrusion 345*a* is movably inserted and separation thereof is prevented by the first extension step 346*a*.

Furthermore, the second guide protrusion 345*b* of the second main arm 300*b* is movably inserted into the second moving elongated hole 929*b* of the second main links 920*b*. The second extension step 346*a* formed at the second guide protrusion 345*b* is inserted into the second moving elongated hole 929*b* in an interference-fit manner, such that the second guide protrusion 345*b* is movably inserted and separation thereof is prevented by the second extension step 346*b*.

In this example, the eccentric gear 800 movably coupled to the gear rotation shaft 347*b* of the lower part of the second main arm 300*b* is supported by the eccentric gear container 940 of the second main link 920*b*. Furthermore, the eccentric protrusion 830 of the eccentric gear 800 is inserted into the eccentric protrusion insertion slot 945 formed at the eccentric gear container 940 of the second main link 920*b*.

Then, the fixed gear 500 is additionally coupled to the spray arm holder coupler 356. The fixed gear 500 is mounted to surround the circumferential surface of the spray arm holder coupler 356. For example, the spray arm holder coupler 356 is inserted into the rim 510 of the fixed gear 500. In this example, the first gear teeth 512 of the fixed gear 500 are geared to the second gear teeth 812 of the eccentric gear 800.

Sequentially, the spray arm holder 600 is additionally coupled to the spray arm 200. First, after the spray arm holder 600 is inserted into the spray arm holder coupler 356, when the spray arm holder coupler 356 is rotated at a certain angle, the holding protrusion 622*a* of the spray arm holder 600 is held at the spray arm holder coupler protrusions 656*a* of the spray arm holder coupler 356, such that the spray arm holder 600 is fixed to the spray arm holder coupler 356.

Then, the sump inserter 630 of the spray arm holder 600 is inserted into the spray arm holder seating part 53 and the fasteners 530 of the fixed gear 500 is coupled to the coupling bosses 51 of the sump cover 50, thereby finishing the process mounting the spray arm 200.

Hereinafter, the first and the second auxiliary arms 400*a* and 400*b* according to reciprocating motion of the linker 900 will be described, with reference to the accompanying drawing.

Figure 39:
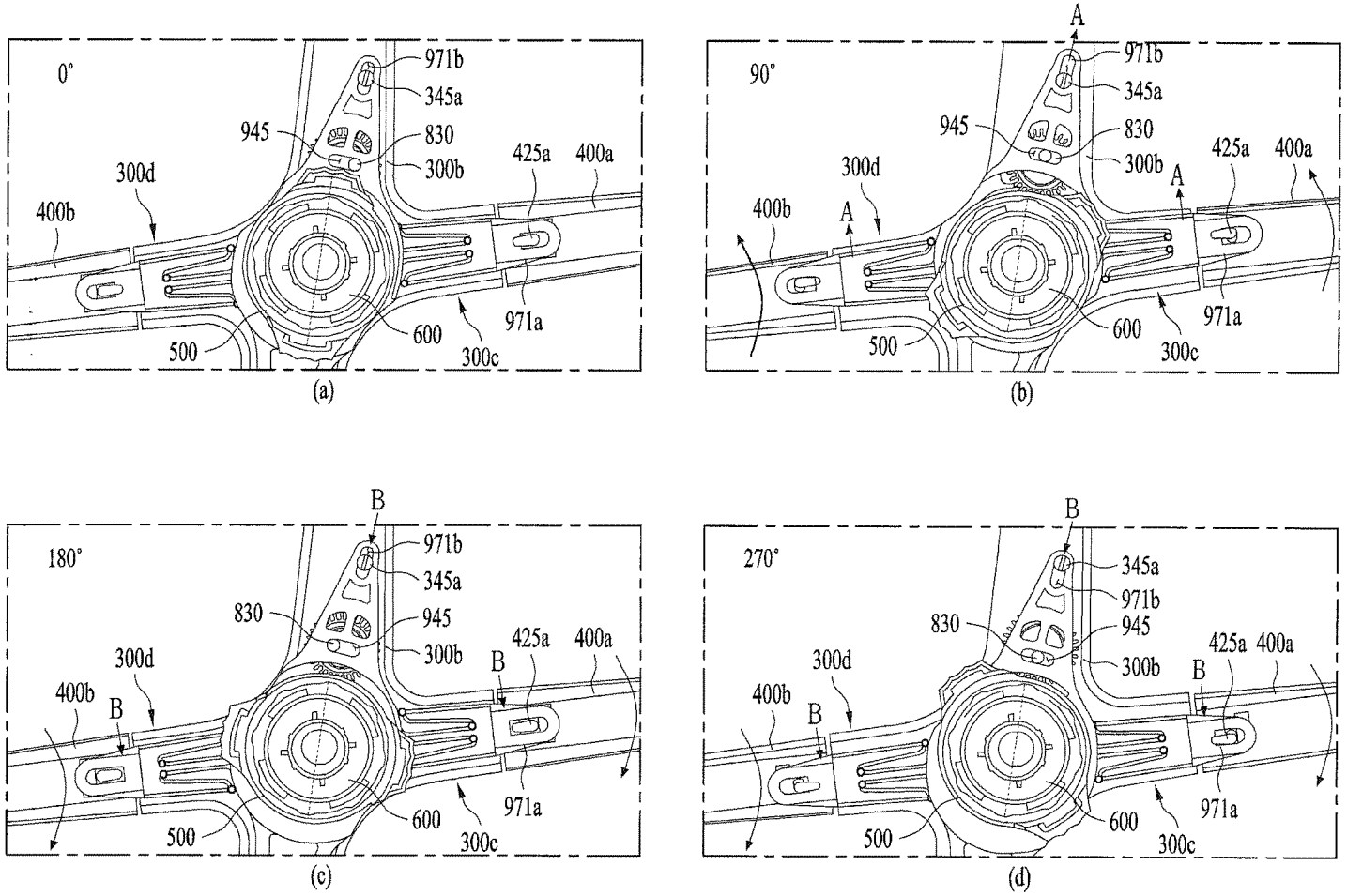
FIG. 39 is a diagram illustrating an example operation of a linker.
Figure 40:
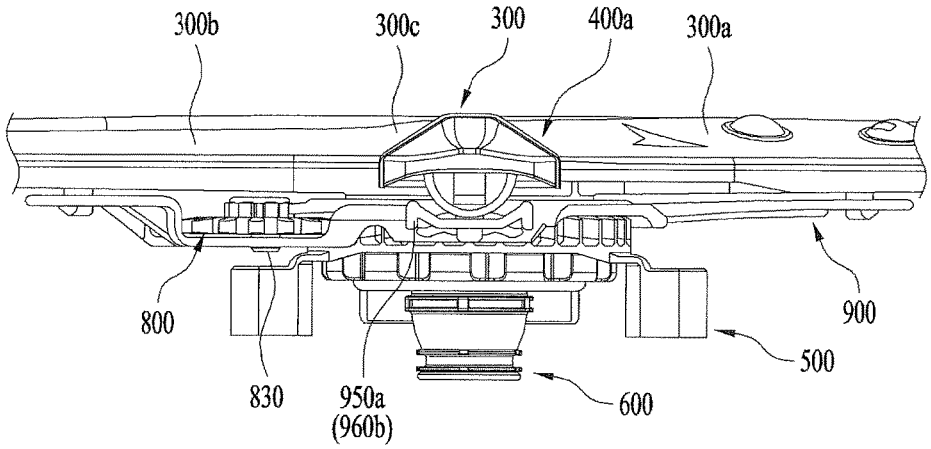
FIG. 40 is a diagram illustrating an example operation of an auxiliary arm.
Figure 40:
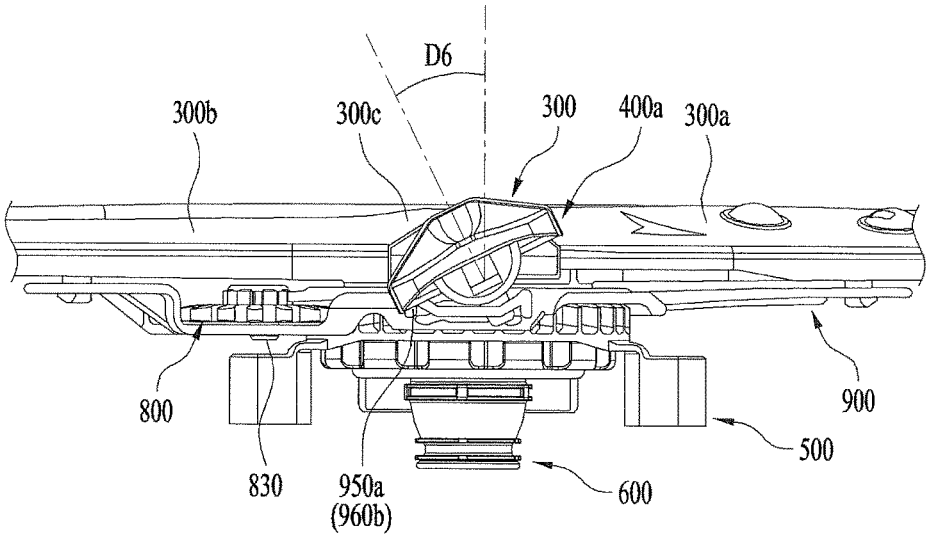

FIG. 39 illustrates an example operation of a linker. FIG. 40 illustrates an example operation of an auxiliary arm.

In this example, (a), (b), (c), and (d) of FIG. 39 are bottom views illustrating the spray arm assembly 100, in which the eccentric gears 800 are rotated at 0, 90, 180, and 270 degrees, respectively. FIG. 40(*a*) is a cross-sectional view illustrating the first spray arm without rotation and FIG. 40(*b*) is a cross-sectional view illustrating the rotated first spray arm.

Referring to FIGS. 39(*a*) and 40(*a*), when the eccentric gear 800 is not rotated i.e. is in the initial state, the eccentric protrusion 830 is provided at one side in the eccentric protrusion insertion slot 945. In this case, the first auxiliary arm 200 is provided parallel to the main arm 300. In this example, when the wash water is supplied to the spray arm 200, rotation of the spray arm 200 starts using the wash water sprayed from the first and the second main arms 300 and 300*b* or the first and the second auxiliary arms 400*a* and 400*b*.

As the spray arm 200 rotates, the eccentric gear 800 provided at the spray arm 200 is geared to the fixed gear 500 fixed to the sump cover 50 to rotate and to revolve along the outer circumferential surface of the fixed gear 500.

Referring to FIGS. 39(*b*) and 40(*b*), when the eccentric gear 800 rotates at 90 degrees in a counterclockwise direction by rotation of the spray arm 200, the eccentric protrusion 830 inserted into the eccentric protrusion insertion slot 945 of the linker 900 moves in one direction to transfer the linker 900 in one direction A.

As the linker 900 moves in one direction A, the first and the second links 920*a* and 920*b* are guided by the first and the second guide protrusions 345*a* and 345*b* formed at the first and the second main arms 300 and 300*b* so as to move. The first auxiliary link 950 rotates the pivoting protrusions 425*a* of the first and the second auxiliary arms 400*a* and 400*b* in one direction.

Accordingly, the first and the second auxiliary arms 400*a* and 400*b* rotate at a certain angle in a clockwise direction. In this example, the angle to which the first and the second auxiliary arms 400*a* and 400*b* are capable of being rotated may be about 15 to 40 degrees.

Referring to FIG. 39(*c*), when the eccentric gear 800 further rotates at 90 degrees in a counterclockwise direction by further rotation of the spray arm 200, the eccentric protrusion 830 inserted into the eccentric protrusion insertion slot 945 of the linker 900 moves in the other direction to transfer liner 900 in a direction B opposite to a direction A. Accordingly, the linker 900 is returned to its original position as illustrated in FIGS. 39(*a*) and 40(*a*). In addition, the first and the second auxiliary arms 400*a* and 400*b* are rotated by the first and the second extensions 300*c* and 300*d* in a counterclockwise direction to be returned to their original positions.

Referring to FIG. 39(*d*), when the eccentric gear 800 further rotates at 90 degrees in a counterclockwise direction by further rotation of the spray arm 200, the linker 900 is moved by the eccentric protrusion 830 along the direction B.

In this example, the first auxiliary arm 400*a* rotates to a certain angle in a counterclockwise direction (i.e. a direction opposite to a direction of FIG. 40(*b*)). In this example, the first and the second auxiliary arms 400*a* and 400*b* may rotate to about 15 to 40 degrees.

In some implementations, the first and the second auxiliary arms 400*a* and 400*b*, and the linker 900 may simultaneously rotate at the same angle. The linker 900 may perform reciprocating motion at a distance between the center of rotation of the eccentric gear 800 by rotation of the eccentric gear 800 and the eccentric protrusion 830.

Hereinafter, a principle of rotating the spray arm 200 according to spraying the wash water at the first and the second main arms 300*a* and 300*b* and the first and the second auxiliary arms 400 and 400*b* will be described.

Figure 41:
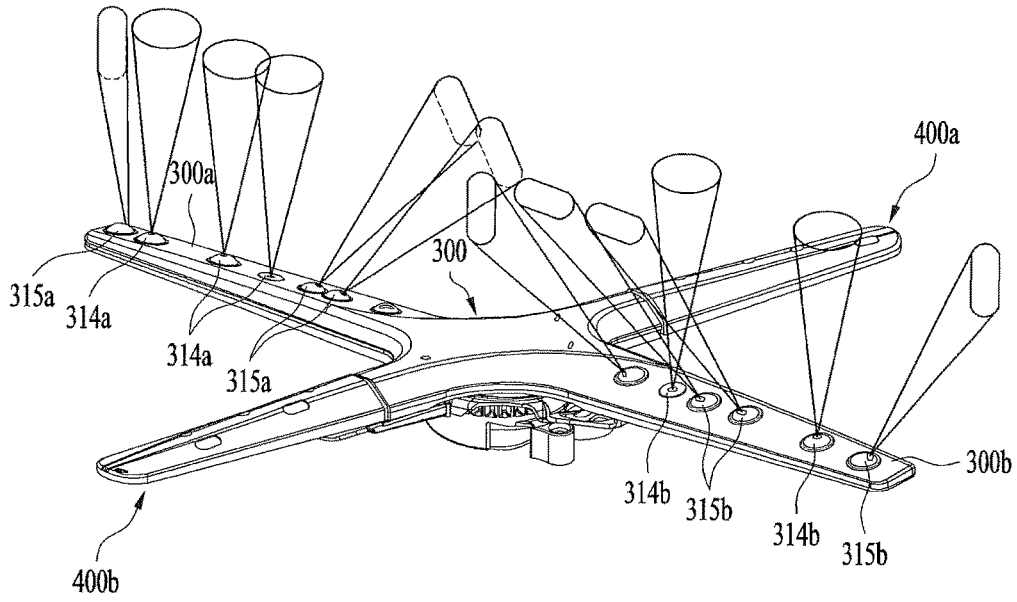
FIGS. 41 and 42 are diagrams illustrating an example operation of a spray arm.
Figure 42:
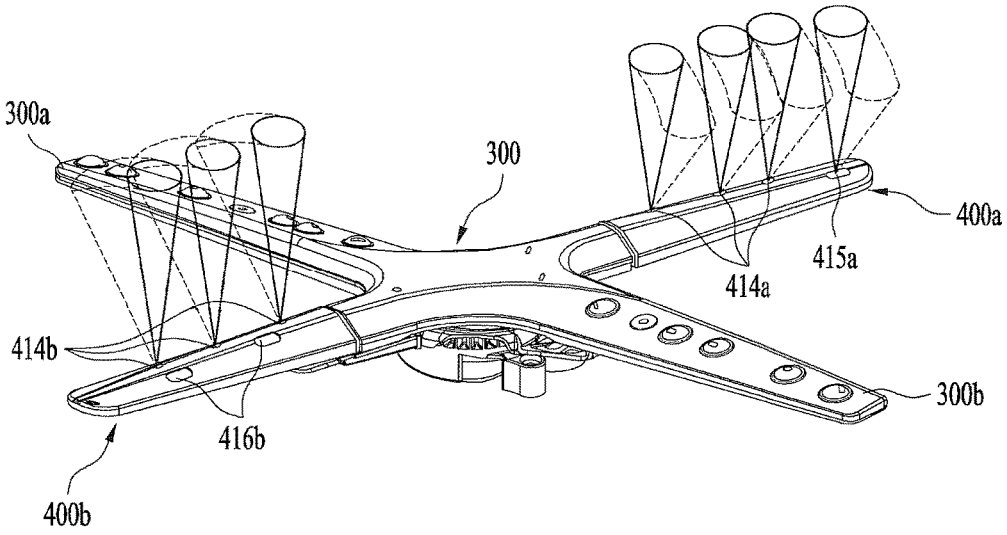
Figure 43:
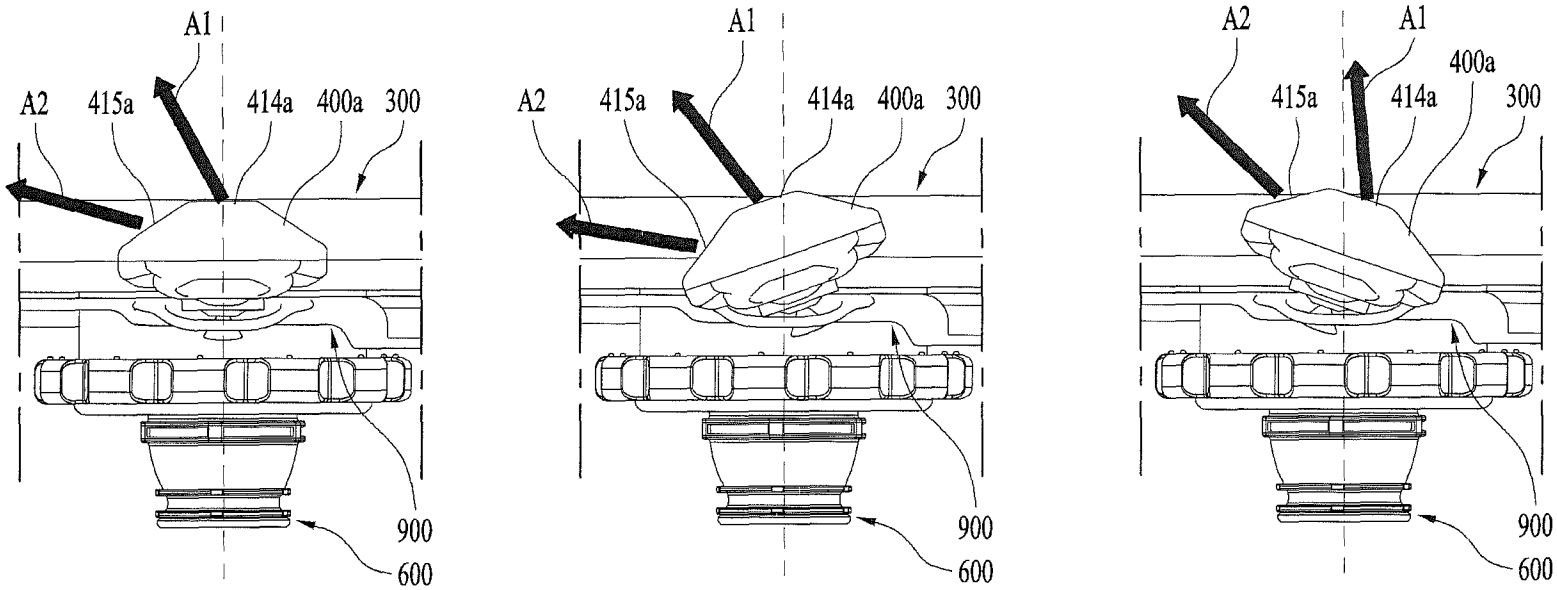
FIG. 43 is a diagram illustrating an example operation of an auxiliary arm.

FIGS. 41 and 42 illustrate an example operation of a spray arm. FIG. 43 illustrates an example operation of an auxiliary arm.

As illustrated in FIG. 41, the first and the second main arms 300*a* and 300*b* include a plurality of first and the second nozzles 314*a* and 314*b* and a plurality of first and the second inclined nozzles 315*a* and 315*b*. In detail, the first main arm 300*a* may include a plurality of first nozzles 314*a* and a plurality of first inclined nozzles 315*a*. Furthermore, the second main arm 300*b* may include a plurality of second nozzles 314*b* and a plurality of second inclined nozzles 315*b*. When the first and the second main arm inlets 354*a* and 354*b* are opened by the flow path converter 700, the wash water may be simultaneously sprayed from a plurality of first and the second nozzles 314*a* and 314*b* and a plurality of first and the second inclined nozzles 315*a* and 315*b*.

In this example, the first and the second inclined nozzles 315*a* and 315*b* spray the wash water in a direction opposite to the rotation direction of the first and the second main arms 300*a* and 300*b*. The wash water sprayed from the first and the second inclined nozzles 315*a* and 315*b* may be biased to have an acute angle with respect to a rotation plane.

Accordingly, the main arm 300 may be rotated by driving force generated by the wash water sprayed from the biased first and the second inclined nozzles 315*a* and 315*b*. That is, when the wash water is sprayed from the first and the second inclined nozzles 315*a* and 315*b*, a certain torque value capable of rotating the spray arm 200 may be generated.

In some implementations, torque applied to the spray arm 200 by the wash water sprayed from the first inclined nozzles 315*a* of the first main arm 300*a* and torque applied to the spray arm 200 by the wash water sprayed from the second inclined nozzles 315*b* of the second main arm 300*b* are oriented in the same direction with respect to the center of rotation of the spray arm 200.

In some implementations, at least one of the first and the second inclined nozzles 315*a* and 315*b* may be biased to spray the wash water at a tangent relative to the rotation trace of the spray arm 200. In this case, torque may be further increased by spraying the wash water.

In addition, the first and the second nozzles 314*a* and 314*b* may spray the wash water in a vertical direction or in the same direction as the first and the second inclined nozzles 315*a* and 315*b*. The first and the second nozzles 314*a* and 314*b* and the first and the second inclined nozzles 315*a* and 315*b* may be oriented at different angles to spray the wash water at various angles.

As illustrated in FIG. 42, the first and the second auxiliary arms 400*a* and 400*b* include a plurality of first and the second auxiliary nozzles 414*a* and 414*b* and a plurality of first and the second auxiliary inclined nozzles 415*a* and 415*b*. In detail, the first auxiliary arm 400*a* may include a plurality of first auxiliary nozzles 414*a* and a plurality of first auxiliary inclined nozzles 415*a*. Furthermore, the second auxiliary arm 400*b* may include a plurality of second auxiliary nozzles 414*b* and a plurality of second auxiliary inclined nozzles 415*b*. When the first and the second auxiliary arm inlets 354*c* and 354*d* are opened by the flow path converter 700, the wash water may be simultaneously sprayed from a plurality of first and the second auxiliary nozzles 414*a* and 414*b* and a plurality of first and the second auxiliary inclined nozzles 415*a* and 415*b*.

In this example, the first and the second auxiliary inclined nozzles 415*a* and 415*b* spray the wash water in a direction opposite to the rotation direction of the first and the second auxiliary arms 400*a* and 400*b*. The wash water sprayed from the first and the second auxiliary inclined nozzles 415*a* and 415*b* may be oriented so as to form an acute angle with respect to a rotation plane.

Accordingly, the main arm 400 may be rotated by driving force generated by the wash water sprayed from the biased first and the second auxiliary inclined nozzles 415*a* and 415*b*. That is, when the wash water is sprayed from the first and the second auxiliary inclined nozzles 415*a* and 415*b*, a certain torque value capable of rotating the spray arm 400 may be generated.

In some implementations, since the first and the second auxiliary arms 400*a* and 400*b* are rotated in the same direction, the amount of torque and directions of the sprayed wash water may be changed by the wash water sprayed from the first and the second auxiliary nozzles 414*a* and 414*b* and the first and the second auxiliary inclined nozzles 415*a* and 415*b*.

Hereinafter, spraying direction of the wash water in the first and the second auxiliary arms 400*a* and 400*b*, the first and the second auxiliary nozzles 414*a* and 414*b*, and the first and the second auxiliary inclined nozzles 415*a* and 415*b* will be described. In this example, the first and the second auxiliary arms 400*a* and 400*b* rotate in the same direction and torque is generated in the same direction. Thus, the first auxiliary arm 400*a* will be described by way of example, and a detailed description of the second auxiliary arm 400*b* will be omitted.

In this example, the change of spraying direction when the first auxiliary arm 400*a* rotates in a reciprocating manner will be described in detail with reference to the accompanying drawing.

FIG. 43 illustrates an example operation of an auxiliary arm.

In this example, FIG. 43(*a*) shows that the first auxiliary arm 400*a* does not rotate. FIG. 43(*b*) is a view showing the first auxiliary arm 400*a* maximally rotates in a clockwise direction. FIG. 43(*c*) is a view showing the first auxiliary arm 400*a* maximally rotates in a counterclockwise direction.

Referring to FIG. 43(*a*), the wash water is simultaneously sprayed from the first auxiliary nozzle 414*a* and the first auxiliary inclined nozzle 415*a*. The spraying direction A1 of the wash water by the first auxiliary nozzle 414*a* and the spraying direction A2 of the wash water by the first auxiliary inclined nozzle 415*a* may be oriented towards a left upper side.

Furthermore, each of the spraying directions A1 and A2 of the wash water sprayed from the first auxiliary nozzle 414*a* and the first auxiliary inclined nozzle 415*a* may always form an acute angle with respect to the rotation plane of the spray arm 200. Accordingly, torque may be applied to the first auxiliary arm 400*a* in a rotation direction of the spray arm 200 by the wash water sprayed from the first auxiliary nozzle 414*a* and the first auxiliary inclined nozzle 415*a*

Referring to FIG. 43(*b*), in the case where the first auxiliary arm 400*a* maximally rotates in one direction, each of the spraying directions A1 and A2 of the wash water sprayed from the first auxiliary nozzle 414*a* and the first auxiliary inclined nozzle 415*a* may be oriented in a direction opposite to the rotation direction of the spray arm 200. Thus, when the first auxiliary arm 400*a* rotates in a clockwise direction, torque may be applied to the first auxiliary arm 400*a* in a rotation direction of the spray arm 200.

Referring to FIG. 43(*c*), in the case where the first auxiliary arm 400*a* maximally rotates in the other direction, each of the spraying directions A1 and A2 of the wash water sprayed from the first auxiliary nozzle 414*a* and the first auxiliary inclined nozzle 415*a* may be oriented in a direction opposite to the rotation direction of the spray arm 200. Thus, when the first auxiliary arm 400*a* rotates in the other direction, torque may be applied to the first auxiliary arm 400*a* in a rotation direction of the spray arm 200.

In the case of the spraying direction A1 of the wash water sprayed from the first auxiliary nozzle 414*a*, when the first auxiliary arm 40 maximally rotates in the other direction, the wash water may be sprayed in a vertical upper direction. This may be a problem since torque direction applied to the spray arm 200 is changed.

Thus, the rotation angle of the first auxiliary arm 400*a* should be less than the spraying angle of the first auxiliary nozzle 414*a*. The term "spraying angle" means an angle formed by the spraying direction A1 of the wash water of the first auxiliary nozzle 414*a*, in the case where the first auxiliary arm 400 does not rotate, and a vertical line passing through the first auxiliary arm 400*a*.

Furthermore, the rotating angle of the first auxiliary arm 400*a* should be less than the spraying angle of the first auxiliary inclined nozzle 415*a*. The term "spraying angle" means the angle formed by the spraying direction A2 of the wash water of the first auxiliary inclined nozzle 415*a*, in the case where the first auxiliary arm 400 does not rotate, and a vertical line passing through the first auxiliary arm 400*a*.

Thus, even if the first auxiliary arm 400*a* maximally rotates in both directions, the spraying direction A1 of the first auxiliary nozzle 414*a* and the spraying direction A2 of the first auxiliary inclined nozzle 415*a* may be always oriented in a direction opposite to the rotation direction of the spray arm 200 such that torque may be applied to the first auxiliary arm 400*a* in the rotation direction of the spray arm 200.

In the dishwasher 1, the first and the second auxiliary arms 400*a* and 400*b* are rotatably mounted to the main arm 300 such that reciprocating rotation, as well as rotation of the main arm 30, is performed. Thereby, the spraying angles may be varied. Accordingly, washing efficiency of the dishwasher 1 may be improved.

Furthermore, the main arm 300 rotates by driving force generated by spraying the wash water while the first and the second spray arms 200 rotate. Thereby, there is no need for any separate driving source.

In addition, rotational force of the spray arm 200 may be converted into reciprocating rotational force of the first and the second auxiliary arms 400*a* and 400*b* by interaction of the fixed gear 500, the eccentric gear 800, and the linker 900. Accordingly, there is no need for any driving source for rotating the first and the second auxiliary arms 400*a* and 400*b*.

What is claimed is:

1. A dishwasher comprising:

a tub configured to accommodate an object;

a pair of main arms that extend in a first extension direction and that are configured to (i) rotate about a first axis inside the tub, (ii) receive incoming water from a water source, (iii) guide first water of the incoming water through a first flow path and second water of the incoming water through a second flow path, and (iv) spray the first water to the object;

a pair of auxiliary arms that extend in a second extension direction to define a predetermined angle with respect to the main arms, that are coupled to the main arms, and that are configured to (i) rotate about a second axis inside the tub and (ii) spray the second water to the object; and a pair of auxiliary arm connectors that are disposed at the main arms, that are configured to couple to the auxiliary arms, and that are rotatable with the auxiliary arms, the auxiliary arm connectors including:

an auxiliary flow path guide that is configured to (i) change a water flow direction of the second water from the main arms to the auxiliary arms and (ii) control water pressure of the second water, and a flow path formation rib that is disposed at an inner surface of the auxiliary flow path guide and that is configured to (i) divide the incoming water into the first water and the second water and (ii) control the water pressure of the second water based on a volume of the second water.

2. The dishwasher of claim 1, wherein the auxiliary arm connectors include:

a plurality of reinforcing ribs that are coupled to an outer surface of the auxiliary flow path guide and that are configured to support the auxiliary flow path guide.

3. The dishwasher of claim 2, wherein the auxiliary arms include:

a plurality of nozzles that are configured to spray the second water to the object, and wherein each of the plurality of reinforcing ribs includes:

one or more depressed grooves for preventing interference with the nozzles of the auxiliary arm.

4. The dishwasher of claim 1, wherein the auxiliary arms include:

one or more first auxiliary nozzles that are configured to spray a first portion of the water that has passed through the second flow path in a first direction, and one or more second auxiliary nozzles that are configured to spray a second portion of the water that has passed through the second flow path in a second direction.

5. The dishwasher of claim 4, wherein the second direction is opposite to a direction that the auxiliary arms are configured to rotate.

6. The dishwasher of claim 2, wherein the plurality of reinforcing ribs include:

one or more first reinforcing ribs that are coupled to a first portion of the auxiliary flow path guide, and one or more second reinforcing ribs that are coupled to a second portion of the auxiliary flow path guide.

7. The dishwasher of claim 6, wherein a number of the one or more second reinforcing ribs is more than a number of the one or more first reinforcing ribs.

8. The dishwasher of claim 1, further comprising:

a supporting part that is coupled to the auxiliary arms, the supporting part including a coupling hole.

9. The dishwasher of claim 8, wherein the auxiliary arm connectors include:

a shaft that is coupled to the supporting part, the shaft being configured to be inserted into the coupling hole of the supporting part, and an insertion key that protrudes from the shaft and that is configured to couple the shaft to the auxiliary arms.

10. The dishwasher of claim 9, wherein the auxiliary arms are configured to rotate within a first angle, and wherein the shaft is configured to rotate about the second axis.

11. The dishwasher of claim 9, wherein the supporting part further includes:

a key groove that is defined at the coupling hole and that is configured to receive the insertion key in a first position, and wherein the insertion key is configured to, based on the auxiliary arms being coupled to the main arms, be disposed in a second position relative to the key groove different from the first position.

12. The dishwasher of claim 11, wherein the auxiliary arms further include:

a reflective plate that is configured to block water from the coupling hole or the key groove.

13. The dishwasher of claim 1, wherein the auxiliary arm connectors further include:

an extending pipe that couples the main arms to the auxiliary flow path guide and that is configured to guide the second water to the auxiliary flow path guide.

14. The dishwasher of claim 13, wherein the extending pipe further includes:

one or more sealing ribs that are protruded from an outer surface of the extending pipe and that are configured to block water leaking between the extending pipe and the auxiliary arms, and a plurality of flow path formation protrusions that are protruded from the outer surface of the extending pipe and that are configured to flow a portion of the second water toward the sealing ribs.

15. The dishwasher of claim 1, further comprising:

a first gear that is coupled to the tub and that is configured to rotate with the main arms;

a second gear that is coupled to the main arms and that is configured to rotate based on rotation of the main arms; and a linker that is coupled to the main arms and the auxiliary arms and that is configured to rotate the auxiliary arms based on rotation of the second gear.

16. The dishwasher of claim 15, wherein the linker is configured to rotate the auxiliary arms based on elastic force.

* * * * *